US010366696B2

(12) United States Patent
Tsujino et al.

(10) Patent No.: US 10,366,696 B2
(45) **Date of Patent: *Jul. 30, 2019**

(54) SPEECH DECODER WITH HIGH-BAND GENERATION AND TEMPORAL ENVELOPE SHAPING

(71) Applicant: NTT DOCOMO, INC., Tokyo (JP)

(72) Inventors: Kosuke Tsujino, Yokohama (JP); Kei Kikuiri, Yokohama (JP); Nobuhiko Naka, Yokohama (JP)

(73) Assignee: NTT DOCOMO, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/240,746

(22) Filed: Aug. 18, 2016

(65) Prior Publication Data

US 2016/0365098 A1 Dec. 15, 2016

Related U.S. Application Data

(63) Continuation of application No. 14/152,540, filed on Jan. 10, 2014, now Pat. No. 9,460,734, which is a (Continued)

(30) Foreign Application Priority Data

Apr. 3, 2009 (JP) ..... 2009-091396
Jun. 19, 2009 (JP) ..... 2009-146831
(Continued)

(51) Int. Cl.
*G10L 19/02* (2013.01)
*G10L 19/03* (2013.01)
(Continued)

(52) U.S. Cl.
CPC ..... *G10L 19/03* (2013.01); *G10L 19/0208* (2013.01); *G10L 19/0212* (2013.01);
(Continued)

(58) Field of Classification Search
CPC ..... G10L 19/0204; G10L 19/0208; G10L 19/173; G10L 19/24; G10L 19/26
(Continued)

(56) References Cited

U.S. PATENT DOCUMENTS 6,502,069 B1 12/2002 Grill et al.
6,680,972 B1 1/2004 Liljeryd et al.
(Continued)

FOREIGN PATENT DOCUMENTS

JP 2001-521648 11/2001
JP 3366903 11/2002
(Continued)

OTHER PUBLICATIONS

Indian Office Action, dated Aug. 4, 2017, pp. 1-7, Indian Application No. 8387/DELNP/2011, Indian Patent Office, New Dehli, India.
(Continued)

*Primary Examiner* — James S Wozniak
(74) *Attorney, Agent, or Firm* — Brinks Gilson & Lione

(57) ABSTRACT

A linear prediction coefficient of a signal represented in a frequency domain is obtained by performing linear prediction analysis in a frequency direction by using a covariance method or an autocorrelation method. After the filter strength of the obtained linear prediction coefficient is adjusted, filtering may be performed in the frequency direction on the signal by using the adjusted coefficient, whereby the temporal envelope of the signal is shaped. This reduces the occurrence of pre-echo and post-echo and improves the subjective quality of the decoded signal, without significantly increasing the bit rate in a bandwidth extension technique in the frequency domain represented by SBR.

8 Claims, 50 Drawing Sheets

Related U.S. Application Data continuation of application No. 13/243,015, filed on Sep. 23, 2011, now Pat. No. 8,655,649, which is a continuation of application No. PCT/JP2010/056077, filed on Apr. 2, 2010.

(30) Foreign Application Priority Data

Jul. 8, 2009 (JP) ..... 2009-162238
Jan. 12, 2010 (JP) ..... 2010-004419

(51) Int. Cl.

*G10L 19/06* (2013.01)
*G10L 19/16* (2013.01)
*G10L 19/24* (2013.01)
*G10L 19/26* (2013.01)
*G10L 21/04* (2013.01)
*G10L 21/038* (2013.01)

(52) U.S. Cl.

CPC ..... *G10L 19/06* (2013.01); *G10L 19/167* (2013.01); *G10L 19/24* (2013.01); *G10L 19/26* (2013.01); *G10L 21/038* (2013.01); *G10L 21/04* (2013.01)

(58) Field of Classification Search

USPC ..... 704/E21.011, 500–501, 205, 211, 225
See application file for complete search history.

(56) References Cited

U.S. PATENT DOCUMENTS

| | | | | |
|---|---|---|---|---|
| 7,308,401 | B2 | 12/2007 | Tsushima et al. | |
| 7,469,206 | B2 * | 12/2008 | Kjorling | G10L 19/07 704/205 |
| 7,519,538 | B2 | 4/2009 | Villemoes et al. | |
| 7,983,424 | B2 | 7/2011 | Kjörling et al. | |
| 8,655,649 | B2 | 2/2014 | Tsujino et al. | |
| 9,064,500 | B2 | 6/2015 | Tsujino et al. | |
| 2003/0187663 | A1 | 10/2003 | Truman et al. | |
| 2004/0125878 | A1 | 7/2004 | Liljeryd et al. | |
| 2005/0171785 | A1 * | 8/2005 | Nomura | G10L 21/038 704/500 |
| 2006/0083385 | A1 * | 4/2006 | Allamanche | G10L 19/008 381/23 |
| 2006/0108543 | A1 | 5/2006 | Chang et al. | |
| 2006/0239473 | A1 | 10/2006 | Kjorling et al. | |
| 2006/0277039 | A1 | 12/2006 | Vos et al. | |
| 2007/0067162 | A1 | 3/2007 | Villemoes et al. | |
| 2007/0088541 | A1 | 4/2007 | Vos et al. | |
| 2007/0088542 | A1 * | 4/2007 | Vos | G10L 19/0208 704/219 |
| 2007/0156397 | A1 * | 7/2007 | Chong | G10L 19/032 704/229 |
| 2007/0238415 | A1 * | 10/2007 | Sinha | G10L 19/0208 455/66.1 |
| 2008/0027718 | A1 | 1/2008 | Krishnan et al. | |
| 2008/0033731 | A1 * | 2/2008 | Vinton | G10L 19/008 704/500 |
| 2008/0040103 | A1 | 2/2008 | Vinton et al. | |
| 2008/0046253 | A1 | 2/2008 | Vinton et al. | |
| 2008/0126081 | A1 | 5/2008 | Geiser et al. | |
| 2008/0126086 | A1 | 5/2008 | Vos et al. | |
| 2009/0192789 | A1 | 7/2009 | Lee et al. | |
| 2009/0192792 | A1 | 7/2009 | Lee et al. | |
| 2009/0192806 | A1 | 7/2009 | Truman et al. | |
| 2009/0201983 | A1 * | 8/2009 | Jasiuk | G10L 21/038 375/240 |
| 2009/0216544 | A1 | 8/2009 | Villemoes et al. | |
| 2009/0299755 | A1 | 12/2009 | Ragot et al. | |
| 2009/0306971 | A1 | 12/2009 | Kim et al. | |
| 2010/0063812 | A1 | 3/2010 | Gao | |
| 2010/0063827 | A1 | 3/2010 | Gao | |
| 2010/0198587 | A1 * | 8/2010 | Ramabadran | G10L 19/06 704/205 |
| 2010/0250260 | A1 | 9/2010 | Laaksonen et al. | |
| 2011/0264454 | A1 | 10/2011 | Ullberg et al. | |
| 2012/0016667 | A1 | 1/2012 | Gao | |

FOREIGN PATENT DOCUMENTS

| | | |
|---|---|---|
| JP | 2005-521907 | 7/2005 |
| JP | 3871347 | 10/2006 |
| JP | 2008-107415 | 5/2008 |
| JP | 2008-513848 | 5/2008 |
| JP | 2008-535025 | 8/2008 |
| JP | 2008-536183 | 9/2008 |
| WO | WO 2006/045371 A1 | 5/2006 |
| WO | WO 2006/107836 A1 | 10/2006 |
| WO | WO 2006/108543 A1 | 10/2006 |
| WO | WO 2007/010771 A1 | 1/2007 |
| WO | WO 2007/107670 A2 | 9/2007 |
| WO | WO 2008/046505 A1 | 4/2008 |
| WO | WO 2010/114123 A1 | 7/2010 |

OTHER PUBLICATIONS

U.S. Office Action, dated Oct. 27, 2016, pp. 1-22, issued in U.S. Appl. No. 15/240,767, U.S. Patent and Trademark Office, Alexandria, VA.

Singapore Search Report and Written Opinion, dated Aug. 23, 2013, pp. 1-19, Singapore Patent Application No. 201107092-7, Searching Authority—Danish Patent and Trademark Office, Taastrup, Denmark.

European Office Action, dated Jul. 19, 2013, pp. 1-4, European Patent Application No. 12171612.0, European Patent Office, Munich, Germany.

European Office Action, dated Jul. 24, 2013, pp. 1-4, European Patent Application No. 12171597.3, European Patent Office, Munich, Germany.

Geiser, Bernd et al., Bandwidth Extension for Hierarchical Speech and Audio Coding in ITU-T Rec. G.729.1, IEEE Transactions on Audio Speech and Language Processing, vol. 15, No. 8, Nov. 2007, pp. 2496-2509.

Herre, Jürgen et al., "Enhancing the Performance of Perceptual Audio Coders by Using Temporal Noise Shaping (TNS)," Presented at the 101st Convention of the AES (Audio Engineering Society), Nov. 1996, 25 pages.

Kikuiri, Kei et al., "Core Experiment Proposal on the eSBR module of USAC," International Organisation for Standardisation, ISO/IEC JTC1/SC29/WG11, Coding of Moving Pictures and Audio, MPEG Meeting, Apr. 2009, 8 pages.

Kikuiri, Kei et al., "Report on Enhanced Temporal Envelope Shaping CE for USAC," International Organisation for Standardisation, ISO/IEC JTC1/SC29/WG11, Coding of Moving Pictures and Audio, MPEG Meeting, Jul. 2009, 18 pages.

Meltzer, Stefan et al., "MPEG-4 HE-AAC v2—audio coding for today's digital media world," Audio compression, Coding technologies, EBU Technical Review, Retrieved from the Internet: http://tech.ebu.ch/Jahia/site/tech/cac/he/bypass/publications, Jan. 2006, 12 pages.

Unknown author, WD on ISO/IEC 14496-3, MPEG-4 Audio, Fourth Edition, Section 4.6.18, "SBR tool," © ISO/IEC, 2005, Motion Picture Expert Group or ISO/IEC JTC1/SC29/WG11, Jul. 2007, pp. 215-251.

Unknown author, "3rd Generation Partnership Project; Technical Specification Group Services and System Aspects; General audio codec audio processing functions; Enhanced aacPlus general audio codec; Enhanced aacPlus encoder Sbr part (Release 8)," 3GPP TS 26.404, 3rd Generation Partnership Project, V8.0.0, Technical Specification, Dec. 2008, 34 pages.

Office Action from Australian Application No. 2010232219, dated Sep. 10, 2012, 3 pages.

Office Action from Australian Application No. 2012204070, dated Sep. 11, 2012, 4 pages.

(56) References Cited

OTHER PUBLICATIONS

Extended European Search Report for European Application No. 10758890.7, dated Aug. 16, 2012, 16 pages.
Extended European Search Report for European Application No. 12171597.3, dated Aug. 23, 2012, 9 pages.
Extended European Search Report for European Application No. 12171612.0, dated Aug. 23, 2012, 8 pages.
Extended European Search Report for European Application No. 12171613.8, dated Aug. 23, 2012, 8 pages.
Extended European Search Report for European Application No. 12171603.9, dated Sep. 12, 2012, 8 pages.
Examination Report from European Application No. 10758890.7, dated Feb. 11, 2013, 7 pages.
Office Action from Russian Application No. 2011144573/20, dated Jan. 16, 2012, 4 pages.
Office Action from Russian Application No. 2012130462/08, dated Mar. 8, 2013, 5 pages.
Office Action from Russian Application No. 2012130472/08, dated Mar. 8, 2013, 5 pages.
Office Action from Russian Application No. 2011144573/20, dated Apr. 5, 2013, 11 pages.
International Search Report issued by the Japanese Patent Office as International Searching Authority, in PCT Patent Application No. PCT/JP2010/056077, dated Jul. 6, 2010 (2 pgs.).
Moriya, T., "Audio Coding Technologies and the MPEG Standards," The Journal of the Institute of Electrical Engineers of Japan, Jul. 1, 2007, vol. 127, No. 7, pp. 407-410; (with 14 page English translation—total 18 pgs.).
Herre et al. "MPEG Surround-the ISO/MPEG standard for efficient and compatible multi-channel audio coding." 122$^{nd}$ Convention of the Audio Engineering Society, J. Audio Eng. Soc. (Abstracts), Sep. 2008, pp. 932-955.
Sinha, Deepen, and E.V. Harinarayanan. "A Novel Integrated Audio Bandwidth Extension Toolkit (ABET)." The preprints of 120$^{th}$ Conventino of the Audio Engineering Socieety, 2006, pp. 1-12.
Villemoes, Lars, et al., "MPEG Surround: the forthcoming ISO standard for spatial audio coding," 28th Int. Conf. (Piteå, Sweden, 2006), Jul. 2006, pp. 1-18.
Korean Office Action with English translation, dated Jan. 18, 2016, pp. 1-9, issued in Korean Patent Application No. 10-2012-7016478, Korean Intellectual Property Office, Daejeon, Republic of Korea.
European Office Action, dated Jul. 24, 2013, pp. 1-4, issued in European Patent Application No. 12171597.3, European Patent Office, Munich, Germany.
Decision to Grant a European Patent, dated Apr. 14, 2016, pp. 1-3, issued in European Patent Application No. 12171597.3, European Patent Office, Munich, Germany.
U.S. Office Action, dated Apr. 12, 2017, pp. 1-18, issued in U.S. Appl. No. 15/240,767, U.S. Patent and Trademark Office, Alexandria, VA.
Krishnan, Venkat, et al. "EVRC-Wideband: the new 3GPP2 wideband vocoder standard." Acoustics, Speech and Signal Processing, 2007. ICASSP 2007. IEEE International Conference vol. 2, IEEE, Apr. 2007, pp. 333-336.
Sinha et al. "A fractal self-similarity model for the spectral representation of audio signals." Presented at 118$^{th}$ Convention of the Audio Engineering Society, Barcelona Spain, May 28-31, 2005, pp. 1-11.
Office Action from co-pending U.S. Appl. No. 13/243,015, dated Mar. 18, 2013, pp. 1-12.
Indian Office Action, dated Jul. 31, 2018, pp. 1-6, issued in India Patent Application No. 5694/DELNP/2012, India Patent Office, Delhi, India.
Indian Office Action, dated Jul. 31, 2018, pp. 1-6, issued in India Patent Application No. 5696/DELNP/2012, India Patent Office, Delhi, India.
Indian Office Action, dated Oct. 5, 2018, pp. 1-7, issued in India Patent Application No. 5694/DELNP/2012, India Patent Office, Delhi, India.

* cited by examiner

SPEECH DECODER WITH HIGH-BAND GENERATION AND TEMPORAL ENVELOPE SHAPING

This application is a continuation of U.S. patent application Ser. No. 14/152,540 filed Jan. 10, 2014, which is a continuation of U.S. patent application Ser. No. 13/243,015 filed Sep. 23, 2011 (now U.S. Pat. No. 8,655,649 issued Feb. 18, 2014), which is a continuation of PCT/JP2010/056077, filed Apr. 2, 2010, which claims the benefit of the filing date under 35 U.S.C. § 119(e) of JP2009-091396, filed Apr. 3, 2009; JP2009-146831, filed Jun. 19, 2009; JP2009-162238, filed Jul. 8, 2009; and JP2010-004419, filed Jan. 12, 2010; all of which are incorporated herein by reference.

TECHNICAL FIELD

The present invention relates to a speech encoding/decoding system that includes a speech encoding device, a speech decoding device, a speech encoding method, a speech decoding method, a speech encoding program, and a speech decoding program.

BACKGROUND ART

Speech and audio coding techniques for compressing the amount of data of signals into a few tenths by removing information not required for human perception by using psychoacoustics are extremely important in transmitting and storing signals. Examples of widely used perceptual audio coding techniques include "MPEG4 AAC" standardized by "ISO/IEC MPEG".

SUMMARY OF INVENTION

Temporal Envelope Shaping (TES) is a technique utilizing the fact that a signal on which decorrelation has not yet been performed has a less distorted temporal envelope. However, in a decoder such as a Spectral Band Replication (SBR) decoder, the high frequency component of a signal may be copied from the low frequency component of the signal. Accordingly, it may not be possible to obtain a less distorted temporal envelope with respect to the high frequency component. A speech encoding/decoding system may provide a method of analyzing the high frequency component of an input signal in an SBR encoder, quantizing the linear prediction coefficients obtained as a result of the analysis, and multiplexing them into a bit stream to be transmitted. This method allows the SBR decoder to obtain linear prediction coefficients including information with less distorted temporal envelope of the high frequency component. However, in some cases, a large amount of information may be required to transmit the quantized linear prediction coefficients, thereby significantly increasing the bit rate of the whole encoded bit stream. The speech encoding/decoding system also provides a reduction in the occurrence of pre-echo and post-echo which may improve the subjective quality of the decoded signal, without significantly increasing the bit rate in the bandwidth extension technique in the frequency domain represented by SBR.

The speech encoding/decoding system may include a speech encoding device for encoding a speech signal. In one embodiment, the speech encoding device includes: a processor, a core encoding unit executable with the processor to encode a low frequency component of the speech signal; a temporal envelope supplementary information calculating unit executable with the processor to calculate temporal envelope supplementary information to obtain an approximation of a temporal envelope of a high frequency component of the speech signal by using a temporal envelope of the low frequency component of the speech signal; and bit stream multiplexing unit executable with the processor to generate a bit stream in which at least the low frequency component encoded by the core encoding unit and the temporal envelope supplementary information calculated by the temporal envelope supplementary information calculating unit are multiplexed.

In the speech encoding device of the speech encoding/decoding system, the temporal envelope supplementary information preferably represents a parameter indicating a sharpness of variation in the temporal envelope of the high frequency component of the speech signal in a predetermined analysis interval.

The speech encoding device may further include a frequency transform unit executable with the processor to transform the speech signal into a frequency domain, and the temporal envelope supplementary information calculating is further executable to calculate the temporal envelope supplementary information based on high frequency linear prediction coefficients obtained by performing linear prediction analysis in a frequency direction on coefficients in high frequencies of the speech signal transformed into the frequency domain by the frequency transform unit.

In the speech encoding device of the speech encoding/decoding system, the temporal envelope supplementary information calculating unit may be further executable to perform linear prediction analysis in a frequency direction on coefficients in low frequencies of the speech signal transformed into the frequency domain by the frequency transform unit to obtain low frequency linear prediction coefficients. The temporal envelope supplementary information calculating unit may also be executable to calculate the temporal envelope supplementary information based on the low frequency linear prediction coefficients and the high frequency linear prediction coefficients.

In the speech encoding device of the speech encoding/decoding system, the temporal envelope supplementary information calculating unit may be further executable to obtain at least two prediction gains from at least each of the low frequency linear prediction coefficients and the high frequency linear prediction coefficients. The temporal envelope supplementary information calculating unit may also be executable to calculate the temporal envelope supplementary information based on magnitudes of the at least two prediction gains.

In the speech encoding device of the speech encoding/decoding system, the temporal envelope supplementary information calculating unit may also be executed to separate the high frequency component from the speech signal, obtain temporal envelope information represented in a time domain from the high frequency component, and calculate the temporal envelope supplementary information based on a magnitude of temporal variation of the temporal envelope information.

In the speech encoding device of the speech encoding/decoding system, the temporal envelope supplementary information may include differential information for obtaining high frequency linear prediction coefficients by using low frequency linear prediction coefficients obtained by performing linear prediction analysis in a frequency direction on the low frequency component of the speech signal.

The speech encoding device of the speech encoding/decoding system may further include a frequency transform unit executable with a processor to transform the speech signal into a frequency domain. The temporal envelope supplementary information calculating unit may be further executable to perform linear prediction analysis in a frequency direction on each of the low frequency component and the high frequency component of the speech signal transformed into the frequency domain by the frequency transform unit to obtain low frequency linear prediction coefficients and high frequency linear prediction coefficients. The temporal envelope supplementary information calculating unit may also be executable to obtain the differential information by obtaining a difference between the low frequency linear prediction coefficients and the high frequency linear prediction coefficients.

In the speech encoding device of the speech encoding/decoding system, the differential information may represent differences between linear prediction coefficients. The linear prediction coefficients may be represented in any one or more domains that include LSP (Linear Spectrum Pair), ISP (Immittance Spectrum Pair), LSF (Linear Spectrum Frequency), ISF (Immittance Spectrum Frequency), and PARCOR coefficients.

A speech encoding device of the speech encoding/decoding system may include a plurality of units executable with a processor. The speech encoding device may be for encoding a speech signal and in one embodiment may include: a core encoding unit for encoding a low frequency component of the speech signal; a frequency transform unit for transforming the speech signal to a frequency domain; a linear prediction analysis unit for performing linear prediction analysis in a frequency direction on coefficients in high frequencies of the speech signal transformed into the frequency domain by the frequency transform unit to obtain high frequency linear prediction coefficients; a prediction coefficient decimation unit for decimating the high frequency linear prediction coefficients obtained by the linear prediction analysis unit in a temporal direction; a prediction coefficient quantizing unit for quantizing the high frequency linear prediction coefficients decimated by the prediction coefficient decimation unit; and a bit stream multiplexing unit for generating a bit stream in which at least the low frequency component encoded by the core encoding unit and the high frequency linear prediction coefficients quantized by the prediction coefficient quantizing unit are multiplexed.

A speech decoding device of the speech encoding/decoding system is a speech decoding device for decoding an encoded speech signal and may include: a processor; a bit stream separating unit executable by the processor to separate a bit stream that includes the encoded speech signal into an encoded bit stream and temporal envelope supplementary information. The bit stream may be received from outside the speech decoding device. The speech decoding device may further include a core decoding unit executable with the processor to decode the encoded bit stream separated by the bit stream separating unit to obtain a low frequency component; a frequency transform unit executable with the processor to transform the low frequency component obtained by the core decoding unit to a frequency domain; a high frequency generating unit executable with the processor to generate a high frequency component by copying the low frequency component transformed into the frequency domain by the frequency transform unit from low frequency bands to high frequency bands; a low frequency temporal envelope calculation unit executable with the processor to calculate the low frequency component transformed into the frequency domain by the frequency transform unit to obtain temporal envelope information; a temporal envelope adjusting unit executable with the processor to adjust the temporal envelope information obtained by the low frequency temporal envelope analysis unit by using the temporal envelope supplementary information, and a temporal envelope shaping unit executable with the processor to shape a temporal envelope of the high frequency component generated by the high frequency generating unit by using the temporal envelope information adjusted by the temporal envelope adjusting unit.

The speech decoding device of the speech encoding/decoding system may further include a high frequency adjusting unit executable with the processor to adjust the high frequency component, and the frequency transform unit may be a filter bank, such as a 64-division quadrature mirror filter (QMF) filter bank with real or complex coefficients, and the frequency transform unit, the high frequency generating unit, and the high frequency adjusting unit may operate based on a decoder, such as a Spectral Band Replication (SBR) decoder for "MPEG4 AAC" defined in "ISO/IEC 14496-3".

In the speech decoding device of the speech encoding/decoding system the low frequency temporal envelope analysis unit may be executed to perform linear prediction analysis in a frequency direction on the low frequency component transformed into the frequency domain by the frequency transform unit to obtain low frequency linear prediction coefficients, the temporal envelope adjusting unit may be executed to adjust the low frequency linear prediction coefficients by using the temporal envelope supplementary information, and the temporal envelope shaping unit may be executed to perform linear prediction filtering in a frequency direction on the high frequency component in the frequency domain generated by the high frequency generating unit, by using linear prediction coefficients adjusted by the temporal envelope adjusting unit, to shape a temporal envelope of a speech signal.

In the speech decoding device of the speech encoding/decoding system the low frequency temporal envelope analysis unit may be executed to obtain temporal envelope information of a speech signal by obtaining power of each time slot of the low frequency component transformed into the frequency domain by the frequency transform unit, the temporal envelope adjusting unit may be executed to adjust the temporal envelope information by using the temporal envelope supplementary information, and the temporal envelope shaping unit may be executed to superimpose the adjusted temporal envelope information on the high frequency component in the frequency domain generated by the high frequency generating unit to shape a temporal envelope of a high frequency component with the adjusted temporal envelope information.

In the speech decoding device of the speech encoding/decoding system the low frequency temporal envelope analysis unit may be executed to obtain temporal envelope information of a speech signal by obtaining at least one power value of each filterbank, such as a QMF subband sample of the low frequency component transformed into the frequency domain by the frequency transform unit, the temporal envelope adjusting unit may be executed to adjust the temporal envelope information by using the temporal envelope supplementary information, and the temporal envelope shaping unit may be executed to shape a temporal envelope of a high frequency component by multiplying the high frequency component in the frequency domain generated by the high frequency generating unit by the adjusted temporal envelope information.

In the speech decoding device of the speech encoding/decoding system, the temporal envelope supplementary information may represent a filter strength parameter used for adjusting strength of linear prediction coefficients. In the speech decoding device of the speech encoding/decoding system, the temporal envelope supplementary information may represent a parameter indicating magnitude of temporal variation of the temporal envelope information.

In the speech decoding device of the speech encoding/decoding system, the temporal envelope supplementary information may include differential information of linear prediction coefficients with respect to the low frequency linear prediction coefficients.

In the speech decoding device of the speech encoding/decoding system, the differential information may represent differences between linear prediction coefficients. The linear prediction coefficients may be represented in any one or more domains that include LSP (Linear Spectrum Pair), ISP (Immittance Spectrum Pair), LSF (Linear Spectrum Frequency), ISF (Immittance Spectrum Frequency), and PARCOR coefficient.

In the speech decoding device of the speech encoding/decoding system the low frequency temporal envelope analysis unit may be executable to perform linear prediction analysis in a frequency direction on the low frequency component transformed into the frequency domain by the frequency transform unit to obtain the low frequency linear prediction coefficients, and obtain power of each time slot of the low frequency component in the frequency domain to obtain temporal envelope information of a speech signal, the temporal envelope adjusting unit may be executed to adjust the low frequency linear prediction coefficients by using the temporal envelope supplementary information and adjust the temporal envelope information by using the temporal envelope supplementary information, and the temporal envelope shaping unit may be executed to perform linear prediction filtering in a frequency direction on the high frequency component in the frequency domain generated by the high frequency generating unit by using the linear prediction coefficients adjusted by the temporal envelope adjusting unit to shape a temporal envelope of a speech signal, and shape a temporal envelope of the the high frequency component by superimposing the temporal envelope information adjusted by the temporal envelope adjusting unit on the high frequency component in the frequency domain.

In the speech decoding device of the speech encoding/decoding system the low frequency temporal envelope analysis unit may be executable to perform linear prediction analysis in a frequency direction on the low frequency component transformed into the frequency domain by the frequency transform unit to obtain the low frequency linear prediction coefficients, and obtain temporal envelope information of a speech signal by obtaining power of each filterbank sample, such as a QMF subband sample, of the low frequency component in the frequency domain, the temporal envelope adjusting unit may be executed to adjust the low frequency linear prediction coefficients by using the temporal envelope supplementary information and adjust the temporal envelope information by using the temporal envelope supplementary information, and the temporal envelope shaping unit may be executed to perform linear prediction filtering in a frequency direction on a high frequency component in the frequency domain generated by the high frequency generating unit by using linear prediction coefficients adjusted by the temporal envelope adjusting unit to shape a temporal envelope of a speech signal, and shape a temporal envelope of the high frequency component by multiplying the high frequency component in the frequency domain by the adjusted temporal envelope information.

In the speech decoding device of the speech encoding/decoding system, the temporal envelope supplementary information preferably represents a parameter indicating both filter strength of linear prediction coefficients and a magnitude of temporal variation of the temporal envelope information.

A speech decoding device of the speech encoding/decoding system is a speech decoding device that includes a plurality of units executable with a processor for decoding an encoded speech signal. In one embodiment, the speech decoding device may include: a bit stream separating unit for separating a bit stream from outside the speech decoding device that includes the encoded speech signal into an encoded bit stream and linear prediction coefficients, a linear prediction coefficients interpolation/extrapolation unit for interpolating or extrapolating the linear prediction coefficients in a temporal direction, and a temporal envelope shaping unit for performing linear prediction filtering in a frequency direction on a high frequency component represented in a frequency domain by using linear prediction coefficients interpolated or extrapolated by the linear prediction coefficients interpolation/extrapolation unit to shape a temporal envelope of a speech signal.

A speech encoding method of the speech encoding/decoding system may use a speech encoding device for encoding a speech signal. The method includes: a core encoding step in which the speech encoding device encodes a low frequency component of the speech signal; a temporal envelope supplementary information calculating step in which the speech encoding device calculates temporal envelope supplementary information for obtaining an approximation of a temporal envelope of a high frequency component of the speech signal by using a temporal envelope of a low frequency component of the speech signal; and a bit stream multiplexing step in which the speech encoding device generates a bit stream in which at least the low frequency component encoded in the core encoding step and the temporal envelope supplementary information calculated in the temporal envelope supplementary information calculating step are multiplexed.

A speech encoding method of the speech encoding/decoding system may use a speech encoding device for encoding a speech signal. The method including: a core encoding step in which the speech encoding device encodes a low frequency component of the speech signal; a frequency transform step in which the speech encoding device transforms the speech signal into a frequency domain; a linear prediction analysis step in which the speech encoding device obtains high frequency linear prediction coefficients by performing linear prediction analysis in a frequency direction on coefficients in high frequencies of the speech signal transformed into the frequency domain in the frequency transform step; a prediction coefficient decimation step in which the speech encoding device decimates the high frequency linear prediction coefficients obtained in the linear prediction analysis step in a temporal direction; a prediction coefficient quantizing step in which the speech encoding device quantizes the high frequency linear prediction coefficients decimated in the prediction coefficient decimation step; and a bit stream multiplexing step in which the speech encoding device generates a bit stream in which at least the low frequency component encoded in the core encoding step and the high frequency linear prediction coefficients quantized in the prediction coefficients quantizing step are multiplexed.

A speech decoding method of the speech encoding/decoding system may use a speech decoding device for decoding an encoded speech signal. The method may include: a bit stream separating step in which the speech decoding device separates a bit stream from outside the speech decoding device that includes the encoded speech signal into an encoded bit stream and temporal envelope supplementary information; a core decoding step in which the speech decoding device obtains a low frequency component by decoding the encoded bit stream separated in the bit stream separating step; a frequency transform step in which the speech decoding device transforms the low frequency component obtained in the core decoding step into a frequency domain; a high frequency generating step in which the speech decoding device generates a high frequency component by copying the low frequency component transformed into the frequency domain in the frequency transform step from a low frequency band to a high frequency band; a low frequency temporal envelope analysis step in which the speech decoding device obtains temporal envelope information by analyzing the low frequency component transformed into the frequency domain in the frequency transform step; a temporal envelope adjusting step in which the speech decoding device adjusts the temporal envelope information obtained in the low frequency temporal envelope analysis step by using the temporal envelope supplementary information; and a temporal envelope shaping step in which the speech decoding device shapes a temporal envelope of the high frequency component generated in the high frequency generating step by using the temporal envelope information adjusted in the temporal envelope adjusting step.

A speech decoding method of the speech encoding/decoding system may use a speech decoding device for decoding an encoded speech signal. The method may include: a bit stream separating step in which the speech decoding device separates a bit stream including the encoded speech signal into an encoded bit stream and linear prediction coefficients. The bit stream received from outside the speech decoding device. The method may also include a linear prediction coefficient interpolating/extrapolating step in which the speech decoding device interpolates or extrapolates the linear prediction coefficients in a temporal direction; and a temporal envelope shaping step in which the speech decoding device shapes a temporal envelope of a speech signal by performing linear prediction filtering in a frequency direction on a high frequency component represented in a frequency domain by using the linear prediction coefficients interpolated or extrapolated in the linear prediction coefficient interpolating/extrapolating step.

The speech encoding/decoding system may also include an embodiment of a speech encoding program stored in a non-transitory computer readable medium. The speech encoding/decoding system may cause a computer, or processor, to execute instructions included in the computer readable medium. The computer readable medium includes: instructions to cause a core encoding unit to encode a low frequency component of the speech signal; instructions to cause a temporal envelope supplementary information calculating unit to calculate temporal envelope supplementary information to obtain an approximation of a temporal envelope of a high frequency component of the speech signal by using a temporal envelope of the low frequency component of the speech signal; and instructions to cause a bit stream multiplexing unit to generate a bit stream in which at least the low frequency component encoded by the core encoding unit and the temporal envelope supplementary information calculated by the temporal envelope supplementary information calculating unit are multiplexed.

The speech encoding/decoding system may also include an embodiment of a speech encoding program stored in a non-transitory computer readable medium, which may cause a computer, or processor, to execute instructions included in the computer readable medium that include: instructions to cause a core encoding unit to encode a low frequency component of the speech signal; instructions to cause a frequency transform unit to transform the speech signal into a frequency domain; instructions to cause a linear prediction analysis unit to perform linear prediction analysis in a frequency direction on coefficients in high frequencies of the speech signal transformed into the frequency domain by the frequency transform unit to obtain high frequency linear prediction coefficients; instruction to cause a prediction coefficient decimation unit to decimate the high frequency linear prediction coefficients obtained by the linear prediction analysis unit in a temporal direction; instructions to cause a prediction coefficient quantizing unit to quantize the high frequency linear prediction coefficients decimated by the prediction coefficient decimation unit; and instructions to cause a bit stream multiplexing unit to generate a bit stream in which at least the low frequency component encoded by the core encoding unit and the high frequency linear prediction coefficients quantized by the prediction coefficient quantizing unit are multiplexed.

The speech encoding/decoding system may also include an embodiment of a speech decoding program stored in a non-transitory computer readable medium. The image encoding/decoding system may cause a computer, or processor, to execute instructions included in the computer readable medium. The computer readable medium includes: instruction to cause a bit stream separating unit to separate a bit stream that include the encoded speech signal into an encoded bit stream and temporal envelope supplementary information. The bit stream received from outside the computer readable medium. The computer readable medium may also include instructions to cause a core decoding unit to decode the encoded bit stream separated by the bit stream separating unit to obtain a low frequency component; instructions to cause a frequency transform unit to transform the low frequency component obtained by the core decoding unit into a frequency domain; instructions to cause a high frequency generating unit to generate a high frequency component by copying the low frequency component transformed into the frequency domain by the frequency transform unit from a low frequency band to a high frequency band; instructions to cause a low frequency temporal envelope analysis unit to analyze the low frequency component transformed into the frequency domain by the frequency transform unit to obtain temporal envelope information; instruction to cause a temporal envelope adjusting unit to adjust the temporal envelope information obtained by the low frequency temporal envelope analysis unit by using the temporal envelope supplementary information; and instructions to cause a temporal envelope shaping unit to shape a temporal envelope of the high frequency component generated by the high frequency generating unit by using the temporal envelope information adjusted by the temporal envelope adjusting unit.

The speech encoding/decoding system may also include an embodiment of a speech decoding program stored in a non-transitory computer readable medium. The image encoding/decoding system may cause a computer, or processor, to execute instructions included in the computer readable medium. The computer readable medium includes:

instructions to cause a bit steam separating unit to separate a bit stream that includes the encoded speech signal into an encoded bit stream and linear prediction coefficients. The bit stream received from outside the computer readable medium. The computer readable medium also including instruction to cause a linear prediction coefficient interpolation/extrapolation unit to interpolate or extrapolate the linear prediction coefficients in a temporal direction; and instructions to cause a temporal envelope shaping unit to perform linear prediction filtering in a frequency direction on a high frequency component represented in a frequency domain by using linear prediction coefficients interpolated or extrapolated by the linear prediction coefficient interpolation/extrapolation unit to shape a temporal envelope of a speech signal.

In an embodiment of the speech encoding/decoding system, the computer readable medium may also include instruction to cause the temporal envelope shaping unit to adjust at least one power value of a high frequency component obtained as a result of the linear prediction filtering. The at least power value adjusted by the temporal envelope shaping unit after performance of the linear prediction filtering in the frequency direction on the high frequency component in the frequency domain generated by the high frequency generating unit. The at least one power value is adjusted to a value equivalent to that before the linear prediction filtering.

In an embodiment of the speech encoding/decoding system the computer readable medium further includes instructions to cause the temporal envelope shaping unit, after performing the linear prediction filtering in the frequency direction on the high frequency component in the frequency domain generated by the high frequency generating unit, to adjust power in a certain frequency range of a high frequency component obtained as a result of the linear prediction filtering to a value equivalent to that before the linear prediction filtering.

In an embodiment of the speech encoding/decoding system, the temporal envelope supplementary information may be a ratio of a minimum value to an average value of the adjusted temporal envelope information.

In an embodiment of the speech encoding/decoding system, the computer readable medium further includes instructions to cause the temporal envelope shaping unit to shape a temporal envelope of the high frequency component by multiplying the temporal envelope whose gain is controlled by the high frequency component in the frequency domain. The temporal envelope of the high frequency component shaped by the temporal envelope shaping unit after controlling a gain of the adjusted temporal envelope so that power of the high frequency component in the frequency domain in an SBR envelope time segment is equivalent before and after shaping of the temporal envelope.

In the speech encoding/decoding system, the computer readable medium further includes instructions to cause the low frequency temporal envelope analysis unit to obtain at least one power value of each QMF subband sample of the low frequency component transformed to the frequency domain by the frequency transform unit, and obtains temporal envelope information represented as a gain coefficient to be multiplied by each of the QMF subband samples, by normalizing the power of each of the QMF subband samples by using average power in an SBR envelope time segment.

The speech encoding/decoding system may also include an embodiment of a speech decoding device for decoding an encoded speech signal. The speech decoding device including a plurality of units executable with a processor. The speech decoding device may include: a core decoding unit executable to obtain a low frequency component by decoding a bit stream that includes the encoded speech signal. The bit stream received from outside the speech decoding device. The speech decoding device may also include a frequency transform unit executable to transform the low frequency component obtained by the core decoding unit into a frequency domain; a high frequency generating unit executable to generate a high frequency component by copying the low frequency component transformed into the frequency domain by the frequency transform unit from a low frequency band to a high frequency band; a low frequency temporal envelope analysis unit executable to analyze the low frequency component transformed into the frequency domain by the frequency transform unit to obtain temporal envelope information; a temporal envelope supplementary information generating unit executable to analyze the bit stream to generate temporal envelope supplementary information; a temporal envelope adjusting unit executable to adjust the temporal envelope information obtained by the low frequency temporal envelope analysis unit by using the temporal envelope supplementary information; and a temporal envelope shaping unit executable to shape a temporal envelope of the high frequency component generated by the high frequency generating unit by using the temporal envelope information adjusted by the temporal envelope adjusting unit.

The speech decoding device of the speech encoding/decoding system of one embodiment may also include a primary high frequency adjusting unit and a secondary high frequency adjusting unit, both corresponding to the high frequency adjusting unit. The primary high frequency adjusting unit is executable to perform a process including a part of a process corresponding to the high frequency adjusting unit. The temporal envelope shaping unit is executable to shape a temporal envelope of an output signal of the primary high frequency adjusting unit. The secondary high frequency adjusting unit executable to perform a process not executed by the primary high frequency adjusting unit among processes corresponding to the high frequency adjusting unit. The process performed on an output signal of the temporal envelope shaping unit, and the secondary high frequency adjusting unit as an addition process of a sinusoid during SBR decoding.

The speech encoding/decoding system is configured to reduce the occurrence of pre-echo and post-echo and the subjective quality of a decoded signal can be improved without significantly increasing the bit rate in a bandwidth extension technique in the frequency domain, such as the bandwidth extension technique represented by SBR.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DESCRIPTION OF EMBODIMENTS

Figure 1:
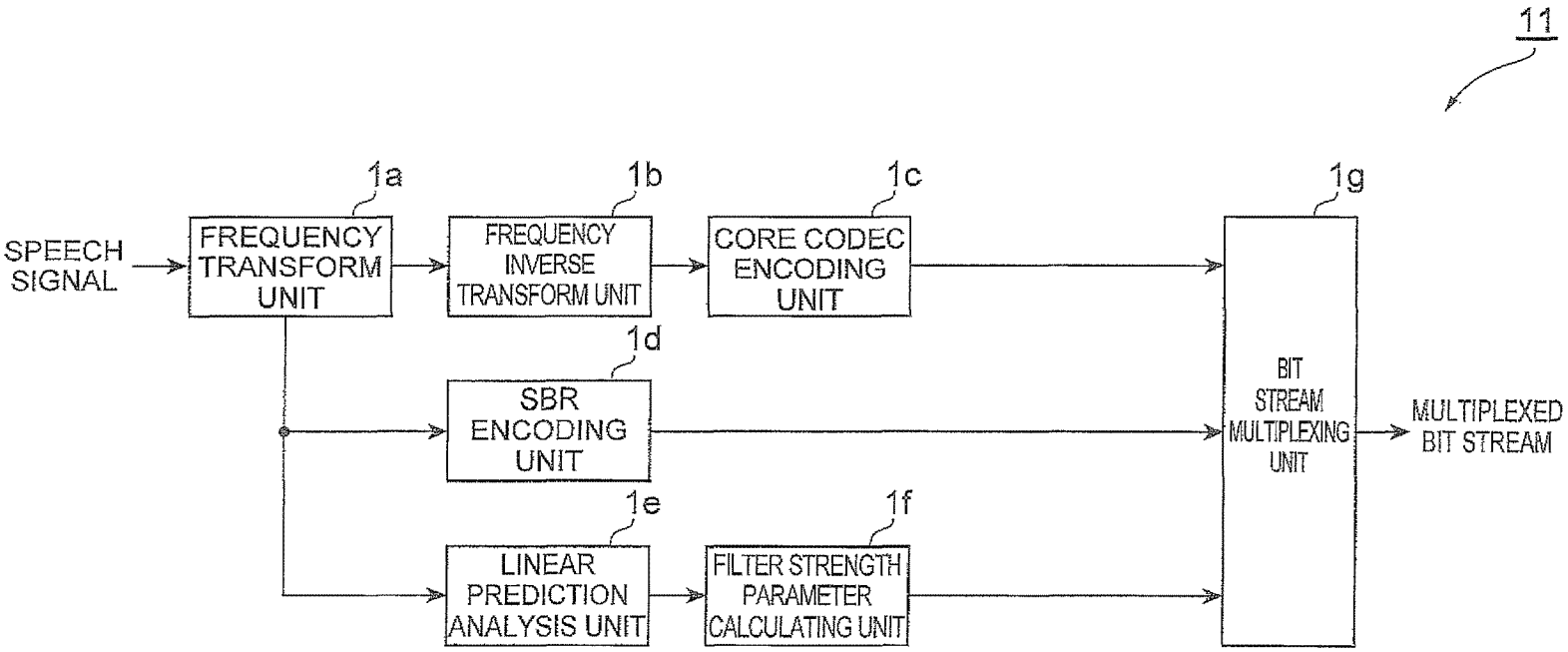
FIG. 1 is a diagram illustrating an example of a speech encoding device according to a first embodiment.

Preferable embodiments of a speech encoding/decoding system are described below in detail with reference to the accompanying drawings. In the description of the drawings, elements that are the same are labeled with the same reference symbols, and the duplicated description thereof is omitted, if applicable.

A bandwidth extension technique for generating high frequency components by using low frequency components of speech may be used as a method for improving the performance of speech encoding and obtaining a high speech quality at a low bit rate. Examples of bandwidth extension techniques include SBR (Spectral Band Replication) techniques, such as the SBR techniques used in "MPEG4 AAC". In SBR techniques, a high frequency component may be generated by transforming a signal into a spectral region by using a filterbank, such as a QMF (Quadrature Mirror Filter) filterbank and copying spectral coefficients between frequency bands, such as from a low frequency band to a high frequency band with respect to the transformed signal. In addition, the high frequency component may be adjusted by adjusting the spectral envelope and tonality of the copied coefficients. A speech encoding method using the bandwidth extension technique can reproduce the high frequency components of a signal by using only a small amount of supplementary information. Thus, it may be effective in reducing the bit rate of speech encoding.

In a bandwidth extension technique in the frequency domain, such as a bandwidth extension technique represented by SBR, the spectral envelope and tonality of the spectral coefficients represented in the frequency domain may be adjusted. Adjustment of the spectral envelope and tonality of the spectral coefficients may include, for example, performing gain adjustment, performing linear prediction inverse filtering in a temporal direction, and superimposing noise on the spectral coefficient. As a result of this adjustment process, upon encoding a signal having a large variation in temporal envelope, such as a speech signal, hand-clapping, or castanets, a reverberation noise called a pre-echo or a post-echo may be perceived in the decoded signal. The pre-echo or the post-echo may be caused because the temporal envelope of the high frequency component is transformed during the adjustment process, and in many cases, the temporal envelope is smoother after the adjustment process than before the adjustment process. The temporal envelope of the high frequency component after the adjustment process may not match with the temporal envelope of the high frequency component of an original signal before being encoded, thereby causing the pre-echo and post-echo.

A similar situation to that of the pre-echo and post-echo may also occur in multi-channel audio coding using a parametric process, such as the multi-channel audio encoding represented by "MPEG Surround" or Parametric Stereo. A decoder used in multi-channel audio coding may include means for performing decorrelation on a decoded signal using a reverberation filter. However, the temporal envelope of the signal being transformed during the decorrelation may be subject to degradation of a reproduction signal similar to that of the pre-echo and post-echo. Techniques such as a TES (Temporal Envelope Shaping) technique may be used to minimize these effects. In techniques such as the TES technique, a linear prediction analysis may be performed in a frequency direction on a signal represented in a QMF domain on which decorrelation has not yet been performed to obtain linear prediction coefficients, and, using the linear prediction coefficients, linear prediction synthesis filtering may be performed in the frequency direction on the signal on which decorrelation has been performed. This process allows the technique to extract the temporal envelope of a signal on which decorrelation has not yet been performed, and in accordance with the extracted temporal envelope, adjust the temporal envelope of the signal on which decorrelation has been performed. Because the signal on which decorrelation has not yet been performed has a less distorted temporal envelope, the temporal envelope of the signal on which decorrelation has been performed is adjusted to a less distorted shape, thereby obtaining a reproduction signal in which the pre-echo and post-echo is improved.

First Embodiment

Figure 2:
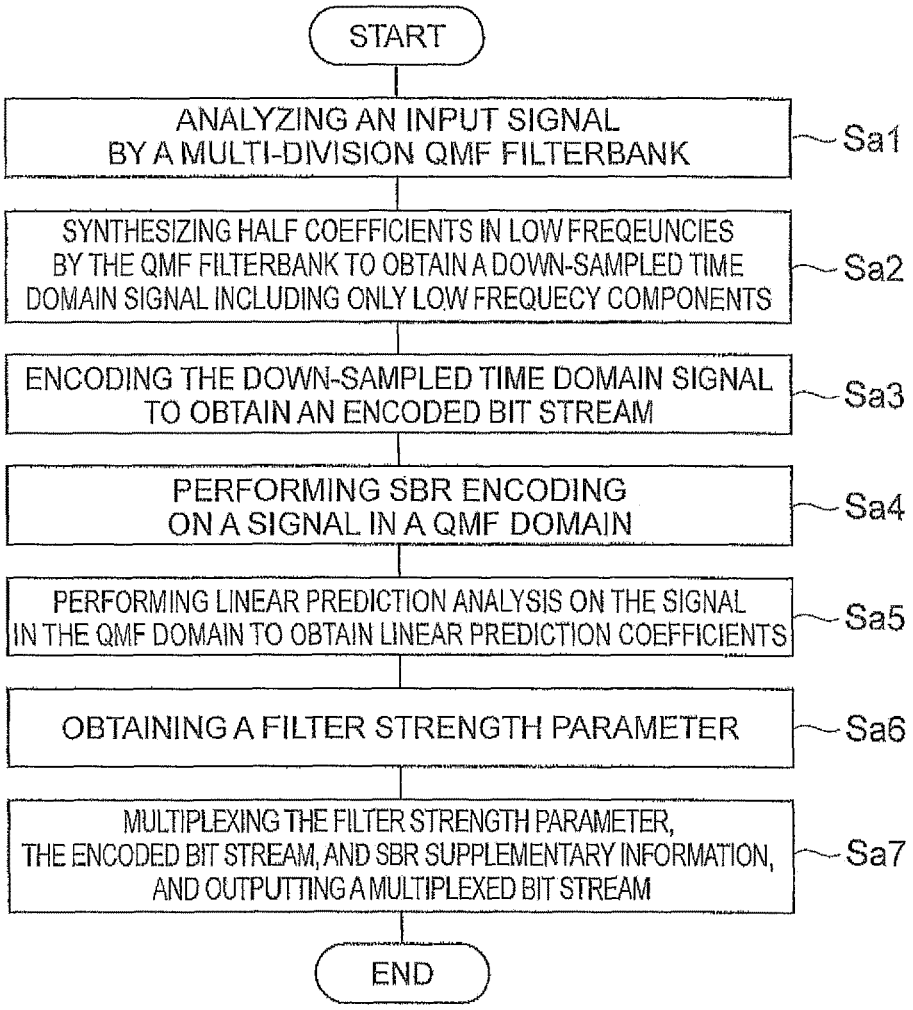
FIG. 2 is a flowchart to describe an example operation of the speech encoding device according to the first embodiment.

FIG. 1 is a diagram illustrating an example of a speech encoding device 11 included in the speech encoding/decoding system according to a first embodiment. The speech encoding device 11 may be a computing device or computer, including for example software, hardware, or a combination of hardware and software, as described later, capable of performing the described functionality. The speech encoding device 11 may be one or more separate systems or devices, may be one or more systems or devices included in the speech encoding/decoding system, or may be combined with other systems or devices within the speech encoding/decoding system. In other examples, fewer or additional blocks may be used to illustrate the functionality of the speech encoding device 11. In the illustrated example, the speech encoding device 11 may physically include a central processing unit (CPU) or processor, and a memory. The memory may include any form of data storage, such as read only memory (ROM), or a random access memory (RAM) providing a non-transitory recording medium, computer readable medium and/or memory. In addition, the speech encoding device may include other hardware, such as a communication device, a user interface, and the like, which are not illustrated. The CPU may integrally control the speech encoding device 11 by loading and executing a predetermined computer program, instructions, or code (such as a computer program for performing processes illustrated in the flowchart of FIG. 2) stored in a computer readable medium or memory, such as a built-in memory of the speech encoding device 11, such as ROM and/or RAM. A speech encoding program as described later may be stored in and provided from a non-transitory recording medium, computer readable medium and/or memory. Instructions in the form of computer software, firmware, data or any other form of computer code and/or computer program readable by a computer within the speech encoding and decoding system may be stored in the non-transitory recording medium. During operation, the communication device of the speech encoding device 11 may receive a speech signal to be encoded from outside the speech encoding device 11, and output an encoded multiplexed bit stream to the outside of the speech encoding device 11.

The speech encoding device 11 functionally may include a frequency transform unit 1*a* (frequency transform unit), a frequency inverse transform unit 1*b*, a core codec encoding unit 1*c* (core encoding unit), an SBR encoding unit 1*d*, a linear prediction analysis unit 1*e* (temporal envelope supplementary information calculating unit), a filter strength parameter calculating unit if (temporal envelope supplementary information calculating unit), and a bit stream multiplexing unit 1*g* (bit stream multiplexing unit). The frequency transform unit 1*a* to the bit stream multiplexing unit 1*g* of the speech encoding device 11 illustrated in FIG. 1 are functions realized when the CPU of the speech encoding device 11 executes computer program stored in the memory of the speech encoding device 11. The CPU of the speech encoding device 11 may sequentially, or in parallel, execute processes (such as the processes from Step Sa1 to Step Sa7) illustrated in the example flowchart of FIG. 2, by executing the computer program (or by using the frequency transform unit 1*a* to the bit stream multiplexing unit 1*g* illustrated in FIG. 1). Various types of data required to execute the computer program and various types of data generated by executing the computer program are all stored in the memory such as the ROM and the RAM of the speech encoding device 11. The functionality included in the speech encoding device 11 may be units. The term "unit" or "units" may be defined to include one or more executable parts of the speech encoding/decoding system. As described herein, the units are defined to include software, hardware or some combination thereof executable by the processor. Software included in the units may include instructions stored in the memory or computer readable medium that are executable by the processor, or any other processor. Hardware included in the units may include various devices, components, circuits, gates, circuit boards, and the like that are executable, directed, and/or controlled for performance by the processor.

The frequency transform unit 1*a* analyzes an input signal received from outside the speech encoding device 11 via the communication device of the speech encoding device 11 by using a multi-division filter bank, such as a QMF filterbank. In the following example a QMF filterbank is described, in other examples, other forms of multi-division filter bank are possible. Using a QMF filter bank, the input signal may be analyzed to obtain a signal q (k, r) in a QMF domain (process at Step Sa1). It is noted that k ($0 \le k \le 63$) is an index in a frequency direction, and r is an index indicating a time slot. The frequency inverse transform unit 1*b* may synthesize a predetermined quantity, such as a half of the coefficients on the low frequency side in the signal of the QMF domain obtained by the frequency transform unit 1*a* by using the QMF filterbank to obtain a down-sampled time domain signal that includes only low-frequency components of the input signal (process at Step Sa2). The core codec encoding unit 1*c* encodes the down-sampled time domain signal to obtain an encoded bit stream (process at Step Sa3). The encoding performed by the core codec encoding unit 1*c* may be based on a speech coding method, such as a speech coding method represented by a prediction method, such as a CELP (Code Excited Linear Prediction) method, or may be based on a transformation coding represented by coding method, such as AAC (Advanced Audio Coding) or a TCX (Transform Coded Excitation) method.

The SBR encoding unit 1*d* receives the signal in the QMF domain from the frequency transform unit 1*a*, and performs SBR encoding based on analyzing aspects of the signal such as power, signal change, tonality, and the like of the high frequency components to obtain SBR supplementary information (process at Step Sa4). Examples of QMF analysis frequency transform and SBR encoding are described in, for example, "3GPP TS 26.404: Enhanced aacPlus encoder Spectral Band Replication (SBR) part".

The linear prediction analysis unit 1*e* receives the signal in the QMF domain from the frequency transform unit 1*a*, and performs linear prediction analysis in the frequency direction on the high frequency components of the signal to obtain high frequency linear prediction coefficients $a_H$ (n, r) $1 \le n \le N$) (process at Step Sa5). It is noted that N is a linear prediction order. The index r is an index in a temporal direction for a sub-sample of the signals in the QMF domain. A covariance method or an autocorrelation method may be used for the signal linear prediction analysis. The linear prediction analysis to obtain $a_H$ (n, r) is performed on the high frequency components that satisfy $k_x < k \le 63$ in q (k, r). It is noted that $k_x$ is a frequency index corresponding to an upper limit frequency of the frequency band encoded by the core codec encoding unit 1*c*. The linear prediction analysis unit 1*e* may also perform linear prediction analysis on low frequency components different from those analyzed when $a_H$ (n, r) are obtained to obtain low frequency linear prediction coefficients $a_L$ (n, r) different from $a_H$ (n, r) (linear prediction coefficients according to such low frequency components correspond to temporal envelope information, and may be similar in the first embodiment to the later described embodiments). The linear prediction analysis to obtain $a_L$ (n, r) is performed on low frequency components that satisfy $0 \le k \le k_x$. The linear prediction analysis may also be performed on a part of the frequency band included in a section of $0 \le k \le k_x$.

The filter strength parameter calculating unit 1*f*, for example, utilizes the linear prediction coefficients obtained by the linear prediction analysis unit 1*e* to calculate a filter strength parameter (the filter strength parameter corresponds to temporal envelope supplementary information and may be similar in the first embodiment to later described embodiments) (process at Step Sa6). A prediction gain $G_H(r)$ is first calculated from $a_H$ (n, r). One example method for calculating the prediction gain is, for example, described in detail in "Speech Coding, Takehiro Moriya, The Institute of Electronics, Information and Communication Engineers". In other examples, other methods for calculating the prediction gain are possible. If $a_L$ (n, r) has been calculated, a prediction gain $G_L(r)$ is calculated similarly. The filter strength parameter K(r) is a parameter that increases as $G_H(r)$ is increased, and for example, can be obtained according to the following expression (1). Here, max (a, b) indicates the maximum value of a and b, and min (a, b) indicates the minimum value of a and b.

$$K(r)=\max(0,\min(1,GH(r)-1)) \tag{1}$$

If $G_L(r)$ has been calculated, K(r) can be obtained as a parameter that increases as $G_H(r)$ is increased, and decreases as $G_L(r)$ is increased. In this case, for example, K can be obtained according to the following expression (2).

$$K(r)=\max(0,\min(1,GH(r)/GL(r)-1)) \tag{2}$$

K(r) is a parameter indicating the strength of a filter for adjusting the temporal envelope of the high frequency components during the SBR decoding. A value of the prediction gain with respect to the linear prediction coefficients in the frequency direction is increased as the variation of the temporal envelope of a signal in the analysis interval becomes sharp. K(r) is a parameter for instructing a decoder to strengthen the process for sharpening variation of the temporal envelope of the high frequency components generated by SBR, with the increase of its value. K(r) may also be a parameter for instructing a decoder (such as a speech decoding device 21) to weaken the process for sharpening the variation of the temporal envelope of the high frequency components generated by SBR, with the decrease of the value of K(r), or may include a value for not executing the process for sharpening the variation of the temporal envelope. Instead of transmitting K(r) to each time slot, K(r) representing a plurality of time slots may be transmitted. To determine the segment of the time slots in which the same value of K(r) is shared, information on time borders of SBR envelope (SBR envelope time border) included in the SBR supplementary information may be used.

K(r) is transmitted to the bit stream multiplexing unit 1*g* after being quantized. It is preferable to calculate K(r) representing the plurality of time slots, for example, by calculating an average of K(r) of a plurality of time slots r before quantization is performed. To transmit K(r) representing the plurality of time slots, K(r) may also be obtained from the analysis result of the entire segment formed of the plurality of time slots, instead of independently calculating K(r) from the result of analyzing each time slot such as the expression (2). In this case, K(r) may be calculated, for example, according to the following expression (3). Here, mean (·) indicates an average value in the segment of the time slots represented by K(r).

$$K(r)=\max(0,\min(1,\mathrm{mean}(G_H(r)/\mathrm{mean}(G_L(r))-1))) \quad (3)$$

K(r) may be exclusively transmitted with inverse filter mode information such as inverse filter mode information included in the SBR supplementary information as described, for example, in "ISO/IEC 14496-3 subpart 4 General Audio Coding". In other words, K(r) is not transmitted for the time slots for which the inverse filter mode information in the SBR supplementary information is transmitted, and the inverse filter mode information (such as inverse filter mode information bs#_invf#_mode in "ISO/IEC 14496-3 subpart 4 General Audio Coding") in the SBR supplementary information need not be transmitted for the time slot for which K(r) is transmitted. Information indicating that either K(r) or the inverse filter mode information included in the SBR supplementary information is transmitted may also be added. K(r) and the inverse filter mode information included in the SBR supplementary information may be combined to handle as vector information, and perform entropy coding on the vector. In this case, the combination of K(r) and the value of the inverse filter mode information included in the SBR supplementary information may be restricted.

The bit stream multiplexing unit 1*g* may multiplex at least two of the encoded bit stream calculated by the core codec encoding unit 1*c*, the SBR supplementary information calculated by the SBR encoding unit 1*d*, and K(r) calculated by the filter strength parameter calculating unit 1*f*, and outputs a multiplexed bit stream (encoded multiplexed bit stream) through the communication device of the speech encoding device 11 (process at Step Sa7).

Figure 3:
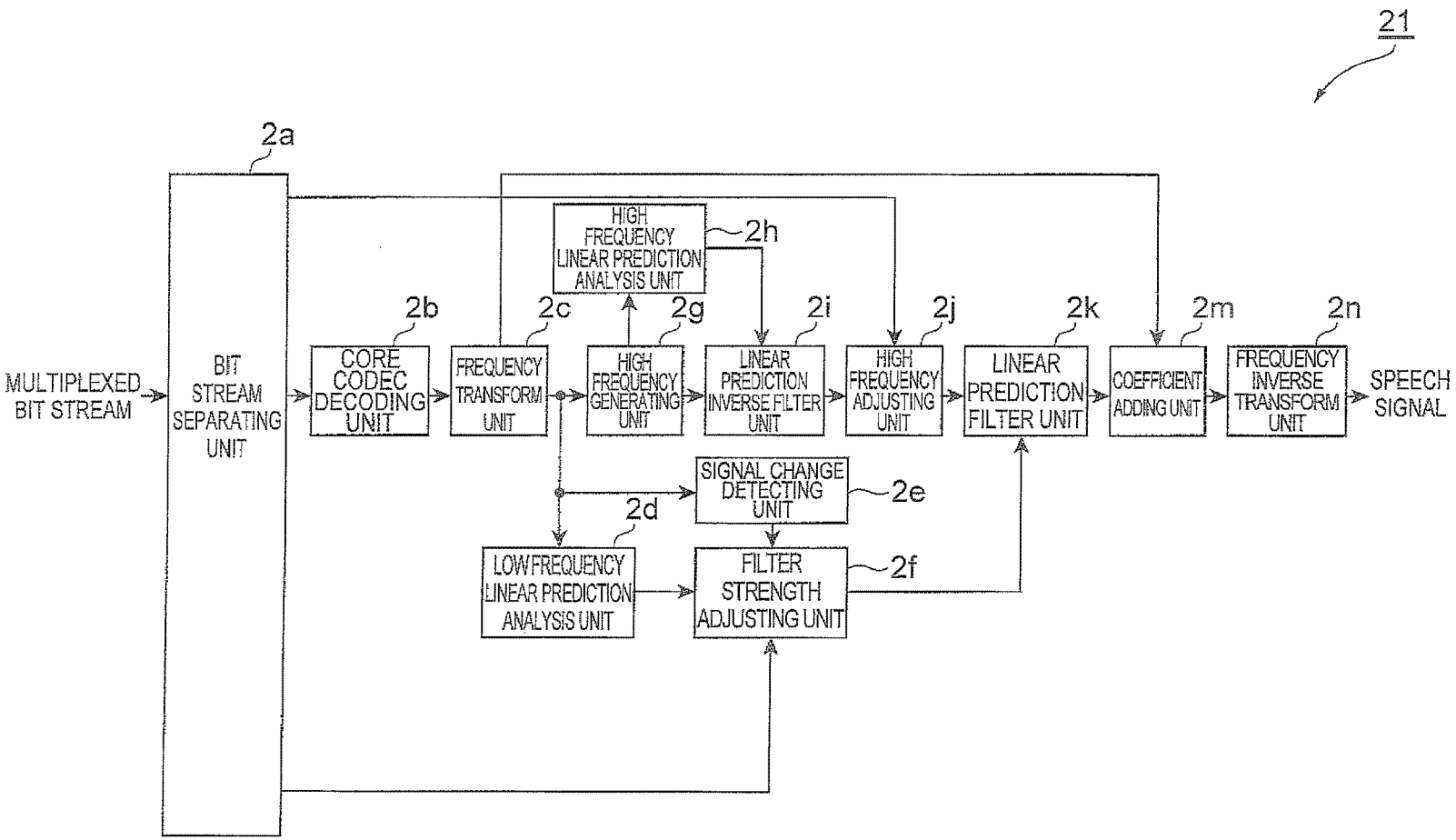
FIG. 3 is a diagram illustrating an example of a speech decoding device according to the first embodiment.
Figure 4:
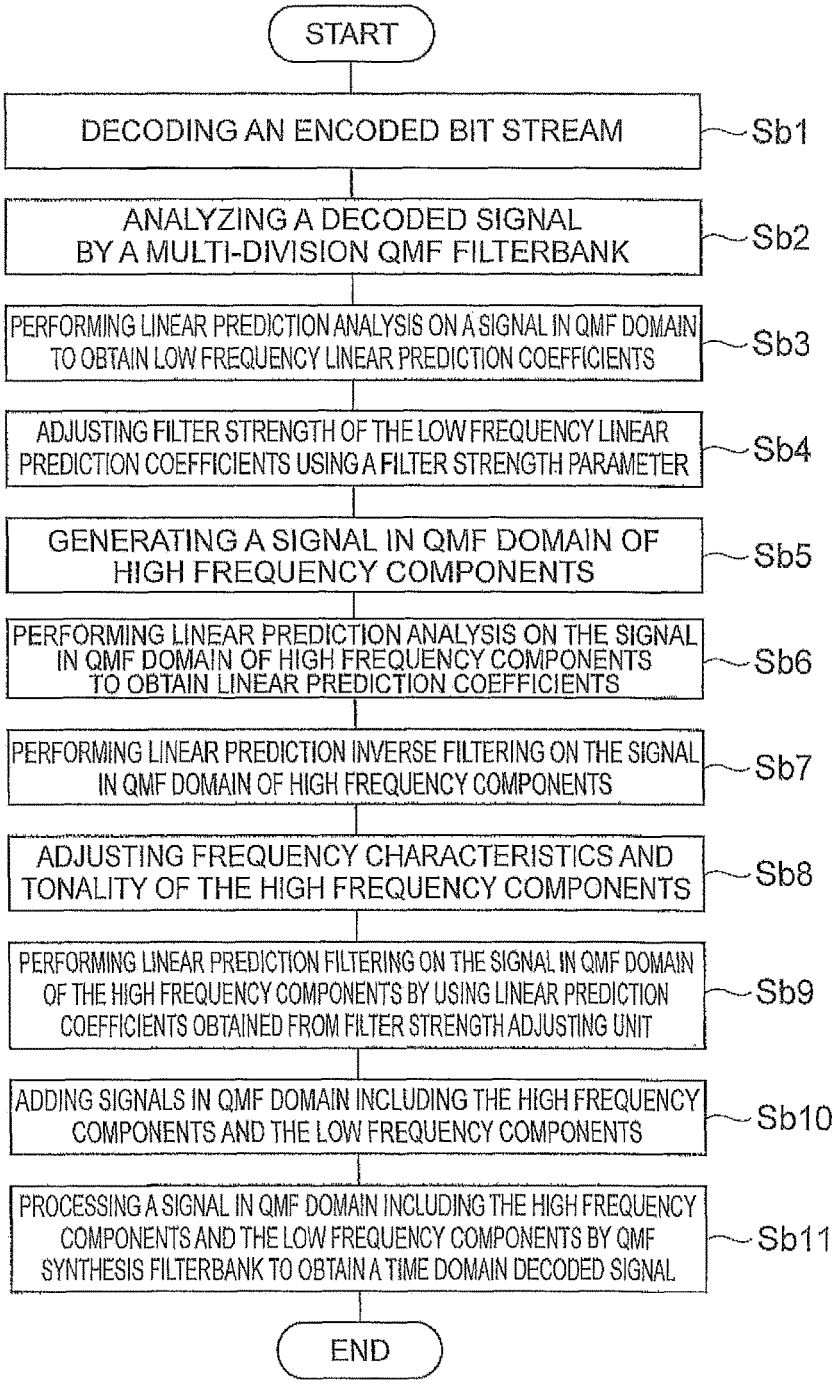
FIG. 4 is a flowchart to describe an example operation of the speech decoding device according to the first embodiment.

FIG. 3 is a diagram illustrating an example speech decoding device 21 according to the first embodiment of the speech encoding/decoding system. The speech decoding device 21 may be a computing device or computer, including for example software, hardware, or a combination of hardware and software, as described later, capable of performing the described functionality. The speech decoding device 21 may be one or more separate systems or devices, may be one or more systems or devices included in the speech encoding/decoding system, or may be combined with other systems or devices within the speech encoding/decoding system. In other examples, fewer or additional blocks may be used to illustrate the functionality of the speech decoding device 21. In the illustrated example, the speech decoding device 21 may physically include a CPU, a memory. As described later, the memory may include any form of data storage, such as a read only memory (ROM), or a random access memory (RAM) providing a non-transitory recording medium, computer readable medium and/or memory. In addition, the speech decoding device 21 may include other hardware, such as a communication device, a user interface, and the like, which are not illustrated. The CPU may integrally control the speech decoding device 21 by loading and executing a predetermined computer program, instructions, or code (such as a computer program for performing processes illustrated in the example flowchart of FIG. 4) stored in a computer readable medium or memory, such as a built-in memory of the speech decoding device 21, such as ROM and/or RAM. A speech decoding program as described later may be stored in and provided from a non-transitory recording medium, computer readable medium and/or memory. Instructions in the form of computer software, firmware, data or any other form of computer code and/or computer program readable by a computer within the speech encoding and decoding system may be stored in the non-transitory recording medium. During operation, the communication device of the speech decoding device 21 may receive the encoded multiplexed bit stream output from the speech encoding device 11, a speech encoding device 11*a* of a modification 1, which will be described later, a speech encoding device of a modification 2, which will be described later, or any other device capable of generating an encoded multiplexed bit stream output, and outputs a decoded speech signal to outside the speech decoding device 21. The speech decoding device 21, as illustrated in FIG. 3, functionally includes a bit stream separating unit 2*a* (bit stream separating unit), a core codec decoding unit 2*b* (core decoding unit), a frequency transform unit 2*c* (frequency transform unit), a low frequency linear prediction analysis unit 2*d* (low frequency temporal envelope analysis unit), a signal change detecting unit 2*e*, a filter strength adjusting unit 2*f* (temporal envelope adjusting unit), a high frequency generating unit 2*g* (high frequency generating unit), a high frequency linear prediction analysis unit 2*h*, a linear prediction inverse filter unit 2*i*, a high frequency adjusting unit 2*j* (high frequency adjusting unit), a linear prediction filter unit 2*k* (temporal envelope shaping unit), a coefficient adding unit 2*m*, and a frequency inverse conversion unit 2*n*. The bit stream separating unit 2*a* to the frequency inverse transform unit 2*n* of the speech decoding device 21 illustrated in FIG. 3 are functions that may be realized when the CPU of the speech decoding device 21 executes the computer program stored in memory of the speech decoding device 21. The CPU of the speech decoding device 21 may sequentially or in parallel execute processes (such as the processes from Step Sb1 to Step Sb11) illustrated in the example flowchart of FIG. 4, by executing the computer program (or by using the bit stream separating unit 2*a* to the frequency inverse transform unit 2*n* illustrated in the example of FIG. 3). Various types of data required to execute the computer program and various types of data generated by executing the computer program are all stored in memory such as the ROM and the RAM of the speech decoding device 21. The functionality included in the speech decoding device 21 may be units. The term "unit" or "units" may be defined to include one or more executable parts of the speech encoding/decoding system. As described herein, the units are defined to include software, hardware or some combination thereof executable by the processor. Software included in the units may include instructions stored in the memory or computer readable medium that are executable by the processor, or any other processor. Hardware included in the units may include various devices, components, circuits, gates, circuit boards, and the like that are executable, directed, and/or controlled for performance by the processor.

The bit stream separating unit 2*a* separates the multiplexed bit stream supplied through the communication device of the speech decoding device 21 into a filter strength parameter, SBR supplementary information, and the encoded bit stream. The core codec decoding unit 2*b* decodes the encoded bit stream received from the bit stream separating unit 2*a* to obtain a decoded signal including only the low frequency components (process at Step Sb1). At this time, the decoding method may be based on a speech coding method, such as the speech encoding method represented by the CELP method, or may be based on audio coding such as the AAC or the TCX (Transform Coded Excitation) method.

The frequency transform unit 2*c* analyzes the decoded signal received from the core codec decoding unit 2*b* by using the multi-division QMF filter bank to obtain a signal $q_{dec}$ (k, r) in the QMF domain (process at Step Sb2). It is noted that k ($0 \le k \le 63$) is an index in the frequency direction, and r is an index indicating an index for the sub-sample of the signal in the QMF domain in the temporal direction.

The low frequency linear prediction analysis unit 2*d* performs linear prediction analysis in the frequency direction on $q_{dec}$ (k, r) of each time slot r, obtained from the frequency transform unit 2*c*, to obtain low frequency linear prediction coefficients $a_{dec}$ (n, r) (process at Step Sb3). The linear prediction analysis is performed for a range of $0 \le k \le k_x$ corresponding to a signal bandwidth of the decoded signal obtained from the core codec decoding unit 2*b*. The linear prediction analysis may be performed on a part of frequency band included in the section of $0 \le k \le k_x$.

The signal change detecting unit 2*e* detects the temporal variation of the signal in the QMF domain received from the frequency transform unit 2*c*, and outputs it as a detection result T(r). The signal change may be detected, for example, by using the method described below.

1. Short-term power p(r) of a signal in the time slot r is obtained according to the following expression (4).

$$p(r) = \sum_{k=0}^{63} |q_{dec}(k, r)|^2 \tag{4}$$

2. An envelope $p_{env}(r)$ obtained by smoothing p(r) is obtained according to the following expression (5). It is noted that α is a constant that satisfies $0<\alpha<1$.

$$p_{env}(r)=\alpha \cdot p_{env}(r-1)+(1-\alpha)\cdot p(r) \tag{5}$$

3. T(r) is obtained according to the following expression (6) by using p(r) and $p_{env}(r)$, where β is a constant.

$$T(r)=\max(1, p(r)/(\beta \cdot p_{env}(r))) \tag{6}$$

The methods described above are simple examples for detecting the signal change based on the change in power, and the signal change may be detected by using other more sophisticated methods. In addition, the signal change detecting unit 2*e* may be omitted.

The filter strength adjusting unit 2*f* adjusts the filter strength with respect to $a_{dec}$ (n, r) obtained from the low frequency linear prediction analysis unit 2*d* to obtain adjusted linear prediction coefficients $a_{adj}$ (n, r), (process at Step Sb4). The filter strength is adjusted, for example, according to the following expression (7), by using a filter strength parameter K received through the bit stream separating unit 2*a*.

$$a_{adj}(n,r)=a_{dec}(n,r)\cdot K(r)^n \ (1 \le n \le N) \tag{7}$$

If an output T(r) is obtained from the signal change detecting unit 2*e*, the strength may be adjusted according to the following expression (8).

$$a_{adj}(n,r)=a_{dec}(n,r)\cdot(K(r)\cdot T(r))^n \ (1 \le n \le N) \tag{8}$$

The high frequency generating unit 2*g* copies the signal in the QMF domain obtained from the frequency transform unit 2*c* from the low frequency band to the high frequency band to generate a signal $q_{exp}$ (k, r) in the QMF domain of the high frequency components (process at Step Sb5). The high frequency components may be generated, for example, according to the HF generation method in SBR in "MPEG4 AAC" ("ISO/IEC 14496-3 subpart 4 General Audio Coding").

The high frequency linear prediction analysis unit 2*h* performs linear prediction analysis in the frequency direction on $q_{exp}$ (k, r) of each of the time slots r generated by the high frequency generating unit 2*g* to obtain high frequency linear prediction coefficients $a_{exp}$ (n, r) (process at Step Sb6). The linear prediction analysis is performed for a range of $k_x \le k \le 63$ corresponding to the high frequency components generated by the high frequency generating unit 2*g*.

The linear prediction inverse filter unit 2*i* performs linear prediction inverse filtering in the frequency direction on a signal in the QMF domain of the high frequency band generated by the high frequency generating unit 2*g*, using $a_{exp}$ (n, r) as coefficients (process at Step Sb7). The transfer function of the linear prediction inverse filter can be expressed as the following expression (9).

$$f(z) = 1 + \sum_{n=1}^{N} a_{exp}(n, r)z^{-n} \tag{9}$$

The linear prediction inverse filtering may be performed from a coefficient at a lower frequency towards a coefficient at a higher frequency, or may be performed in the opposite direction. The linear prediction inverse filtering is a process for temporarily flattening the temporal envelope of the high frequency components, before the temporal envelope shaping is performed at the subsequent stage, and the linear prediction inverse filter unit 2*i* may be omitted. It is also possible to perform linear prediction analysis and inverse filtering on outputs from the high frequency adjusting unit 2*j*, which will be described later, by the high frequency linear prediction analysis unit 2*h* and the linear prediction inverse filter unit 2*i*, instead of performing linear prediction analysis and inverse filtering on the high frequency components of the outputs from the high frequency generating unit 2*g*. The linear prediction coefficients used for the linear prediction inverse filtering may also be $a_{dec}$ (n, r) or $a_{adj}$ (n, r), instead of $a_{exp}$ (n, r). The linear prediction coefficients used for the linear prediction inverse filtering may also be linear prediction coefficients $a_{exp,adj}$ (n, r) obtained by performing filter strength adjustment on $a_{exp}$ (n, r). The strength adjustment is performed according to the following expression (10), similar to that when $a_{adj}$ (n, r) is obtained.

$$a_{exp,adj}(n,r)=a_{exp}(n,r)\cdot K(r)^n \ (1 \le n \le N) \tag{10}$$

The high frequency adjusting unit 2*j* adjusts the frequency characteristics and tonality of the high frequency components of an output from the linear prediction inverse filter unit 2*i* (process at Step Sb8). The adjustment may be performed according to the SBR supplementary information received from the bit stream separating unit 2*a*. The processing by the high frequency adjusting unit 2*j* may be performed according to any form of frequency and tone adjustment process, such as according to "HF adjustment" step in SBR in "MPEG4 AAC", and may be adjusted by performing linear prediction inverse filtering in the temporal direction, the gain adjustment, and the noise addition on the signal in the QMF domain of the high frequency band. Examples of processes similar to those described in the steps described above are described in "ISO/IEC 14496-3 subpart 4 General Audio Coding". The frequency transform unit 2*c*, the high frequency generating unit 2*g*, and the high frequency adjusting unit 2*j* may all operate similarly or according to the SBR decoder in "MPEG4 AAC" defined in "ISO/IEC 14496-3".

The linear prediction filter unit 2*k* performs linear prediction synthesis filtering in the frequency direction on a high frequency components $q_{adj}$ (n, r) of a signal in the QMF domain output from the high frequency adjusting unit 2*j*, by using $a_{adj}$ (n, r) obtained from the filter strength adjusting unit 2*f* (process at Step Sb9). The transfer function in the linear prediction synthesis filtering can be expressed as the following expression (11).

$$g(z) = \frac{1}{1 + \sum_{n=1}^{N} a_{adj}(n, r) z^{-n}} \tag{11}$$

By performing the linear prediction synthesis filtering, the linear prediction filter unit 2*k* transforms the temporal envelope of the high frequency components generated based on SBR.

The coefficient adding unit 2*m* adds a signal in the QMF domain including the low frequency components output from the frequency transform unit 2*c* and a signal in the QMF domain including the high frequency components output from the linear prediction filter unit 2*k*, and outputs a signal in the QMF domain including both the low frequency components and the high frequency components (process at Step Sb10).

The frequency inverse transform unit 2*n* processes the signal in the QMF domain obtained from the coefficients adding unit 2*m* by using a QMF synthesis filter bank. Accordingly, a time domain decoded speech signal including both the low frequency components obtained by the core codec decoding and the high frequency components generated by SBR and whose temporal envelope is shaped by the linear prediction filter is obtained, and the obtained speech signal is output to outside the speech decoding device 21 through the built-in communication device (process at Step Sb11). If K(r) and the inverse filter mode information of the SBR supplementary information described in "ISO/IEC 14496-3 subpart 4 General Audio Coding" are exclusively transmitted, the frequency inverse transform unit 2*n* may generate inverse filter mode information of the SBR supplementary information for a time slot to which K(r) is transmitted but the inverse filter mode information of the SBR supplementary information is not transmitted, by using inverse filter mode information of the SBR supplementary information with respect to at least one time slot of the time slots before and after the time slot. It is also possible to set the inverse filter mode information of the SBR supplementary information of the time slot to a predetermined mode in advance. The frequency inverse transform unit 2*n* may generate K(r) for a time slot to which the inverse filter data of the SBR supplementary information is transmitted but K(r) is not transmitted, by using K(r) for at least one time slot of the time slots before and after the time slot. It is also possible to set K(r) of the time slot to a predetermined value in advance. The frequency inverse transform unit 2*n* may also determine whether the transmitted information is K(r) or the inverse filter mode information of the SBR supplementary information, based on information indicating whether K(r) or the inverse filter mode information of the SBR supplementary information is transmitted.

Modification 1 of First Embodiment

Figure 5:
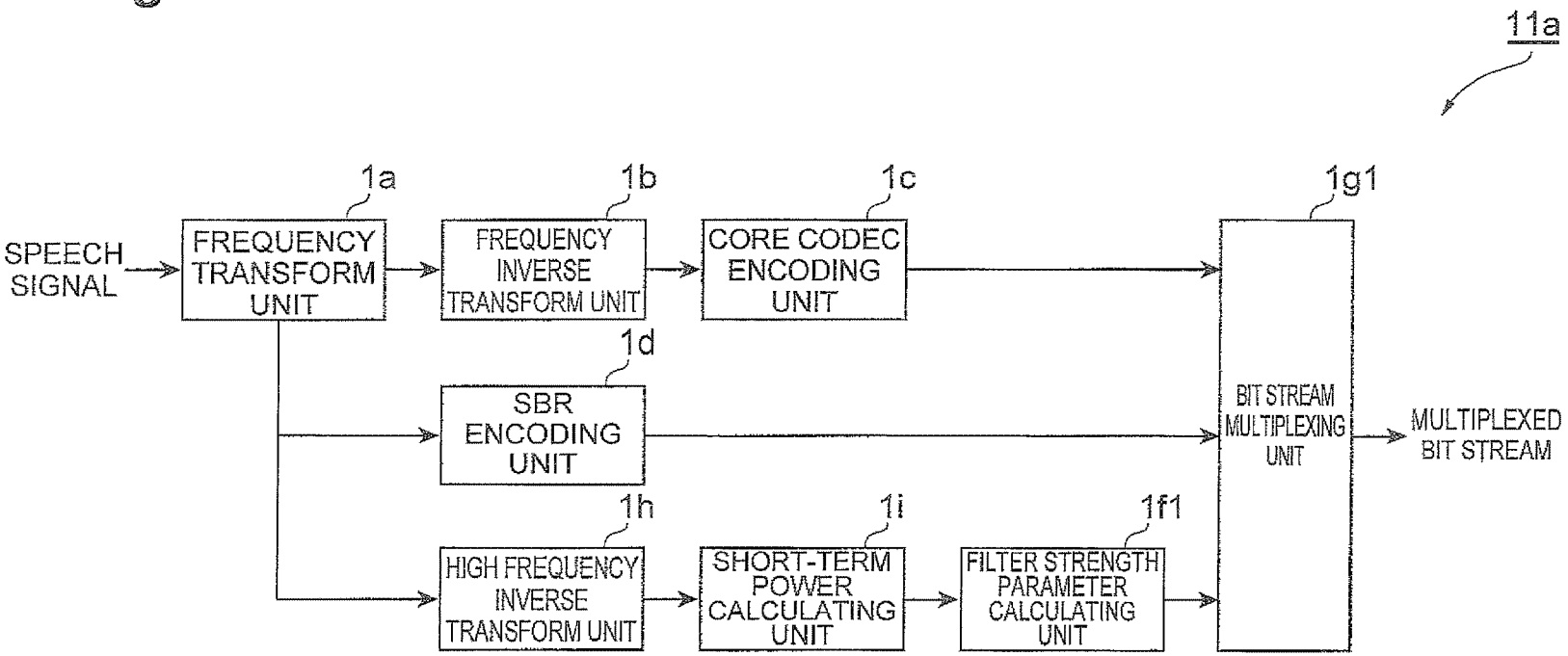
FIG. 5 is a diagram illustrating an example of a speech encoding device according to a first modification of the first embodiment.

FIG. 5 is a diagram illustrating a modification example (speech encoding device 11*a*) of the speech encoding device according to the first embodiment. The speech encoding device 11*a* physically includes a CPU, a ROM, a RAM, a communication device, and the like, which are not illustrated, and the CPU integrally controls the speech encoding device 11*a* by loading and executing a predetermined computer program stored in a memory of the speech encoding device 11*a* such as the ROM into the RAM. The communication device of the speech encoding device 11*a* receives a speech signal to be encoded from outside the encoding device 11*a*, and outputs an encoded multiplexed bit stream to the outside.

The speech encoding device 11*a*, as illustrated in FIG. 5, functionally includes a high frequency inverse transform unit 1*h*, a short-term power calculating unit 1*i* (temporal envelope supplementary information calculating unit), a filter strength parameter calculating unit 1*f*1 (temporal envelope supplementary information calculating unit), and a bit stream multiplexing unit 1*g*1 (bit stream multiplexing unit), instead of the linear prediction analysis unit 1*e*, the filter strength parameter calculating unit 1*f*, and the bit stream multiplexing unit 1*g* of the speech encoding device 11. The bit stream multiplexing unit 1*g*1 has the same function as that of 1*g*. The frequency transform unit 1*a* to the SBR encoding unit 1*d*, the high frequency inverse transform unit 1*h*, the short-term power calculating unit 1*i*, the filter strength parameter calculating unit 1*f*1, and the bit stream multiplexing unit 1*g*1 of the speech encoding device 11*a* illustrated in FIG. 5 are functions realized when the CPU of the speech encoding device 11*a* executes the computer program stored in the memory of the speech encoding device 11*a*. Various types of data required to execute the computer program and various types of data generated by executing the computer program are all stored in the memory such as the ROM and the RAM of the speech encoding device 11*a*.

The high frequency inverse transform unit 1*h* replaces the coefficients of the signal in the QMF domain obtained from the frequency transform unit 1*a* with "0", which correspond to the low frequency components encoded by the core codec encoding unit 1*c*, and processes the coefficients by using the QMF synthesis filter bank to obtain a time domain signal that includes only the high frequency components. The short-term power calculating unit 1*i* divides the high frequency components in the time domain obtained from the high frequency inverse transform unit 1*h* into short segments, calculates the power, and calculates p(r). As an alternative method, the short-term power may also be calculated according to the following expression (12) by using the signal in the QMF domain.

$$p(r) = \sum_{k=0}^{63} |q(k, r)|^2 \tag{12}$$

The filter strength parameter calculating unit 1f1 detects the changed portion of p(r), and determines a value of K(r), so that K(r) is increased with the large change. The value of K(r), for example, can also be calculated by the same method as that of calculating T(r) by the signal change detecting unit 2e of the speech decoding device 21. The signal change may also be detected by using other more sophisticated methods. The filter strength parameter calculating unit 1f1 may also obtain short-term power of each of the low frequency components and the high frequency components, obtain signal changes Tr(r) and Th(r) of each of the low frequency components and the high frequency components using the same method as that of calculating T(r) by the signal change detecting unit 2e of the speech decoding device 21, and determine the value of K(r) using these. In this case, for example, K(r) can be obtained according to the following expression (13), where is a constant such as 3.0.

$$K(r)=\max(0,\varepsilon\cdot(Th(r)-Tr(r))) \quad (13)$$

Modification 2 of First Embodiment

A speech encoding device (not illustrated) of a modification 2 of the first embodiment physically includes a CPU, a ROM, a RAM, a communication device, and the like, which are not illustrated, and the CPU integrally controls the speech encoding device of the modification 2 by loading and executing a predetermined computer program stored in a memory of the speech encoding device of the modification 2 such as the ROM into the RAM. The communication device of the speech encoding device of the modification 2 receives a speech signal to be encoded from outside the speech encoding device, and outputs an encoded multiplexed bit stream to the outside.

The speech encoding device of the modification 2 functionally includes a linear prediction coefficient differential encoding unit (temporal envelope supplementary information calculating unit) and a bit stream multiplexing unit (bit stream multiplexing unit) that receives an output from the linear prediction coefficient differential encoding unit, which are not illustrated, instead of the filter strength parameter calculating unit 1f and the bit stream multiplexing unit 1g of the speech encoding device 11. The frequency transform unit 1a to the linear prediction analysis unit 1e, the linear prediction coefficient differential encoding unit, and the bit stream multiplexing unit of the speech encoding device of the modification 2 are functions realized when the CPU of the speech encoding device of the modification 2 executes the computer program stored in the memory of the speech encoding device of the modification 2. Various types of data required to execute the computer program and various types of data generated by executing the computer program are all stored in the memory such as the ROM and the RAM of the speech encoding device of the modification 2.

The linear prediction coefficient differential encoding unit calculates differential values $a_D$ (n, r) of the linear prediction coefficients according to the following expression (14), by using $a_H$ (n, r) of the input signal and $a_L$ (n, r) of the input signal.

$$a_D(n,r)=a_H(n,r)-a_L(n,r)\ (1\leq n\leq N) \quad (14)$$

The linear prediction coefficient differential encoding unit then quantizes $a_D$ (n, r), and transmits them to the bit stream multiplexing unit (structure corresponding to the bit stream multiplexing unit 1g). The bit stream multiplexing unit multiplexes $a_D$ (n, r) into the bit stream instead of K(r), and outputs the multiplexed bit stream to outside the speech encoding device through the built-in communication device.

A speech decoding device (not illustrated) of the modification 2 of the first embodiment physically includes a CPU, a ROM, a RAM, a communication device, and the like, which are not illustrated, and the CPU integrally controls the speech decoding device of the modification 2 by loading and executing a predetermined computer program stored in memory, such as a built-in memory of the speech decoding device of the modification 2 such as the ROM into the RAM. The communication device of the speech decoding device of the modification 2 receives the encoded multiplexed bit stream output from the speech encoding device 11, the speech encoding device 11a according to the modification 1, or the speech encoding device according to the modification 2, and outputs a decoded speech signal to the outside of the speech decoder.

The speech decoding device of the modification 2 functionally includes a linear prediction coefficient differential decoding unit, which is not illustrated, instead of the filter strength adjusting unit 2f of the speech decoding device 21. The bit stream separating unit 2a to the signal change detecting unit 2e, the linear prediction coefficient differential decoding unit, and the high frequency generating unit 2g to the frequency inverse transform unit 2n of the speech decoding device of the modification 2 are functions realized when the CPU of the speech decoding device of the modification 2 executes the computer program stored in the memory of the speech decoding device of the modification 2. Various types of data required to execute the computer program and various types of data generated by executing the computer program are all stored in the memory such as the ROM and the RAM of the speech decoding device of the modification 2.

The linear prediction coefficient differential decoding unit obtains $a_{adj}$ (n, r) differentially decoded according to the following expression (15), by using $a_L$ (n, r) obtained from the low frequency linear prediction analysis unit 2d and $a_D$ (n, r) received from the bit stream separating unit 2a.

$$a_{adj}(n,r)=a_{dec}(n,r)+a_D(n,r),\ 1\leq n\leq N \quad (15)$$

The linear prediction coefficient differential decoding unit transmits $a_{adj}$ (n, differentially decoded in this manner to the linear prediction filter unit 2k. $a_D$ (n, r) may be a differential value in the domain of prediction coefficients as illustrated in the expression (14). But, after transforming prediction coefficients to the other expression form such as LSP (Linear Spectrum Pair), ISP (Immittance Spectrum Pair), LSF (Linear Spectrum Frequency), ISF (Immittance Spectrum Frequency), and PARCOR coefficient, $a_D$ (n, r) may be a value taking a difference of them. In this case, the differential decoding also has the same expression form.

Second Embodiment

Figure 6:
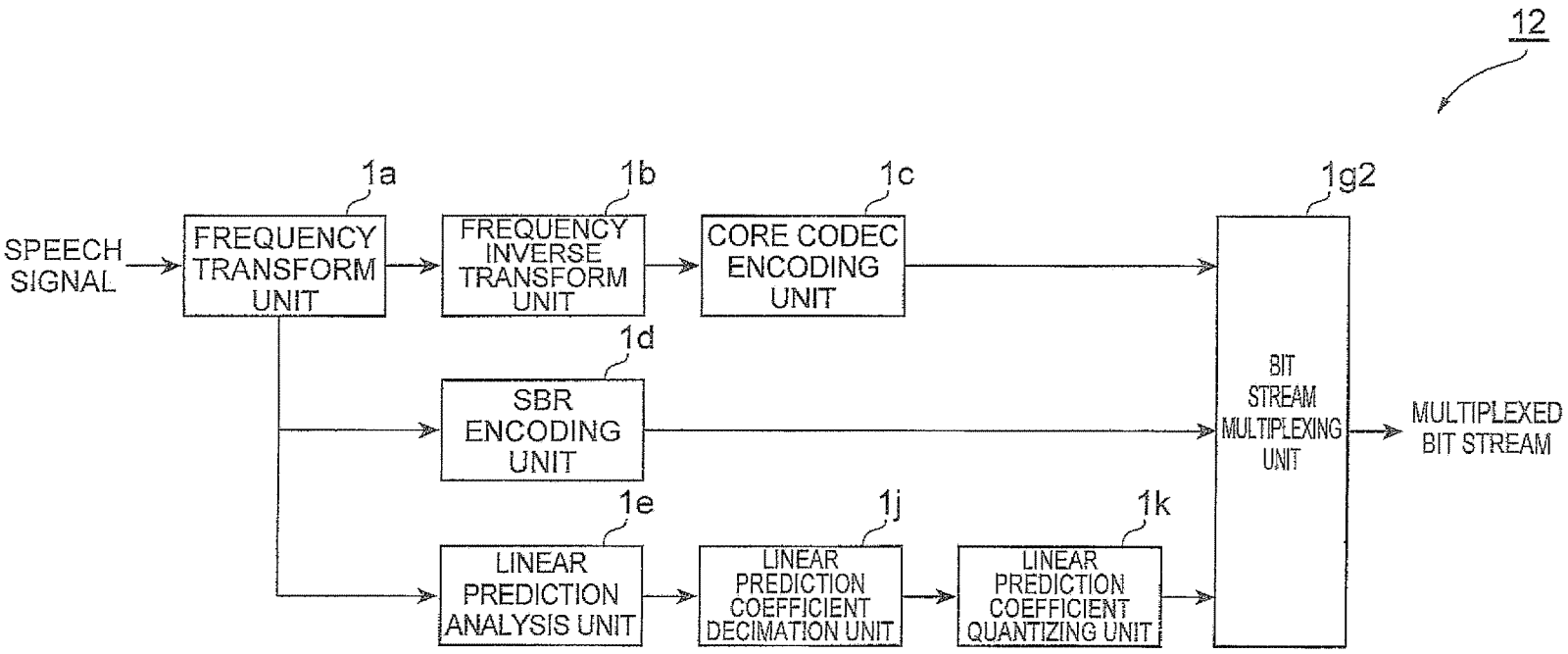
FIG. 6 is a diagram illustrating an example of a speech encoding device according to a second embodiment.
Figure 7:
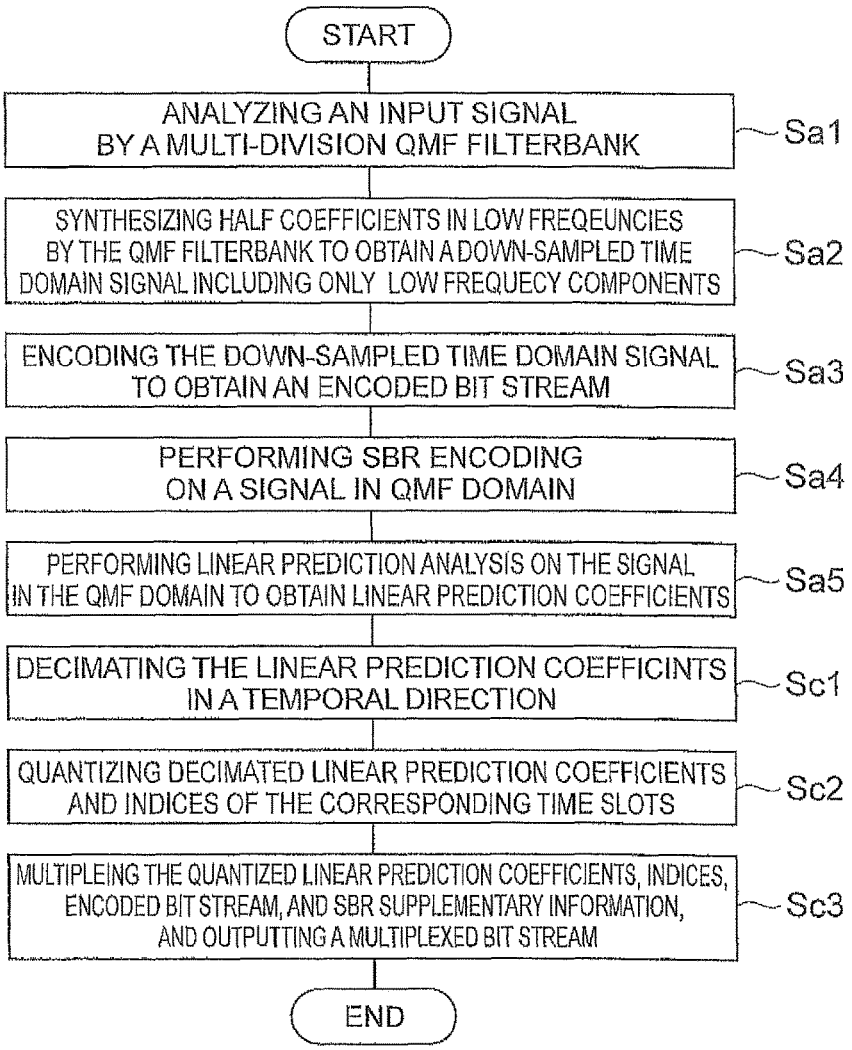
FIG. 7 is a flowchart to describe an example of operation of the speech encoding device according to the second embodiment.

FIG. 6 is a diagram illustrating an example speech encoding device 12 according to a second embodiment. The speech encoding device 12 physically includes a CPU, a ROM, a RAM, a communication device, and the like, which are not illustrated, and the CPU integrally controls the speech encoding device 12 by loading and executing a predetermined computer program (such as a computer program for performing processes illustrated in the flowchart of FIG. 7) stored in a memory of the speech encoding device 12 such as the ROM into the RAM, as previously discussed with respect to the first embodiment. The communication device of the speech encoding device 12 receives a speech signal to be encoded from outside the speech encoding device 12, and outputs an encoded multiplexed bit stream to the outside.

The speech encoding device 12 functionally includes a linear prediction coefficient decimation unit 1*j* (prediction coefficient decimation unit), a linear prediction coefficient quantizing unit 1*k* (prediction coefficient quantizing unit), and a bit stream multiplexing unit 1*g*2 (bit stream multiplexing unit), instead of the filter strength parameter calculating unit if and the bit stream multiplexing unit 1*g* of the speech encoding device 11. The frequency transform unit 1*a* to the linear prediction analysis unit 1*e* (linear prediction analysis unit), the linear prediction coefficient decimation unit 1*j*, the linear prediction coefficient quantizing unit 1*k*, and the bit stream multiplexing unit 1*g*2 of the speech encoding device 12 illustrated in FIG. 6 are functions realized when the CPU of the speech encoding device 12 executes the computer program stored in the memory of the speech encoding device 12. The CPU of the speech encoding device 12 sequentially executes processes (processes from Step Sa1 to Step Say, and processes from Step Sc1 to Step Sc3) illustrated in the example flowchart of FIG. 7, by executing the computer program (or by using the frequency transform unit 1*a* to the linear prediction analysis unit 1*e*, the linear prediction coefficient decimation unit 1*j*, the linear prediction coefficient quantizing unit 1*k*, and the bit stream multiplexing unit 1*g*2 of the speech encoding device 12 illustrated in FIG. 6). Various types of data required to execute the computer program and various types of data generated by executing the computer program are all stored in the memory such as the ROM and the RAM of the speech encoding device 12.

The linear prediction coefficient decimation unit 1*j* decimates $a_H$ (n, r) obtained from the linear prediction analysis unit 1*e* in the temporal direction, and transmits a value of $a_H$ (n, r) for a part of time slot $r_i$ and a value of the corresponding $r_i$, to the linear prediction coefficient quantizing unit 1*k* (process at Step Sc1). It is noted that $\kappa \leq i < N_{ts}$, and $N_{ts}$ is the number of time slots in a frame for which $a_H$ (n, r) is transmitted. The decimation of the linear prediction coefficients may be performed at a predetermined time interval, or may be performed at nonuniform time interval based on the characteristics of $a_H$ (n, r). For example, a method is possible that compares $G_H(r)$ of $a_H(n, r)$ in a frame having a certain length, and makes $a_H$ (n, r), of which $G_H(r)$ exceeds a certain value, an object of quantization. If the decimation interval of the linear prediction coefficients is a predetermined interval instead of using the characteristics of $a_H$ (n, r), $a_H$ (n, r) need not be calculated for the time slot at which the transmission is not performed.

The linear prediction coefficient quantizing unit 1*k* quantizes the decimated high frequency linear prediction coefficients $a_H$ (n, $r_i$) received from the linear prediction coefficient decimation unit 1*j* and indices $r_i$ of the corresponding time slots, and transmits them to the bit stream multiplexing unit 1*g*2 (process at Step Sc2). As an alternative structure, instead of quantizing $a_H$ (n, $r_i$), differential values $a_D$ (n, $r_i$) of the linear prediction coefficients may be quantized as the speech encoding device according to the modification 2 of the first embodiment.

The bit stream multiplexing unit 1*g*2 multiplexes the encoded bit stream calculated by the core codec encoding unit 1*c*, the SBR supplementary information calculated by the SBR encoding unit 1*d*, and indices $\{r_i\}$ of time slots corresponding to $a_H$ (n, $r_i$) being quantized and received from the linear prediction coefficient quantizing unit 1*k* into a bit stream, and outputs the multiplexed bit stream through the communication device of the speech encoding device 12 (process at Step Sc3).

Figure 8:
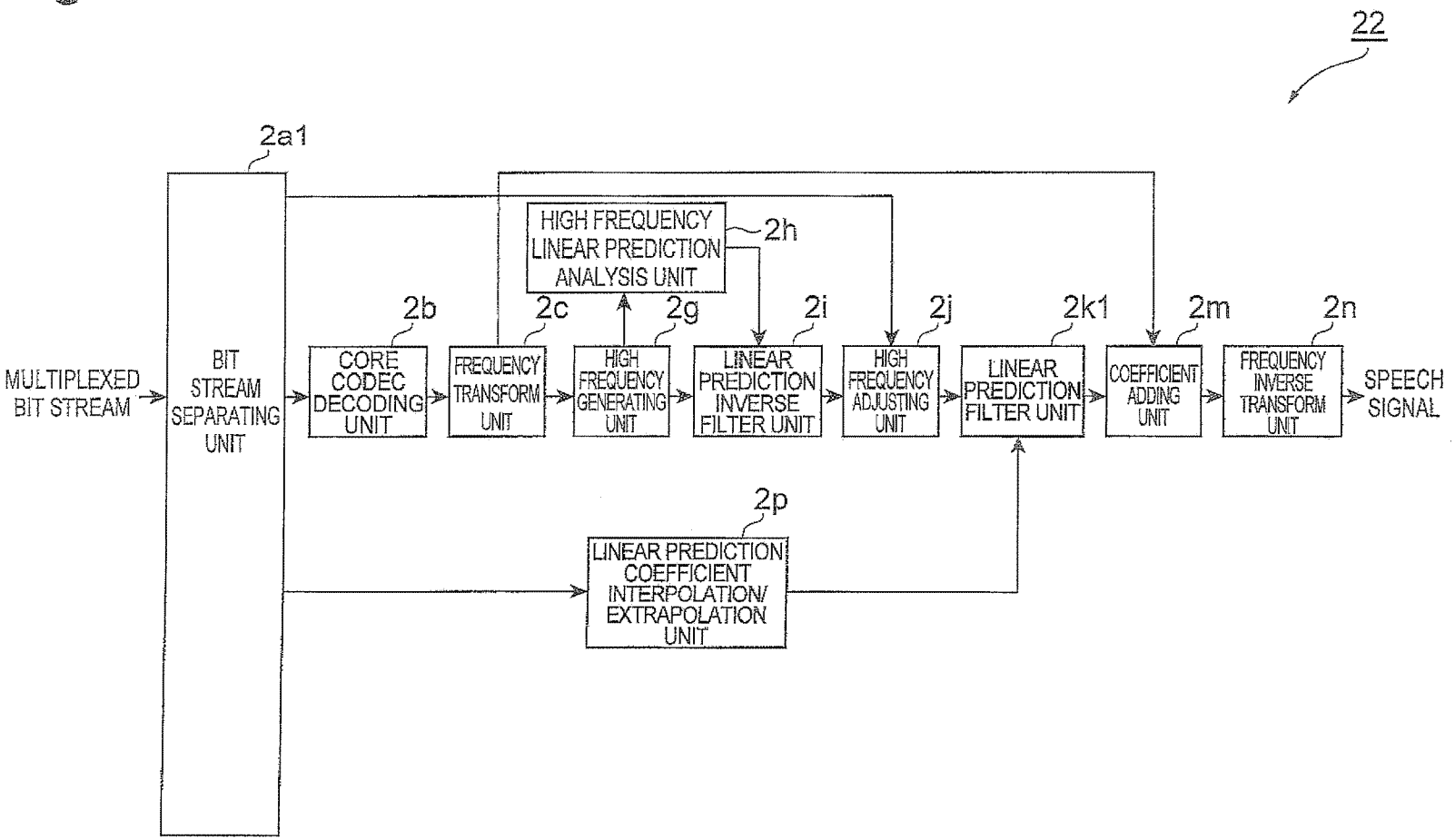
FIG. 8 is a diagram illustrating an example of a speech decoding device according to the second embodiment.
Figure 9:
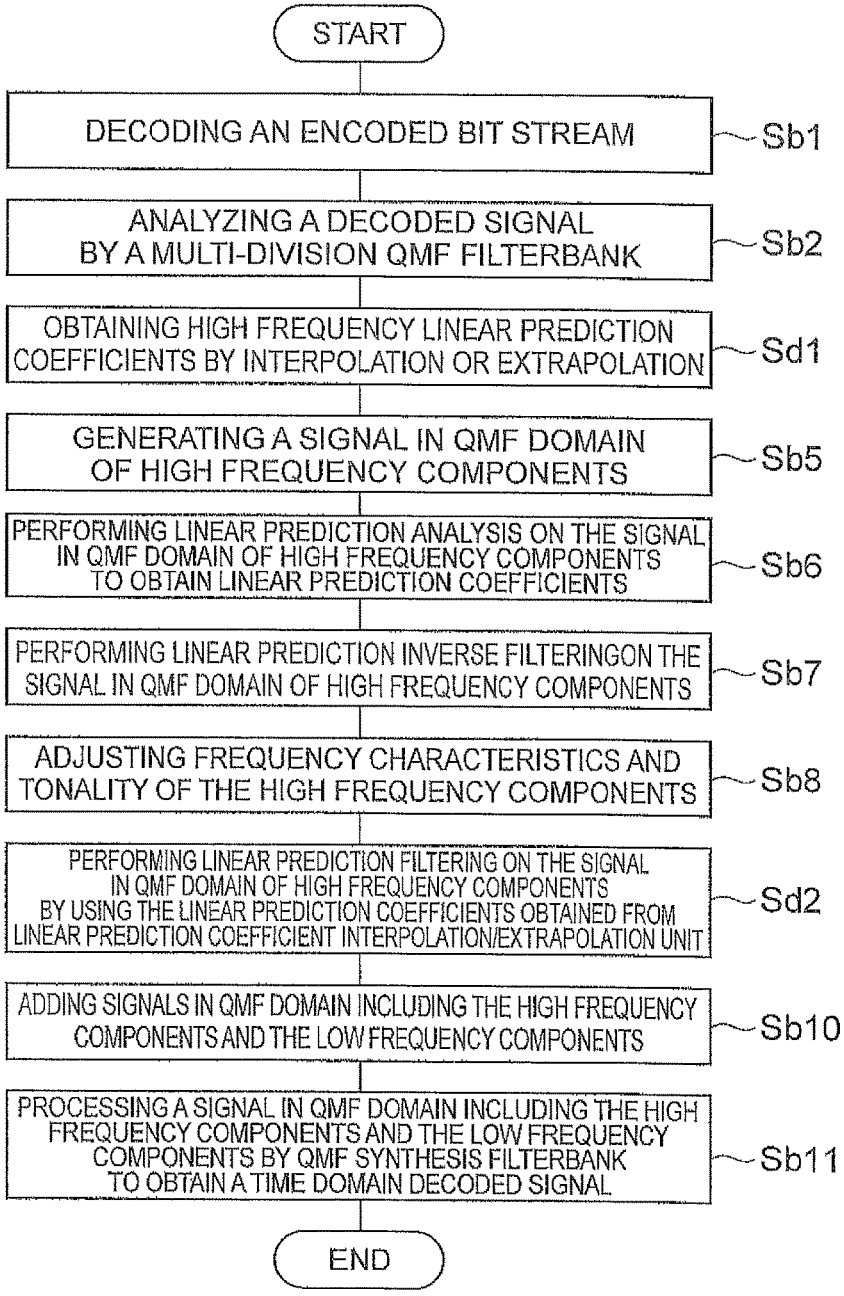
FIG. 9 is a flowchart to describe an example operation of the speech decoding device according to the second embodiment.

FIG. 8 is a diagram illustrating an example speech decoding device 22 according to the second embodiment. The speech decoding device 22 physically includes a CPU, a ROM, a RAM, a communication device, and the like, which are not illustrated, and the CPU integrally controls the speech decoding device 22 by loading and executing a predetermined computer program (such as a computer program for performing processes illustrated in the flowchart of FIG. 9) stored in a memory of the speech decoding device 22 such as the ROM into the RAM, as previously discussed. The communication device of the speech decoding device 22 receives the encoded multiplexed bit stream output from the speech encoding device 12, and outputs a decoded speech signal to outside the speech encoding device 12.

The speech decoding device 22 functionally includes a bit stream separating unit 2*a*1 (bit stream separating unit), a linear prediction coefficient interpolation/extrapolation unit 2*p* (linear prediction coefficient interpolation/extrapolation unit), and a linear prediction filter unit 2*k*1 (temporal envelope shaping unit) instead of the bit stream separating unit 2*a*, the low frequency linear prediction analysis unit 2*d*, the signal change detecting unit 2*e*, the filter strength adjusting unit 2*f*, and the linear prediction filter unit 2*k* of the speech decoding device 21. The bit stream separating unit 2*a*1, the core codec decoding unit 2*b*, the frequency transform unit 2*c*, the high frequency generating unit 2*g* to the high frequency adjusting unit 2*j*, the linear prediction filter unit 2*k*1, the coefficient adding unit 2*m*, the frequency inverse transform unit 2*n*, and the linear prediction coefficient interpolation/extrapolation unit 2*p* of the speech decoding device 22 illustrated in FIG. 8 are example functions realized when the CPU of the speech decoding device 22 executes the computer program stored in the memory of the speech decoding device 22. The CPU of the speech decoding device 22 sequentially executes processes (processes from Step Sb1 to Step Sd2, Step Sd1, from Step Sb5 to Step Sb8, Step Sd2, and from Step Sb10 to Step Sb11) illustrated in the example flowchart of FIG. 9, by executing the computer program (or by using the bit stream separating unit 2*a*1, the core codec decoding unit 2*b*, the frequency transform unit 2*c*, the high frequency generating unit 2*g* to the high frequency adjusting unit 2*j*, the linear prediction filter unit 2*k*1, the coefficient adding unit 2*m*, the frequency inverse transform unit 2*n*, and the linear prediction coefficient interpolation/extrapolation unit 2*p* illustrated in FIG. 8). Various types of data required to execute the computer program and various types of data generated by executing the computer program are all stored in the memory such as the ROM and the RAM of the speech decoding device 22.

The speech decoding device 22 includes the bit stream separating unit 2*a*1, the linear prediction coefficient interpolation/extrapolation unit 2*p*, and the linear prediction filter unit 2*k*1, instead of the bit stream separating unit 2*a*, the low frequency linear prediction analysis unit 2*d*, the signal change detecting unit 2*e*, the filter strength adjusting unit 2*f*, and the linear prediction filter unit 2*k* of the speech decoding device 22.

The bit stream separating unit 2*a*1 separates the multiplexed bit stream supplied through the communication device of the speech decoding device 22 into the indices $r_i$ of the time slots corresponding to $a_H$ (n, $r_i$) being quantized, the SBR supplementary information, and the encoded bit stream.

The linear prediction coefficient interpolation/extrapolation unit 2*p* receives the indices $r_i$ of the time slots corresponding to $a_H$ (n, $r_i$) being quantized from the bit stream separating unit 2*a*1, and obtains $a_H$ (n, r) corresponding to the time slots of which the linear prediction coefficients are not transmitted, by interpolation or extrapolation (processes at Step Sd1). The linear prediction coefficient interpolation/extrapolation unit 2*p* can extrapolate the linear prediction coefficients, for example, according to the following expression (16).

$$a_H(n,r)=\delta^{|r-r_{i0}|}a_H(n,r_{i0})\ (1\leq n\leq N) \tag{16}$$

where $r_{i0}$ is the nearest value to r in the time slots $\{r_i\}$ of which the linear prediction coefficients are transmitted. δ is a constant that satisfies $0<\delta<1$.

The linear prediction coefficient interpolation/extrapolation unit 2*p* can interpolate the linear prediction coefficients, for example, according to the following expression (17), where $r_{i0}<r<r_{i0+1}$ is satisfied.

$$a_H(n,r)=\frac{r_{i0+1}-r}{r_{i0+1}-r_i}\cdot a_H(n,r_i)+\frac{r-r_{i0}}{r_{i0+1}-r_{i0}}\cdot a_H(n,r_{i0+1})\ (1\leqq n\leqq N) \tag{17}$$

The linear prediction coefficient interpolation/extrapolation unit 2*p* may transform the linear prediction coefficients into other expression forms such as LSP (Linear Spectrum Pair), ISP (Immittance Spectrum Pair), LSF (Linear Spectrum Frequency), ISF (Immittance Spectrum Frequency), and PARCOR coefficient, interpolate or extrapolate them, and transform the obtained values into the linear prediction coefficients to be used. $a_H$ (n, r) being interpolated or extrapolated are transmitted to the linear prediction filter unit 2*k*1 and used as linear prediction coefficients for the linear prediction synthesis filtering, but may also be used as linear prediction coefficients in the linear prediction inverse filter unit 2*i*. If $a_D$ (n, $r_i$) is multiplexed into a bit stream instead of $a_H$ (n, r), the linear prediction coefficient interpolation/extrapolation unit 2*p* performs the differential decoding similar to that of the speech decoding device according to the modification 2 of the first embodiment, before performing the interpolation or extrapolation process described above.

The linear prediction filter unit 2*k*1 performs linear prediction synthesis filtering in the frequency direction on $q_{adj}$ (n, r) output from the high frequency adjusting unit 2*j*, by using $a_H$ (n, r) being interpolated or extrapolated obtained from the linear prediction coefficient interpolation/extrapolation unit 2*p* (process at Step Sd2). A transfer function of the linear prediction filter unit 2*k*1 can be expressed as the following expression (18). The linear prediction filter unit 2*k*1 shapes the temporal envelope of the high frequency components generated by the SBR by performing linear prediction synthesis filtering, as the linear prediction filter unit 2*k* of the speech decoding device 21.

$$g(z)=\frac{1}{1+\sum_{n=1}^{N}a_H(n,r)z^{-n}} \tag{18}$$

Third Embodiment

Figure 10:
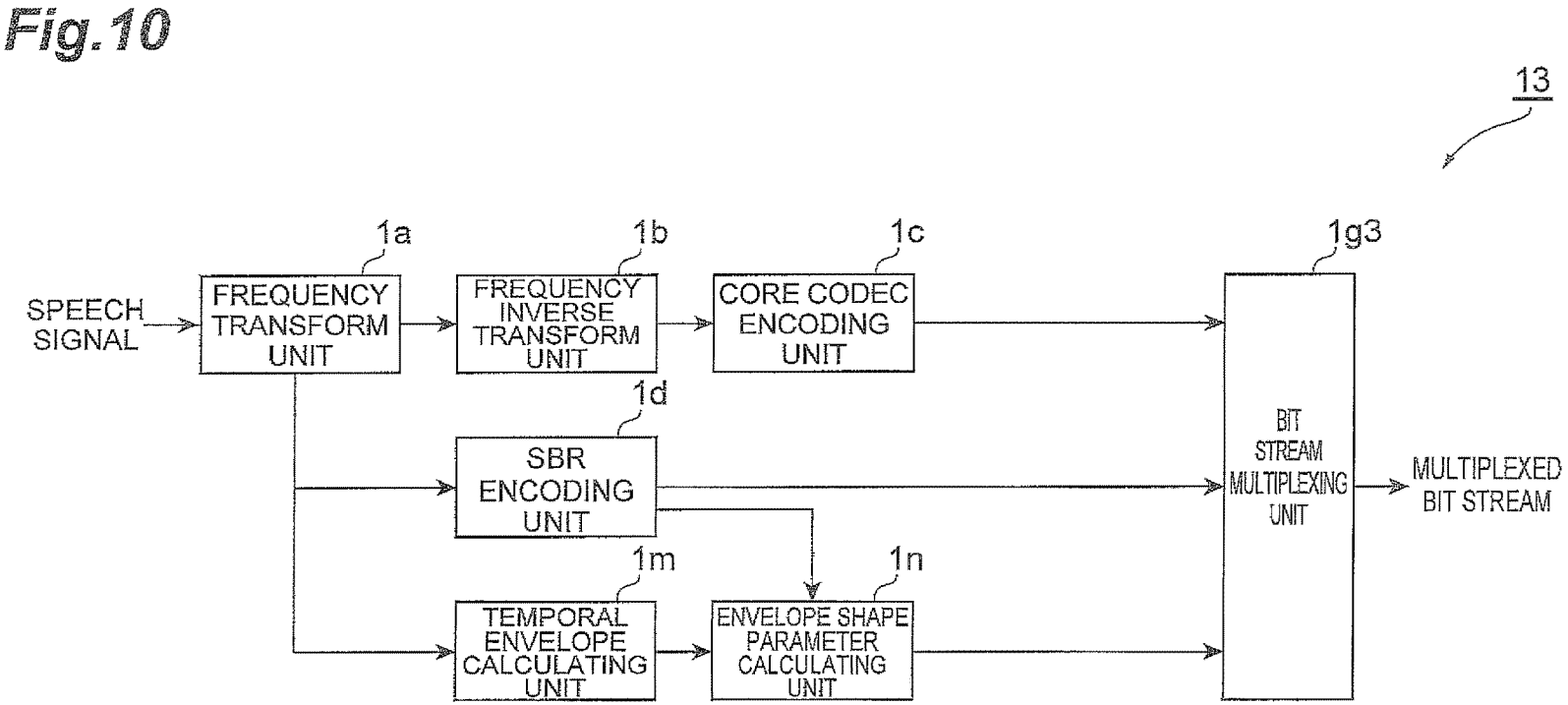
FIG. 10 is a diagram illustrating an example of a speech encoding device according to a third embodiment.
Figure 11:
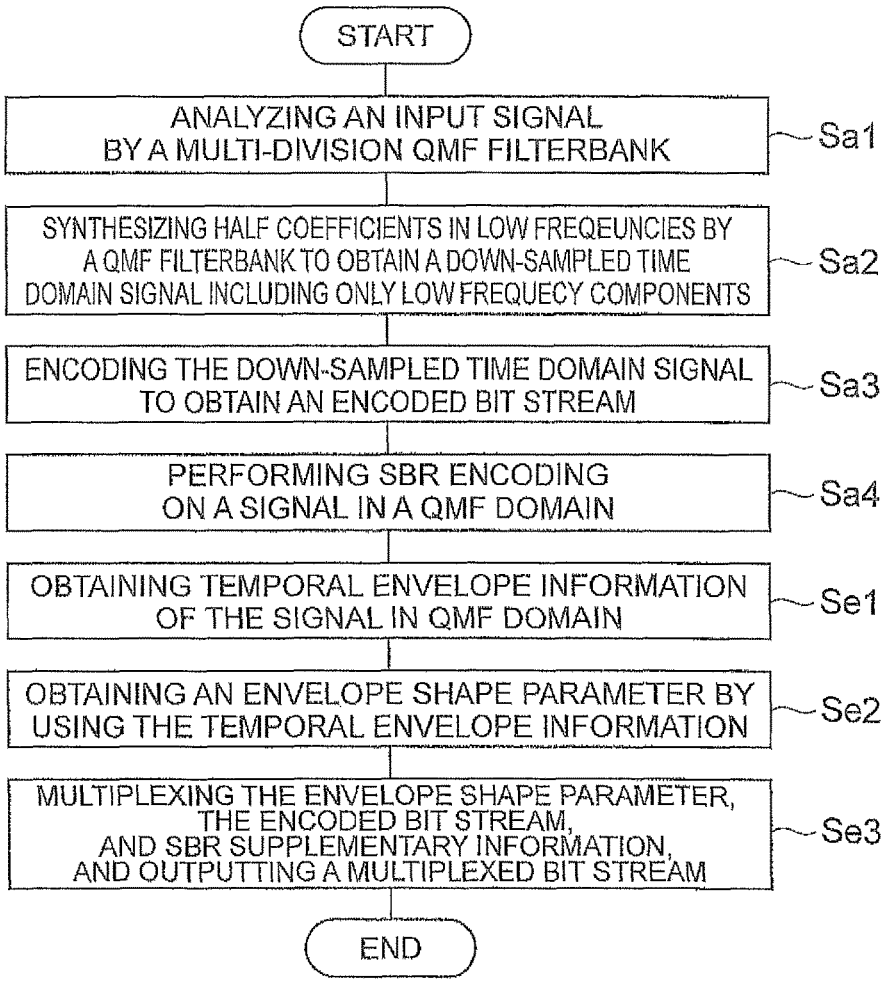
FIG. 11 is a flowchart to describe an example operation of the speech encoding device according to the third embodiment.

FIG. 10 is a diagram illustrating an example speech encoding device 13 according to a third embodiment. The speech encoding device 13 physically includes a CPU, a ROM, a RAM, a communication device, and the like, which are not illustrated, and the CPU integrally controls the speech encoding device 13 by loading and executing a predetermined computer program (such as a computer program for performing processes illustrated in the flowchart of FIG. 11) stored in a built-in memory of the speech encoding device 13 such as the ROM into the RAM, as previously discussed. The communication device of the speech encoding device 13 receives a speech signal to be encoded from outside the speech encoding device, and outputs an encoded multiplexed bit stream to the outside.

The speech encoding device 13 functionally includes a temporal envelope calculating unit 1*m* (temporal envelope supplementary information calculating unit), an envelope shape parameter calculating unit 1*n* (temporal envelope supplementary information calculating unit), and a bit stream multiplexing unit 1*g*3 (bit stream multiplexing unit), instead of the linear prediction analysis unit 1*e*, the filter strength parameter calculating unit 1*f*, and the bit stream multiplexing unit 1*g* of the speech encoding device 11. The frequency transform unit 1*a* to the SBR encoding unit 1*d*, the temporal envelope calculating unit 1*m*, the envelope shape parameter calculating unit 1*n*, and the bit stream multiplexing unit 1*g*3 of the speech encoding device 13 illustrated in FIG. 10 are functions realized when the CPU of the speech encoding device 13 executes the computer program stored in the built-in memory of the speech encoding device 13. The CPU of the speech encoding device 13 sequentially executes processes (processes from Step Sa1 to Step Sa 4 and from Step Se1 to Step Se3) illustrated in the example flowchart of FIG. 11, by executing the computer program (or by using the frequency transform unit 1*a* to the SBR encoding unit 1*d*, the temporal envelope calculating unit 1*m*, the envelope shape parameter calculating unit 1*n*, and the bit stream multiplexing unit 1*g*3 of the speech encoding device 13 illustrated in FIG. 10). Various types of data required to execute the computer program and various types of data generated by executing the computer program are all stored in the built-in memory such as the ROM and the RAM of the speech encoding device 13.

The temporal envelope calculating unit 1*m* receives q (k, r), and for example, obtains temporal envelope information e(r) of the high frequency components of a signal, by obtaining the power of each time slot of q (k, r) (process at Step Se1). In this case, e(r) is obtained according to the following expression (19).

$$e(r)=\sqrt{\sum_{k=k_x}^{63}|q(k,r)|^2} \tag{19}$$

The envelope shape parameter calculating unit 1*n* receives e(r) from the temporal envelope calculating unit 1*m* and receives SBR envelope time borders $\{b_i\}$ from the SBR encoding unit 1*d*. It is noted that $0\leq i\leq Ne$, and Ne is the number of SBR envelopes in the encoded frame. The envelope shape parameter calculating unit 1*n* obtains an envelope shape parameter s(i) ($0\leq i\leq Ne$) of each of the SBR envelopes in the encoded frame according to the following expression (20) (process at Step Se2). The envelope shape parameter s(i) corresponds to the temporal envelope supplementary information, and is similar in the third embodiment.

$$s(i) = \frac{1}{b_{i+1} - b_i - 1} \sum_{r=bi}^{b_{i+1}-1} (\overline{e(i)} - e(r))^2 \tag{20}$$

It is noted that:

$$\overline{e(i)} = \frac{\sum_{r=bi}^{b_{i+1}-1} e(r)}{b_{i+1} - b_i} \tag{21}$$

where s(i) in the above expression is a parameter indicating the magnitude of the variation of e(r) in the i-th SBR envelope satisfying $b_i \leq r < b_{i+1}$, and e(r) has a larger number as the variation of the temporal envelope is increased. The expressions (20) and (21) described above are examples of method for calculating s(i), and for example, s(i) may also be obtained by using, for example, SMF (Spectral Flatness Measure) of e(r), a ratio of the maximum value to the minimum value, and the like. s(i) is then quantized, and transmitted to the bit stream multiplexing unit 1*g*3.

The bit stream multiplexing unit 1*g*3 multiplexes the encoded bit stream calculated by the core codec encoding unit 1*c*, the SBR supplementary information calculated by the SBR encoding unit 1*d*, and s(i) into a bit stream, and outputs the multiplexed bit stream through the communication device of the speech encoding device 13 (process at Step Se3).

Figure 12:
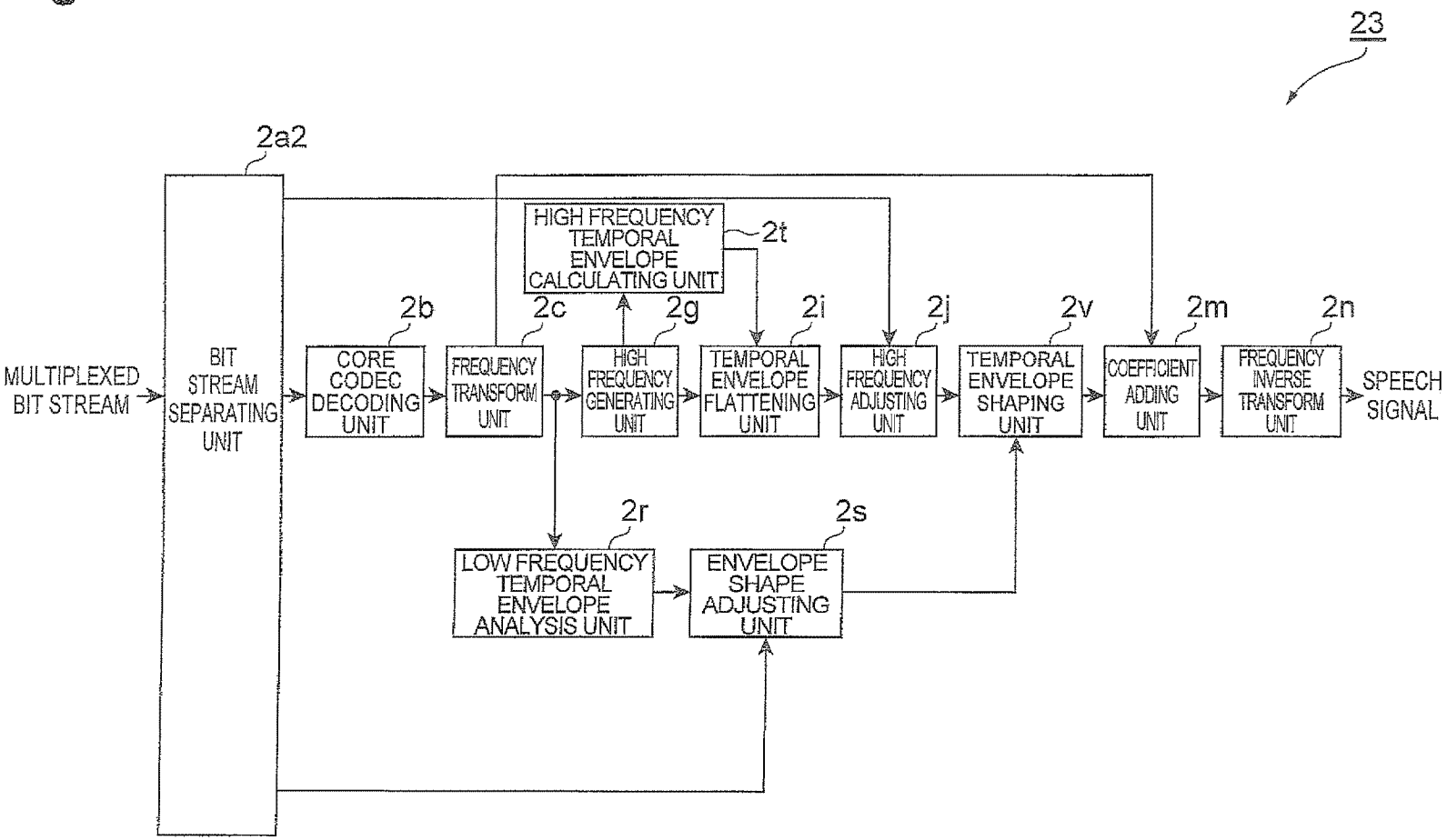
FIG. 12 is a diagram illustrating an example of a speech decoding device according to the third embodiment.
Figure 13:
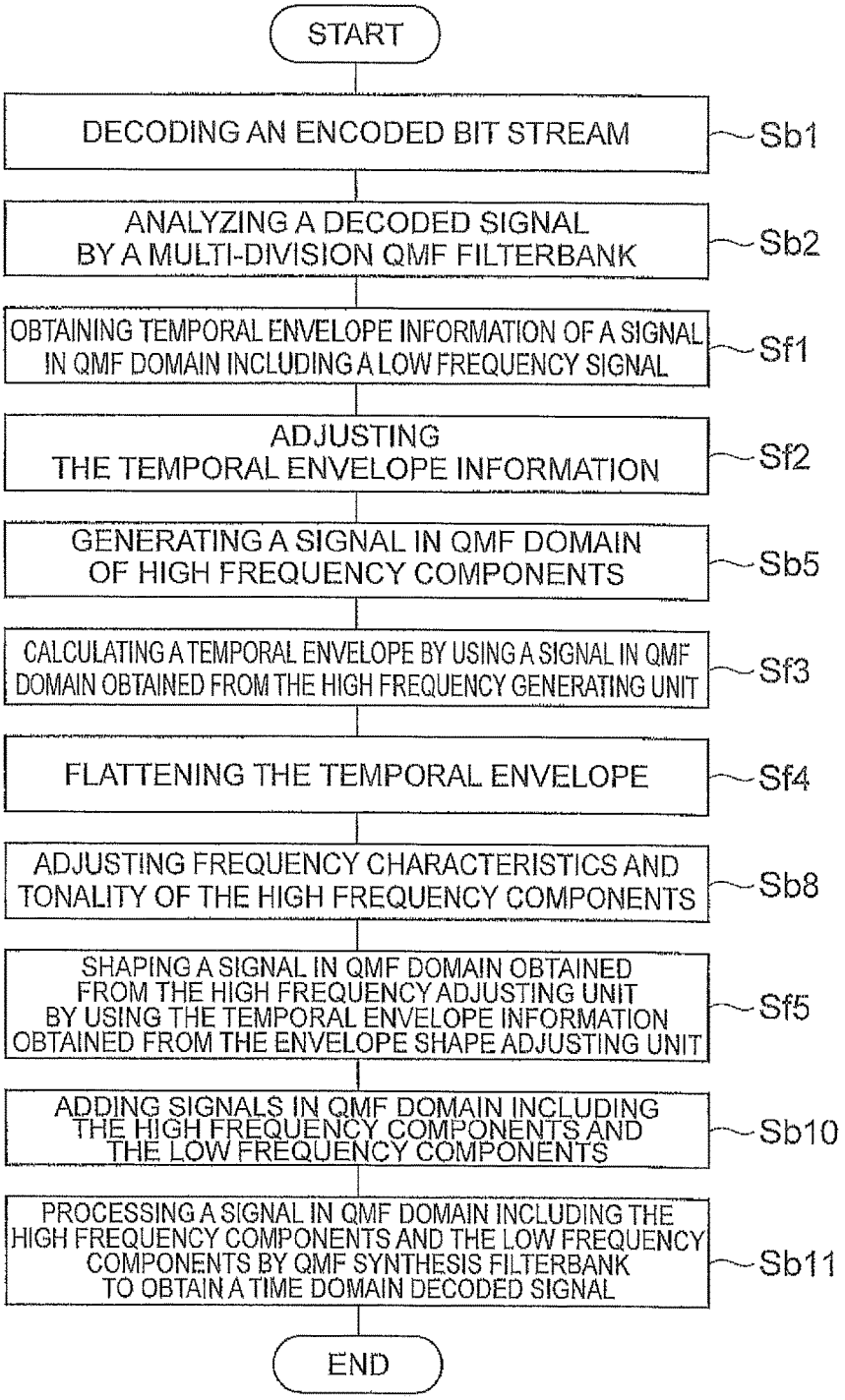
FIG. 13 is a flowchart to describe an example operation of the speech decoding device according to the third embodiment.

FIG. 12 is a diagram illustrating an example speech decoding device 23 according to the third embodiment. The speech decoding device 23 physically includes a CPU, a ROM, a RAM, a communication device, and the like, which are not illustrated, and the CPU integrally controls the speech decoding device 23 by loading and executing a predetermined computer program (such as a computer program for performing processes illustrated in the flowchart of FIG. 13) stored in a built-in memory of the speech decoding device 23 such as the ROM into the RAM. The communication device of the speech decoding device 23 receives the encoded multiplexed bit stream output from the speech encoding device 13, and outputs a decoded speech signal to outside of the speech decoding device 23.

The speech decoding device 23 functionally includes a bit stream separating unit 2*a*2 (bit stream separating unit), a low frequency temporal envelope calculating unit 2*r* (low frequency temporal envelope analysis unit), an envelope shape adjusting unit 2*s* (temporal envelope adjusting unit), a high frequency temporal envelope calculating unit 2*t*, a temporal envelope smoothing unit 2*u*, and a temporal envelope shaping unit 2*v* (temporal envelope shaping unit), instead of the bit stream separating unit 2*a*, the low frequency linear prediction analysis unit 2*d*, the signal change detecting unit 2*e*, the filter strength adjusting unit 2*f*, the high frequency linear prediction analysis unit 2*h*, the linear prediction inverse filter unit 2*i*, and the linear prediction filter unit 2*k* of the speech decoding device 21. The bit stream separating unit 2*a*2, the core codec decoding unit 2*b* to the frequency transform unit 2*c*, the high frequency generating unit 2*g*, the high frequency adjusting unit 2*j*, the coefficient adding unit 2*m*, the frequency inverse transform unit 2*n*, and the low frequency temporal envelope calculating unit 2*r* to the temporal envelope shaping unit 2*v* of the speech decoding device 23 illustrated in FIG. 12 are example functions realized when the CPU of the speech encoding device 23 executes the computer program stored in the built-in memory of the speech encoding device 23. The CPU of the speech decoding device 23 sequentially executes processes (processes from Step Sb1 to Step Sb2, from Step Sf1 to Step Sf2, Step Sb5, from Step Sf3 to Step Sf4, Step Sb8, Step Sf5, and from Step Sb10 to Step Sb11) illustrated in the example flowchart of FIG. 13, by executing the computer program (or by using the bit stream separating unit 2*a*2, the core codec decoding unit 2*b* to the frequency transform unit 2*c*, the high frequency generating unit 2*g*, the high frequency adjusting unit 2*j*, the coefficient adding unit 2*m*, the frequency inverse transform unit 2*n*, and the low frequency temporal envelope calculating unit 2*r* to the temporal envelope shaping unit 2*v* of the speech decoding device 23 illustrated in FIG. 12). Various types of data required to execute the computer program and various types of data generated by executing the computer program are all stored in the built-in memory such as the ROM and the RAM of the speech decoding device 23.

The bit stream separating unit 2*a*2 separates the multiplexed bit stream supplied through the communication device of the speech decoding device 23 into s(i), the SBR supplementary information, and the encoded bit stream. The low frequency temporal envelope calculating unit 2*r* receives $q_{dec}$ (k, r) including the low frequency components from the frequency transform unit 2*c*, and obtains e(r) according to the following expression (22) (process at Step Sf1).

$$e(r) = \sqrt{\sum_{k=0}^{63} |q_{dec}(k, r)|^2} \tag{22}$$

The envelope shape adjusting unit 2*s* adjusts e(r) by using s(i), and obtains the adjusted temporal envelope information $e_{adj}$(r) (process at Step Sf2). e(r) can be adjusted, for example, according to the following expressions (23) to (25).

$$\begin{aligned} e_{adj}(r) &= \overline{e(i)} + \sqrt{s(i) - v(i)} \cdot (e(r) - \overline{e(i)}) \quad (s(i) > v(i)) \\ e_{adj}(r) &= e(r) \quad \text{(otherwise)} \end{aligned} \tag{23}$$

It is noted that:

$$\overline{e(i)} = \frac{\sum_{r=bi}^{b_{i+1}-1} e(r)}{b_{i+1} - b_i} \tag{24}$$

$$v(i) = \frac{1}{b_{i+1} - b_i - 1} \sum_{r=bi}^{b_{i+1}-1} (\overline{e(i)} - e(r))^2 \tag{25}$$

The expressions (23) to (25) described above are examples of adjusting method, and the other adjusting method by which the shape of $e_{adj}$(r) becomes similar to the shape illustrated by s(i) may also be used.

The high frequency temporal envelope calculating unit 2*t* calculates a temporal envelope $e_{exp}$(r) by using $q_{exp}$ (k, r) obtained from the high frequency generating unit 2*g*, according to the following expression (26) (process at Step Sf3).

$$e_{exp}(r) = \sqrt{\sum_{k=k_x}^{63} |q_{exp}(k, r)|^2} \tag{26}$$

The temporal envelope flattening unit 2*u* flattens the temporal envelope of $q_{exp}$ (k, r) obtained from the high frequency generating unit 2*g* according to the following expression (27), and transmits the obtained signal $q_{flat}$ (k, r) in the QMF domain to the high frequency adjusting unit 2*j* (process at Step Sf4).

$$q_{flat}(k, r) = \frac{q_{exp}(k, r)}{e_{exp}(r)} \quad (k_x \leqq k \leqq 63) \tag{27}$$

The flattening of the temporal envelope by the temporal envelope flattening unit 2*u* may also be omitted. Instead of calculating the temporal envelope of the high frequency components of the output from the high frequency generating unit 2*g* and flattening the temporal envelope thereof, the temporal envelope of the high frequency components of an output from the high frequency adjusting unit 2*j* may be calculated, and the temporal envelope thereof may be flattened. The temporal envelope used in the temporal envelope flattening unit 2*u* may also be $e_{adj}$(r) obtained from the envelope shape adjusting unit 2*s*, instead of $e_{exp}$(r) obtained from the high frequency temporal envelope calculating unit 2*t*.

The temporal envelope shaping unit 2*v* shapes $q_{adj}$ (k, r) obtained from the high frequency adjusting unit 2*j* by using $e_{adj}$(r) obtained from the temporal envelope shaping unit 2*v*, and obtains a signal $q_{envadj}$ (k, r) in the QMF domain in which the temporal envelope is shaped (process at Step Sf5). The shaping is performed according to the following expression (28). $q_{envadj}$ (k, r) is transmitted to the coefficient adding unit 2*m* as a signal in the QMF domain corresponding to the high frequency components.

$$q_{envadj}(k,r)=q_{adj}(k,r)\cdot e_{adj}(r) \quad (k_x \leq k=63) \tag{28}$$

Fourth Embodiment

Figure 14:
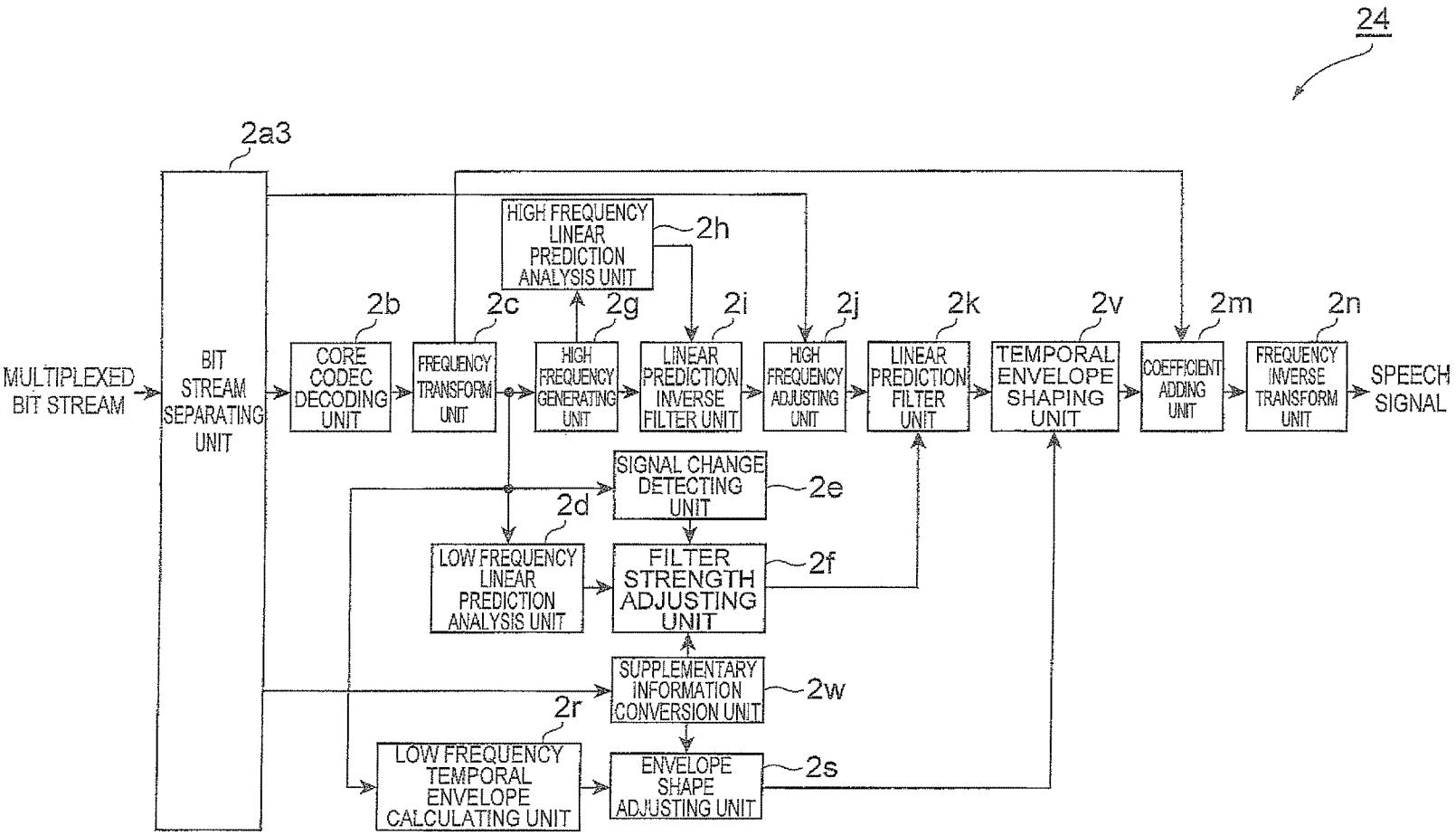
FIG. 14 is a diagram illustrating an example of a speech decoding device according to a fourth embodiment.

FIG. 14 is a diagram illustrating an example speech decoding device 24 according to a fourth embodiment. The speech decoding device 24 physically includes a CPU, a ROM, a RAM, a communication device, and the like, which are not illustrated, and the CPU integrally controls the speech decoding device 24 by loading and executing a predetermined computer program stored in a built-in memory of the speech decoding device 24 such as the ROM into the RAM. The communication device of the speech decoding device 24 receives the encoded multiplexed bit stream output from the speech encoding device 11 or the speech encoding device 13, and outputs a decoded speech signal to outside the speech encoding device.

The speech decoding device 24 functionally includes the structure of the speech decoding device 21 (the core codec decoding unit 2*b*, the frequency transform unit 2*c*, the low frequency linear prediction analysis unit 2*d*, the signal change detecting unit 2*e*, the filter strength adjusting unit 2*f*, the high frequency generating unit 2*g*, the high frequency linear prediction analysis unit 2*h*, the linear prediction inverse filter unit 2*i*, the high frequency adjusting unit 2*j*, the linear prediction filter unit 2*k*, the coefficient adding unit 2*m*, and the frequency inverse transform unit 2*n*) and the structure of the speech decoding device 23 (the low frequency temporal envelope calculating unit 2*r*, the envelope shape adjusting unit 2*s*, and the temporal envelope shaping unit 2*v*). The speech decoding device 24 also includes a bit stream separating unit 2*a*3 (bit stream separating unit) and a supplementary information conversion unit 2*w*. The order of the linear prediction filter unit 2*k* and the temporal envelope shaping unit 2*v* may be opposite to that illustrated in FIG. 14. The speech decoding device 24 preferably receives the bit stream encoded by the speech encoding device 11 or the speech encoding device 13. The structure of the speech decoding device 24 illustrated in FIG. 14 is a function realized when the CPU of the speech decoding device 24 executes the computer program stored in the built-in memory of the speech decoding device 24. Various types of data required to execute the computer program and various types of data generated by executing the computer program are all stored in the built-in memory such as the ROM and the RAM of the speech decoding device 24.

The bit stream separating unit 2*a*3 separates the multiplexed bit stream supplied through the communication device of the speech decoding device 24 into the temporal envelope supplementary information, the SBR supplementary information, and the encoded bit stream. The temporal envelope supplementary information may also be K(r) described in the first embodiment or s(i) described in the third embodiment. The temporal envelope supplementary information may also be another parameter X(r) that is neither K(r) nor s(i).

The supplementary information conversion unit 2*w* transforms the supplied temporal envelope supplementary information to obtain K(r) and s(i). If the temporal envelope supplementary information is K(r), the supplementary information conversion unit 2*w* transforms K(r) into s(i). The supplementary information conversion unit 2*w* may also obtain, for example, an average value of K(r) in a section of $b_i \leq r \leq b_{i+1}$ $$\overline{K}(i) \tag{29}$$

and transform the average value represented in the expression (29) into s(i) by using a predetermined table. If the temporal envelope supplementary information is s(i), the supplementary information conversion unit 2*w* transforms s(i) into K(r). The supplementary information conversion unit 2*w* may also perform the conversion by converting s(i) into K(r), for example, by using a predetermined table. It is noted that i and r are associated with each other so as to satisfy the relationship of $b_i \leq r < b_{i+1}$.

If the temporal envelope supplementary information is a parameter X(r) that is neither s(i) nor K(r), the supplementary information conversion unit 2*w* converts X(r) into K(r) and s(i). It is preferable that the supplementary information conversion unit 2*w* converts X(r) into K(r) and s(i), for example, by using a predetermined table. It is also preferable that the supplementary information conversion unit 2*w* transmits X(r) as a representative value every SBR envelope. The tables for transforming X(r) into K(r) and s(i) may be different from each other.

Modification 3 of First Embodiment

In the speech decoding device 21 of the first embodiment, the linear prediction filter unit 2*k* of the speech decoding device 21 may include an automatic gain control process. The automatic gain control process is a process to adjust the power of the signal in the QMF domain output from the linear prediction filter unit 2*k* to the power of the signal in the QMF domain being supplied. In general, a signal $q_{syn,pow}(n, r)$ in the QMF domain whose gain has been controlled is realized by the following expression.

$$q_{syn,pow}(n, r) = q_{syn}(n, r) \cdot \sqrt{\frac{P_0(r)}{P_1(r)}} \tag{30}$$

Here, $P_0(r)$ and $P_1(r)$ are expressed by the following expression (31) and the expression (32).

$$P_0(r) = \sum_{n=k_x}^{63} |q_{adj}(n, r)|^2 \tag{31}$$

$$P_1(r) = \sum_{n=k_x}^{63} |q_{syn}(n, r)|^2 \tag{32}$$

By carrying out the automatic gain control process, the power of the high frequency components of the signal output from the linear prediction filter unit 2*k* is adjusted to a value equivalent to that before the linear prediction filtering. As a result, for the output signal of the linear prediction filter unit 2*k* in which the temporal envelope of the high frequency components generated based on SBR is shaped, the effect of adjusting the power of the high frequency signal performed by the high frequency adjusting unit 2*j* can be maintained. The automatic gain control process can also be performed individually on a certain frequency range of the signal in the QMF domain. The process performed on the individual frequency range can be realized by limiting n in the expression (30), the expression (31), and the expression (32) within a certain frequency range. For example, i-th frequency range can be expressed as $F_i \leq n < F_{i+1}$ (in this case, i is an index indicating the number of a certain frequency range of the signal in the QMF domain). $F_i$ indicates the frequency range boundary, and it is preferable that Fi be a frequency boundary table of an envelope scale factor defined in SBR in "MPEG4 AAC". The frequency boundary table is defined by the high frequency generating unit 2*g* based on the definition of SBR in "MPEG4 AAC". By performing the automatic gain control process, the power of the output signal from the linear prediction filter unit 2*k* in a certain frequency range of the high frequency components is adjusted to a value equivalent to that before the linear prediction filtering. As a result, the effect for adjusting the power of the high frequency signal performed by the high frequency adjusting unit 2*j* on the output signal from the linear prediction filter unit 2*k* in which the temporal envelope of the high frequency components generated based on SBR is shaped, is maintained per unit of frequency range. The changes made to the present modification 3 of the first embodiment may also be made to the linear prediction filter unit 2*k* of the fourth embodiment.

Modification 1 of Third Embodiment

The envelope shape parameter calculating unit 1*n* in the speech encoding device 13 of the third embodiment can also be realized by the following process. The envelope shape parameter calculating unit 1*n* obtains an envelope shape parameter s(i) ($0 \leq i < Ne$) according to the following expression (33) for each SBR envelope in the encoded frame.

$$s(i) = 1 - \min\left(\frac{e(r)}{\overline{e(i)}}\right) \tag{33}$$

It is noted that:

$$\overline{e(i)} \tag{34}$$

is an average value of e(r) in the SBR envelope, and the calculation method is based on the expression (21). It is noted that the SBR envelope indicates the time segment satisfying $b_i \leq r < b_{i+1}$. $\{b_i\}$ are the time borders of the SBR envelopes included in the SBR supplementary information as information, and are the boundaries of the time segment for which the SBR envelope scale factor representing the average signal energy in a certain time segment and a certain frequency range is given. min (·) represents the minimum value within the range of $b_i \leq r < b_{i+1}$. Accordingly, in this case, the envelope shape parameter s(i) is a parameter for indicating a ratio of the minimum value to the average value of the adjusted temporal envelope information in the SBR envelope. The envelope shape adjusting unit 2*s* in the speech decoding device 23 of the third embodiment may also be realized by the following process. The envelope shape adjusting unit 2*s* adjusts e(r) by using s(i) to obtain the adjusted temporal envelope information $e_{adj}(r)$. The adjusting method is based on the following expression (35) or expression (36).

$$e_{adj}(r) = \overline{e(i)}\left(1 + s(i)\frac{(e(r) - \overline{e(i)})}{\overline{e(i)} - \min(e(r))}\right) \tag{35}$$

$$e_{adj}(r) = \overline{e(i)}\left(1 + s(i)\frac{(e(r) - \overline{e(i)})}{\overline{e(i)}}\right) \tag{36}$$

The expression 35 adjusts the envelope shape so that the ratio of the minimum value to the average value of the adjusted temporal envelope information $e_{adj}(r)$ in the SBR envelope becomes equivalent to the value of the envelope shape parameter s(i). The changes made to the modification 1 of the third embodiment described above may also be made to the fourth embodiment.

Modification 2 of Third Embodiment

The temporal envelope shaping unit 2*v* may also use the following expression instead of the expression (28). As indicated in the expression (37), $e_{adj,scaled}(r)$ is obtained by controlling the gain of the adjusted temporal envelope information $e_{adj}(r)$, so that the power of $q_{envadj}$ (k,r) maintains that of $q_{adj}$ (k, r) within the SBR envelope. As indicated in the expression (38), in the present modification 2 of the third embodiment, $q_{envadj}$ (k, r) is obtained by multiplying the signal $q_{adj}$ (k, r) in the QMF domain by $e_{adj,scaled}(r)$ instead of $e_{adj}(r)$. Accordingly, the temporal envelope shaping unit 2*v* can shape the temporal envelope of the signal $q_{adj}$ (k, r) in the QMF domain, so that the signal power within the SBR envelope becomes equivalent before and after the shaping of the temporal envelope. It is noted that the SBR envelope indicates the time segment satisfying $b_i \leq r < b_{i+1}$. $\{b_i\}$ are the time borders of the SBR envelopes included in the SBR supplementary information as information, and are the boundaries of the time segment for which the SBR envelope scale factor representing the average signal energy of a certain time segment and a certain frequency range is given. The terminology "SBR envelope" in the embodiments of the present invention corresponds to the terminology "SBR envelope time segment" in "MPEG4 AAC" defined in "ISO/IEC 14496-3", and the "SBR envelope" has the same contents as the "SBR envelope time segment" throughout the embodiments.

$$e_{adj,scaled}(r) = e_{adj}(r) \cdot \sqrt{\frac{\sum_{k=k_x}^{63} \sum_{r=b_i}^{b_{i+1}-1} |q_{adj}(k, r)|^2}{\sum_{k=k_x}^{63} \sum_{r=b_i}^{b_{i+1}-1} |q_{adj}(k, r) \cdot e_{adj}(r)|^2}} \quad (37)$$

$$(k_x \le k \le 63,\ b_i \le r < b_{i+1})$$

$$q_{envadj}(k, r) = q_{adj}(k, r) \cdot e_{adj,scaled}(r) \quad (38)$$

$$(k_x \le k \le 63,\ b_i \le r < b_{i+1})$$

The changes made to the present modification 2 of the third embodiment described above may also be made to the fourth embodiment.

Modification 3 of Third Embodiment

The expression (19) may also be the following expression (39).

$$e(r) = \sqrt{\frac{(b_{i+1} - b_i) \sum_{k=k_x}^{63} |q(k, r)|^2}{\sum_{r=b_i}^{b_{i+1}-1} \sum_{k=k_x}^{63} |q(k, r)|^2}} \quad (39)$$

The expression (22) may also be the following expression (40).

$$e(r) = \sqrt{\frac{(b_{i+1} - b_i) \sum_{k=0}^{63} |q_{dec}(k, r)|^2}{\sum_{r=b_i}^{b_{i+1}-1} \sum_{k=0}^{63} |q_{dec}(k, r)|^2}} \quad (40)$$

The expression (26) may also be the following expression (41).

$$e_{exp}(r) = \sqrt{\frac{(b_{i+1} - b_i) \sum_{k=k_x}^{63} |q_{exp}(k, r)|^2}{\sum_{r=b_i}^{b_{i+1}-1} \sum_{k=k_x}^{63} |q_{exp}(k, r)|^2}} \quad (41)$$

When the expression (39) and the expression (40) are used, the temporal envelope information e(r) is information in which the power of each QMF subband sample is normalized by the average power in the SBR envelope, and the square root is extracted. However, the QMF subband sample is a signal vector corresponding to the time index "r" in the QMF domain signal, and is one subsample in the QMF domain. In all the embodiments of the present invention, the terminology "time slot" has the same contents as the "QMF subband sample". In this case, the temporal envelope information e(r) is a gain coefficient that should be multiplied by each QMF subband sample, and the same applies to the adjusted temporal envelope information $e_{adj}(r)$.

Modification 1 of Fourth Embodiment

A speech decoding device 24*a* (not illustrated) of a modification 1 of the fourth embodiment physically includes a CPU, a ROM, a RAM, a communication device, and the like, which are not illustrated, and the CPU integrally controls the speech decoding device 24*a* by loading and executing a predetermined computer program stored in a built-in memory of the speech decoding device 24*a* such as the ROM into the RAM. The communication device of the speech decoding device 24*a* receives the encoded multiplexed bit stream output from the speech encoding device 11 or the speech encoding device 13, and outputs a decoded speech signal to outside the speech decoding device 24*a*. The speech decoding device 24*a* functionally includes a bit stream separating unit 2*a*4 (not illustrated) instead of the bit stream separating unit 2*a*3 of the speech decoding device 24, and also includes a temporal envelope supplementary information generating unit 2*y* (not illustrated), instead of the supplementary information conversion unit 2*w*. The bit stream separating unit 2*a*4 separates the multiplexed bit stream into the SBR information and the encoded bit stream. The temporal envelope supplementary information generating unit 2*y* generates temporal envelope supplementary information based on the information included in the encoded bit stream and the SBR supplementary information.

To generate the temporal envelope supplementary information in a certain SBR envelope, for example, the time width $(b_{i+1}-b_i)$ of the SBR envelope, a frame class, a strength parameter of the inverse filter, a noise floor, the amplitude of the high frequency power, a ratio of the high frequency power to the low frequency power, a autocorrelation coefficient or a prediction gain of a result of performing linear prediction analysis in the frequency direction on a low frequency signal represented in the QMF domain, and the like may be used. The temporal envelope supplementary information can be generated by determining K(r) or s(i) based on one or a plurality of values of the parameters. For example, the temporal envelope supplementary information can be generated by determining K(r) or s(i) based on $(b_{i+1}-b_i)$ so that K(r) or s(i) is reduced as the time width $(b_{i+1}-b_i)$ of the SBR envelope is increased, or K(r) or s(i) is increased as the time width $(b_{i+1}-b_i)$ of the SBR envelope is increased. The similar changes may also be made to the first embodiment and the third embodiment.

Modification 2 of Fourth Embodiment

Figure 15:
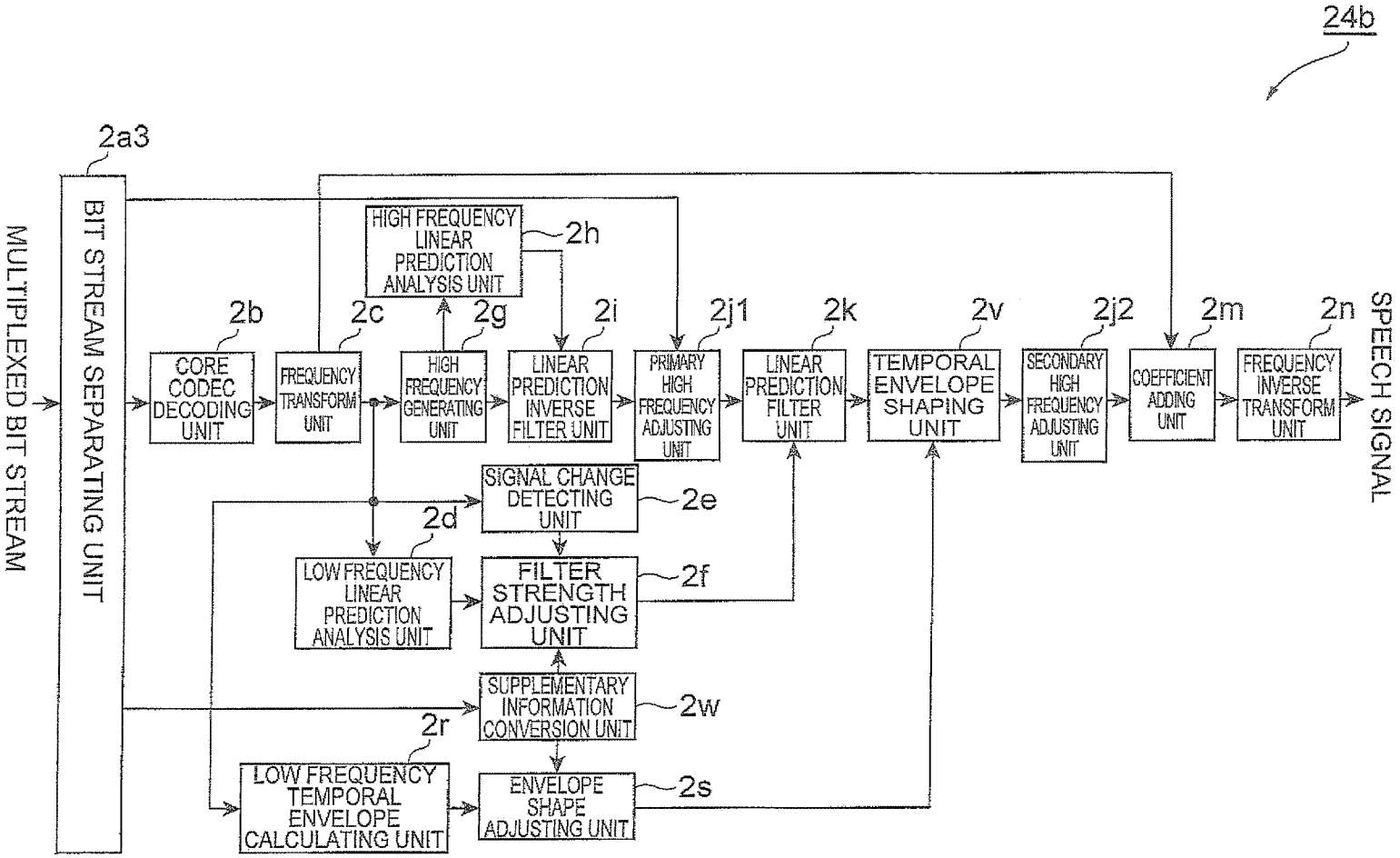
FIG. 15 is a diagram illustrating an example of a speech decoding device according to a modification of the fourth embodiment.

A speech decoding device 24*b* (see FIG. 15) of a modification 2 of the fourth embodiment physically includes a CPU, a ROM, a RAM, a communication device, and the like, which are not illustrated, and the CPU integrally controls the speech decoding device 24*b* by loading and executing a predetermined computer program stored in a built-in memory of the speech decoding device 24*b* such as the ROM into the RAM. The communication device of the speech decoding device 24*b* receives the encoded multiplexed bit stream output from the speech encoding device 11 or the speech encoding device 13, and outputs a decoded speech signal to outside the speech decoding device 24*b*. The example speech decoding device 24*b*, as illustrated in FIG. 15, includes a primary high frequency adjusting unit 2*j*1 and a secondary high frequency adjusting unit 2*j*2 instead of the high frequency adjusting unit 2*j*.

Here, the primary high frequency adjusting unit 2*j*1 adjusts a signal in the QMF domain of the high frequency band by performing linear prediction inverse filtering in the temporal direction, the gain adjustment, and noise addition, described in The "HF generation" step and the "HF adjustment" step in SBR in "MPEG4 AAC". At this time, the output signal of the primary high frequency adjusting unit 2*j*1 corresponds to a signal $W_2$ in the description in "SBR tool" in "ISO/IEC 14496-3:2005", clauses 4.6.18.7.6 of "Assembling HF signals". The linear prediction filter unit 2*k* (or the linear prediction filter unit 2*k*1) and the temporal envelope shaping unit 2*v* shape the temporal envelope of the output signal from the primary high frequency adjusting unit. The secondary high frequency adjusting unit 2*j*2 performs an addition process of sinusoid in the "HF adjustment" step in SBR in "MPEG4 AAC". The process of the secondary high frequency adjusting unit corresponds to a process of generating a signal Y from the signal $W_2$ in the description in "SBR tool" in "ISO/IEC 14496-3:2005", clauses 4.6.18.7.6 of "Assembling HF signals", in which the signal $W_2$ is replaced with an output signal of the temporal envelope shaping unit 2*v*.

In the above description, only the process for adding sinusoid is performed by the secondary high frequency adjusting unit 2*j*2. However, any one of the processes in the "HF adjustment" step may be performed by the secondary high frequency adjusting unit 2*j*2. Similar modifications may also be made to the first embodiment, the second embodiment, and the third embodiment. In these cases, the linear prediction filter unit (linear prediction filter units 2*k* and 2*k*1) is included in the first embodiment and the second embodiment, but the temporal envelope shaping unit is not included. Accordingly, an output signal from the primary high frequency adjusting unit 2*j*1 is processed by the linear prediction filter unit, and then an output signal from the linear prediction filter unit is processed by the secondary high frequency adjusting unit 2*j*2.

In the third embodiment, the temporal envelope shaping unit 2*v* is included but the linear prediction filter unit is not included. Accordingly, an output signal from the primary high frequency adjusting unit 2*j*1 is processed by the temporal envelope shaping unit 2*v*, and then an output signal from the temporal envelope shaping unit 2*v* is processed by the secondary high frequency adjusting unit.

In the speech decoding device (speech decoding device 24, 24*a*, or 24*b*) of the fourth embodiment, the processing order of the linear prediction filter unit 2*k* and the temporal envelope shaping unit 2*v* may be reversed. In other words, an output signal from the high frequency adjusting unit 2*j* or the primary high frequency adjusting unit 2*j*1 may be processed first by the temporal envelope shaping unit 2*v*, and then an output signal from the temporal envelope shaping unit 2*v* may be processed by the linear prediction filter unit 2*k*.

In addition, only if the temporal envelope supplementary information includes binary control information for indicating whether the process is performed by the linear prediction filter unit 2*k* or the temporal envelope shaping unit 2*v*, and the control information indicates to perform the process by the linear prediction filter unit 2*k* or the temporal envelope shaping unit 2*v*, the temporal envelope supplementary information may employ a form that further includes at least one of the filer strength parameter K(r), the envelope shape parameter s(i), or X(r) that is a parameter for determining both K(r) and s(i) as information.

Modification 3 of Fourth Embodiment

Figure 16:
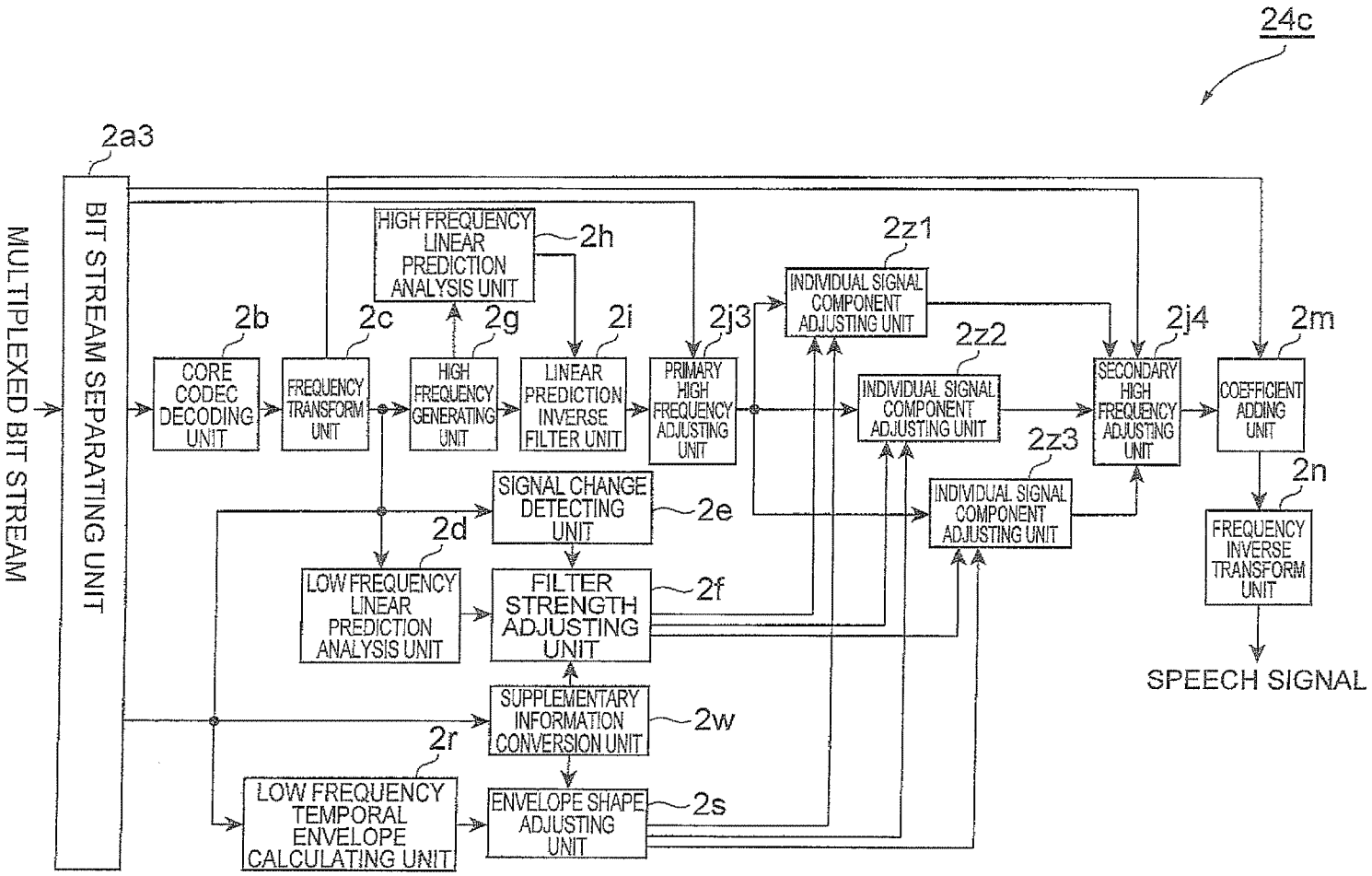
FIG. 16 is a diagram illustrating an example of a speech decoding device according to another modification of the fourth embodiment.
Figure 17:
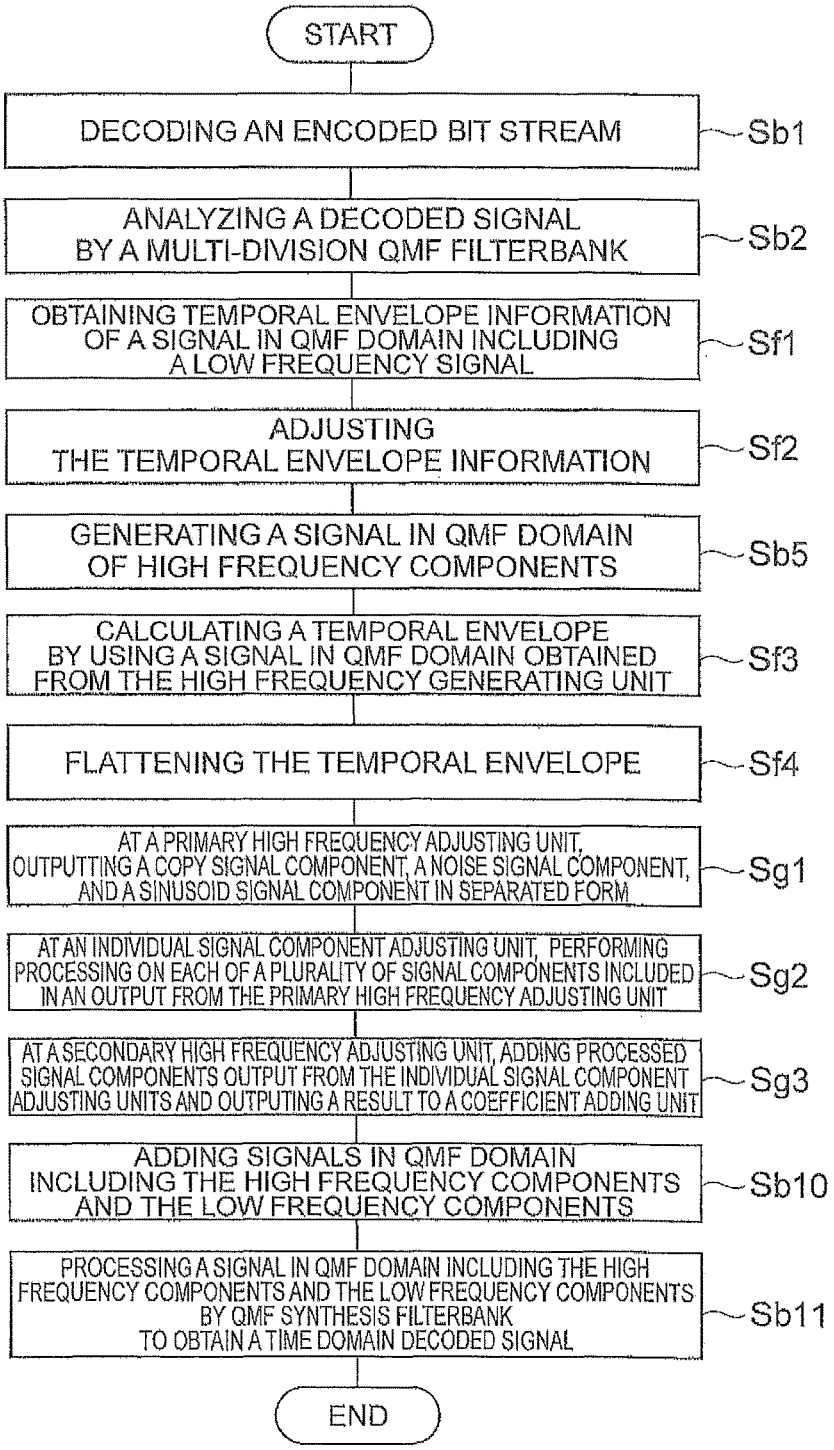
FIG. 17 is a flowchart to describe an example operation of the speech decoding device according to the modification of the fourth embodiment illustrated in FIG. 16.

A speech decoding device 24*c* (see FIG. 16) of a modification 3 of the fourth embodiment physically includes a CPU, a ROM, a RAM, a communication device, and the like, which are not illustrated, and the CPU integrally controls the speech decoding device 24*c* by loading and executing a predetermined computer program (such as a computer program for performing processes illustrated in the flowchart of FIG. 17) stored in a built-in memory of the speech decoding device 24*c* such as the ROM into the RAM. The communication device of the speech decoding device 24*c* receives the encoded multiplexed bit stream and outputs a decoded speech signal to outside the speech decoding device 24*c*. As illustrated in FIG. 16, the example speech decoding device 24*c* includes a primary high frequency adjusting unit 2*j*3 and a secondary high frequency adjusting unit 2*j*4 instead of the high frequency adjusting unit 2*j*, and also includes individual signal component adjusting units 2*z*1, 2*z*2, and 2*z*3 instead of the linear prediction filter unit 2*k* and the temporal envelope shaping unit 2*v* (individual signal component adjusting units correspond to the temporal envelope shaping unit).

The primary high frequency adjusting unit 2*j*3 outputs a signal in the QMF domain of the high frequency band as a copy signal component. The primary high frequency adjusting unit 2*j*3 may output a signal on which at least one of the linear prediction inverse filtering in the temporal direction and the gain adjustment (frequency characteristics adjustment) is performed on the signal in the QMF domain of the high frequency band, by using the SBR supplementary information received from the bit stream separating unit 2*a*3, as a copy signal component. The primary high frequency adjusting unit 2*j*3 also generates a noise signal component and a sinusoid signal component by using the SBR supplementary information supplied from the bit stream separating unit 2*a*3, and outputs each of the copy signal component, the noise signal component, and the sinusoid signal component separately (process at Step Sg1). The noise signal component and the sinusoid signal component may not be generated, depending on the contents of the SBR supplementary information.

The individual signal component adjusting units 2*z*1, 2*z*2, and 2*z*3 perform processing on each of the plurality of signal components included in the output from the primary high frequency adjusting unit (process at Step Sg2). The process with the individual signal component adjusting units 2*z*1, 2*z*2, and 2*z*3 may be linear prediction synthesis filtering in the frequency direction obtained from the filter strength adjusting unit 2*f* by using the linear prediction coefficients, similar to that of the linear prediction filter unit 2*k* (process 1). The process with the individual signal component adjusting units 2*z*1, 2*z*2, and 2*z*3 may also be a process of multiplying each QMF subband sample by a gain coefficient by using the temporal envelope obtained from the envelope shape adjusting unit 2*s*, similar to that of the temporal envelope shaping unit 2*v* (process 2). The process with the individual signal component adjusting units 2*z*1, 2*z*2, and 2*z*3 may also be a process of performing linear prediction synthesis filtering in the frequency direction on the input signal by using the linear prediction coefficients obtained from the filter strength adjusting unit 2*f* similar to that of the linear prediction filter unit 2*k*, and then multiplying each QMF subband sample by a gain coefficient by using the temporal envelope obtained from the envelope shape adjusting unit 2*s*, similar to that of the temporal envelope shaping unit 2*v* (process 3). The process with the individual signal component adjusting units 2*z*1, 2*z*2, and 2*z*3 may also be a process of multiplying each QMF subband sample with respect to the input signal by a gain coefficient by using the temporal envelope obtained from the envelope shape adjusting unit 2*s*, similar to that of the temporal envelope shaping unit 2*v*, and then performing linear prediction synthesis filtering in the frequency direction on the output signal by using the linear prediction coefficient obtained from the filter strength adjusting unit 2*f*, similar to that of the linear prediction filter unit 2*k* (process 4). The individual signal component adjusting units 2*z*1, 2*z*2, and 2*z*3 may not perform the temporal envelope shaping process on the input signal, but may output the input signal as it is (process 5). The process with the individual signal component adjusting units 2*z*1, 2*z*2, and 2*z*3 may include any process for shaping the temporal envelope of the input signal by using a method other than the processes 1 to 5 (process 6). The process with the individual signal component adjusting units 2*z*1, 2*z*2, and 2*z*3 may also be a process in which a plurality of processes among the processes 1 to 6 are combined in an arbitrary order (process 7).

The processes with the individual signal component adjusting units 2*z*1, 2*z*2, and 2*z*3 may be the same, but the individual signal component adjusting units 2*z*1, 2*z*2, and 2*z*3 may shape the temporal envelope of each of the plurality of signal components included in the output of the primary high frequency adjusting unit by different methods. For example, different processes may be performed on the copy signal, the noise signal, and the sinusoid signal, in such a manner that the individual signal component adjusting unit 2*z*1 performs the process 2 on the supplied copy signal, the individual signal component adjusting unit 2*z*2 performs the process 3 on the supplied noise signal component, and the individual signal component adjusting unit 2*z*3 performs the process 5 on the supplied sinusoid signal. In this case, the filter strength adjusting unit 2*f* and the envelope shape adjusting unit 2*s* may transmit the same linear prediction coefficient and the temporal envelope to the individual signal component adjusting units 2*z*1, 2*z*2, and 2*z*3, but may also transmit different linear prediction coefficients and the temporal envelopes. It is also possible to transmit the same linear prediction coefficient and the temporal envelope to at least two of the individual signal component adjusting units 2*z*1, 2*z*2, and 2*z*3. Because at least one of the individual signal component adjusting units 2*z*1, 2*z*2, and 2*z*3 may not perform the temporal envelope shaping process but output the input signal as it is (process 5), the individual signal component adjusting units 2*z*1, 2*z*2, and 2*z*3 perform the temporal envelope process on at least one of the plurality of signal components output from the primary high frequency adjusting unit 2*j*3 as a whole (if all the individual signal component adjusting units 2*z*1, 2*z*2, and 2*z*3 perform the process 5, the temporal envelope shaping process is not performed on any of the signal components, and the effects of the present invention are not exhibited).

The processes performed by each of the individual signal component adjusting units 2*z*1, 2*z*2, and 2*z*3 may be fixed to one of the process 1 to the process 7, but may be dynamically determined to perform one of the process 1 to the process 7 based on the control information received from outside the speech decoding device. At this time, it is preferable that the control information be included in the multiplexed bit stream. The control information may be an instruction to perform any one of the process 1 to the process 7 in a specific SBR envelope time segment, the encoded frame, or in the other time segment, or may be an instruction to perform any one of the process 1 to the process 7 without specifying the time segment of control.

The secondary high frequency adjusting unit 2*j*4 adds the processed signal components output from the individual signal component adjusting units 2*z*1, 2*z*2, and 2*z*3, and outputs the result to the coefficient adding unit (process at Step Sg3). The secondary high frequency adjusting unit 2*j*4 may perform at least one of the linear prediction inverse filtering in the temporal direction and gain adjustment (frequency characteristics adjustment) on the copy signal component, by using the SBR supplementary information received from the bit stream separating unit 2*a*3.

The individual signal component adjusting units 2*z*1, 2*z*2, and 2*z*3 may operate in cooperation with one another, and generate an output signal at an intermediate stage by adding at least two signal components on which any one of the processes 1 to 7 is performed, and further performing any one of the processes 1 to 7 on the added signal. At this time, the secondary high frequency adjusting unit 2*j*4 adds the output signal at the intermediate stage and a signal component that has not yet been added to the output signal at the intermediate stage, and outputs the result to the coefficient adding unit. More specifically, it is preferable to generate an output signal at the intermediate stage by performing the process 5 on the copy signal component, applying the process 1 on the noise component, adding the two signal components, and further applying the process 2 on the added signal. At this time, the secondary high frequency adjusting unit 2*j*4 adds the sinusoid signal component to the output signal at the intermediate stage, and outputs the result to the coefficient adding unit.

The primary high frequency adjusting unit 2*j*3 may output any one of a plurality of signal components in a form separated from each other in addition to the three signal components of the copy signal component, the noise signal component, and the sinusoid signal component. In this case, the signal component may be obtained by adding at least two of the copy signal component, the noise signal component, and the sinusoid signal component. The signal component may also be a signal obtained by dividing the band of one of the copy signal component, the noise signal component, and the sinusoid signal. The number of signal components may be other than three, and in this case, the number of the individual signal component adjusting units may be other than three.

The high frequency signal generated by SBR consists of three elements of the copy signal component obtained by copying from the low frequency band to the high frequency band, the noise signal, and the sinusoid signal. Because the copy signal, the noise signal, and the sinusoid signal have the temporal envelopes different from one another, if the temporal envelope of each of the signal components is shaped by using different methods as the individual signal component adjusting units of the present modification, it is possible to further improve the subjective quality of the decoded signal compared with the other embodiments of the present invention. In particular, because the noise signal generally has a smooth temporal envelope, and the copy signal has a temporal envelope close to that of the signal in the low frequency band, the temporal envelopes of the copy signal and the noise signal can be independently controlled, by handling them separately and applying different processes thereto. Accordingly, it is effective in improving the subject quality of the decoded signal. More specifically, it is preferable to perform a process of shaping the temporal envelope on the noise signal (process 3 or process 4), perform a process different from that for the noise signal on the copy signal (process 1 or process 2), and perform the process 5 on the sinusoid signal (in other words, the temporal envelope shaping process is not performed). It is also preferable to perform a shaping process (process 3 or process 4) of the temporal envelope on the noise signal, and perform the process 5 on the copy signal and the sinusoid signal (in other words, the temporal envelope shaping process is not performed).

Modification 4 of First Embodiment

Figure 44:
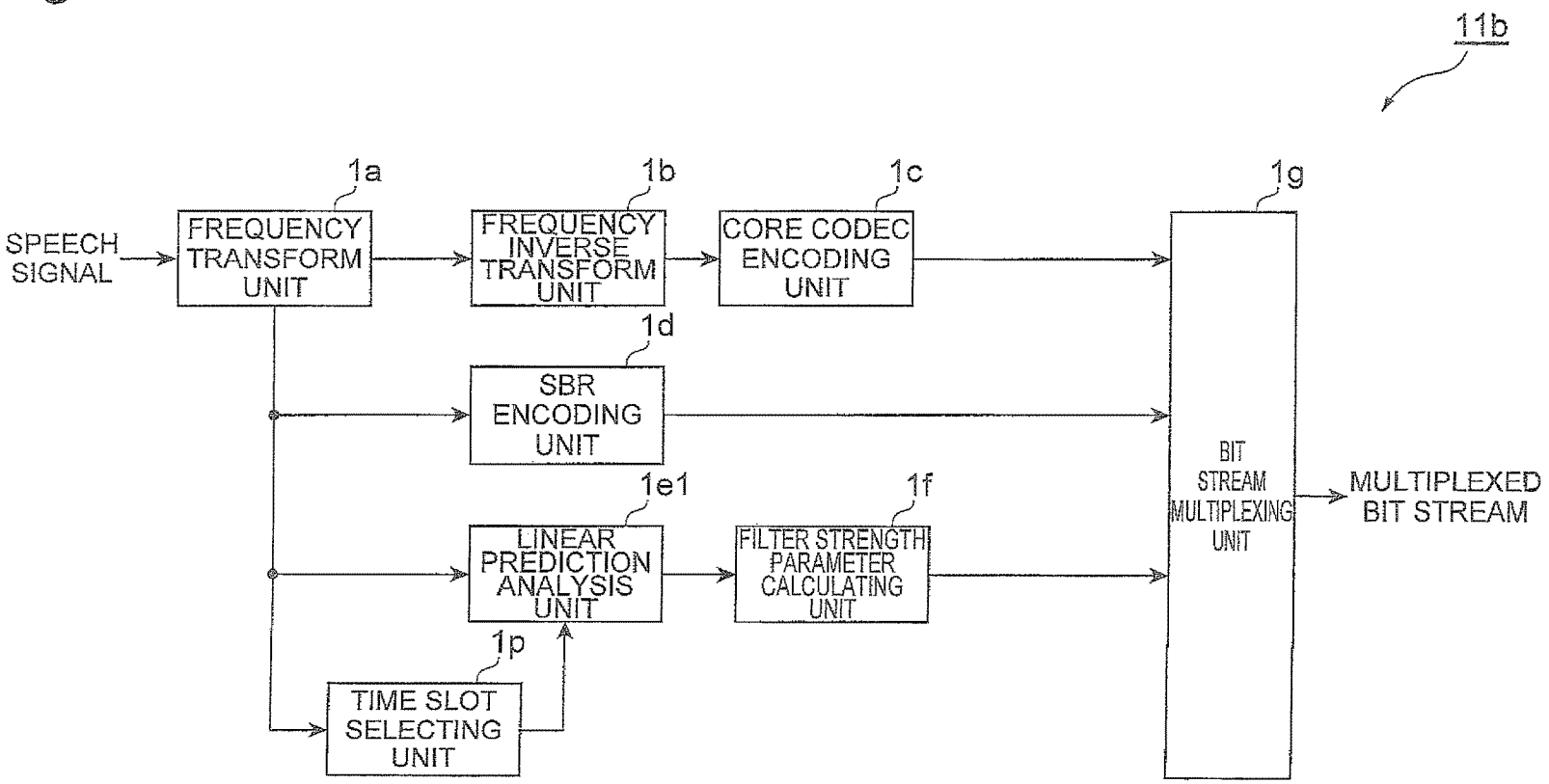
FIG. 44 is a diagram illustrating an example of a speech encoding device according to another modification of the first embodiment.

A speech encoding device 11*b* (FIG. 44) of a modification 4 of the first embodiment physically includes a CPU, a ROM, a RAM, a communication device, and the like, which are not illustrated, and the CPU integrally controls the speech encoding device 11*b* by loading and executing a predetermined computer program stored in a built-in memory of the speech encoding device 11*b* such as the ROM into the RAM. The communication device of the speech encoding device 11*b* receives a speech signal to be encoded from outside the speech encoding device 11*b*, and outputs an encoded multiplexed bit stream to the outside. The speech encoding device 11*b* includes a linear prediction analysis unit 1*e*1 instead of the linear prediction analysis unit 1*e* of the speech encoding device 11, and further includes a time slot selecting unit 1*p*.

The time slot selecting unit 1*p* receives a signal in the QMF domain from the frequency transform unit 1*a* and selects a time slot at which the linear prediction analysis by the linear prediction analysis unit 1*e*1 is performed. The linear prediction analysis unit 1*e*1 performs linear prediction analysis on the QMF domain signal in the selected time slot as the linear prediction analysis unit 1*e*, based on the selection result transmitted from the time slot selecting unit 1*p*, to obtain at least one of the high frequency linear prediction coefficients and the low frequency linear prediction coefficients. The filter strength parameter calculating unit if calculates a filter strength parameter by using linear prediction coefficients of the time slot selected by the time slot selecting unit 1*p*, obtained by the linear prediction analysis unit 1*e*1. To select a time slot by the time slot selecting unit 1*p*, for example, at least one selection methods using the signal power of the QMF domain signal of the high frequency components, similar to that of a time slot selecting unit 3*a* in a decoding device 21*a* of the present modification, which will be described later, may be used. At this time, it is preferable that the QMF domain signal of the high frequency components in the time slot selecting unit 1*p* be a frequency component encoded by the SBR encoding unit 1*d*, among the signals in the QMF domain received from the frequency transform unit 1*a*. The time slot selecting method may be at least one of the methods described above, may include at least one method different from those described above, or may be the combination thereof.

Figure 18:
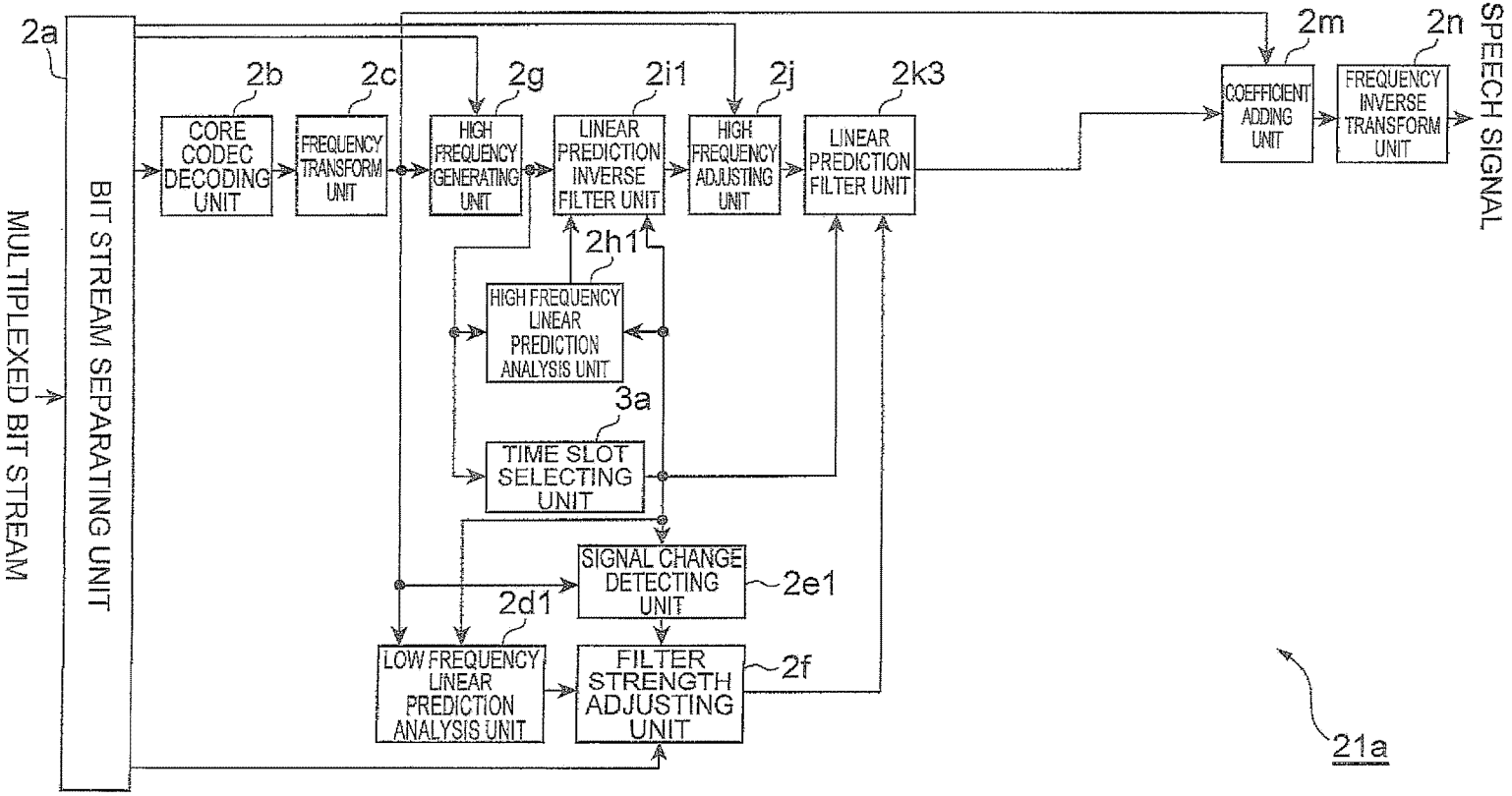
FIG. 18 is a diagram illustrating an example of a speech decoding device according to another modification of the first embodiment.
Figure 19:
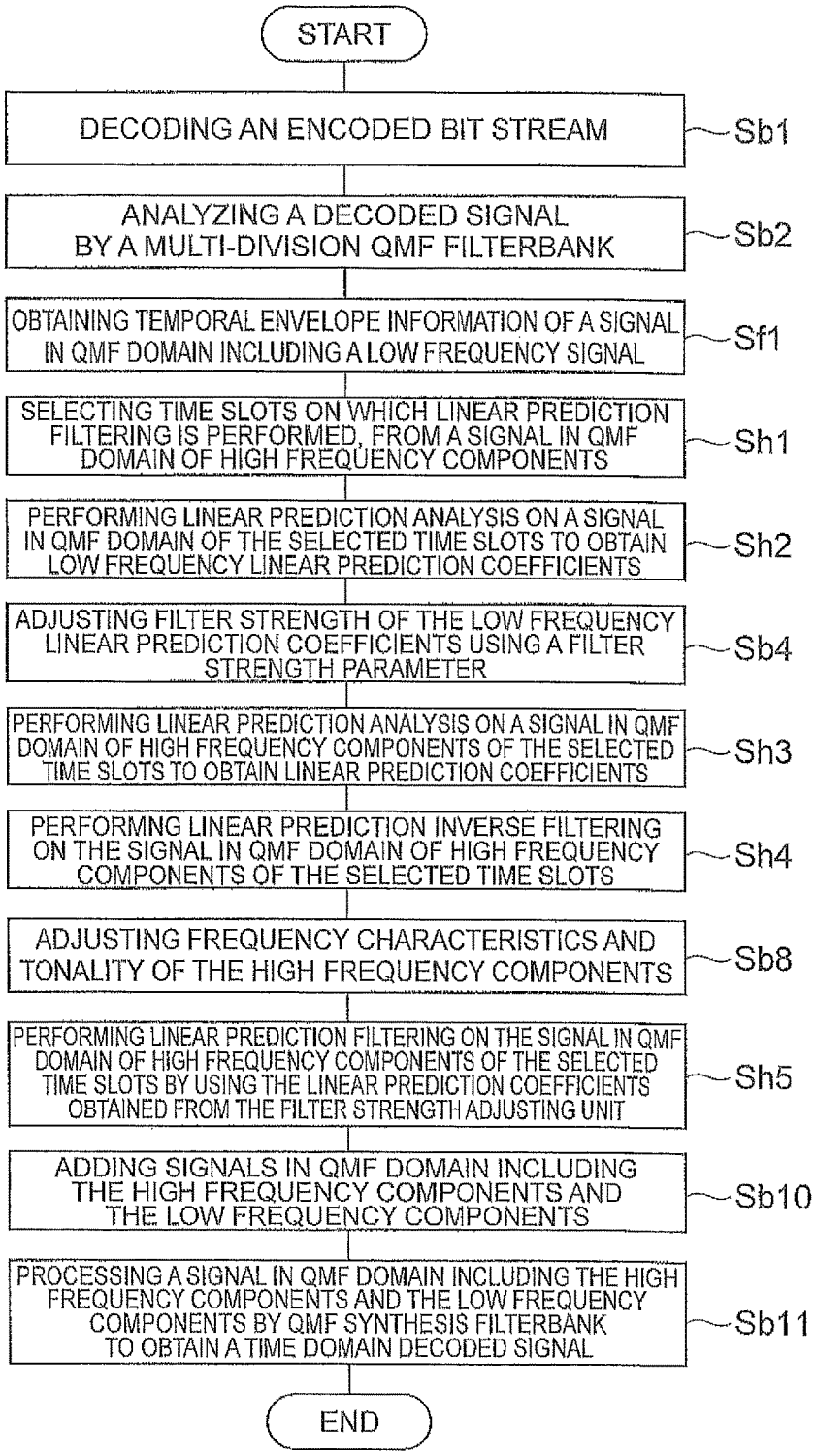
FIG. 19 is a flowchart to describe an example operation of the speech decoding device according to the modification of the first embodiment illustrated in FIG. 18.

A speech decoding device 21*a* (see FIG. 18) of the modification 4 of the first embodiment physically includes a CPU, a ROM, a RAM, a communication device, and the like, which are not illustrated, and the CPU integrally controls the speech decoding device 21*a* by loading and executing a predetermined computer program (such as a computer program for performing processes illustrated in the example flowchart of FIG. 19) stored in a built-in memory of the speech decoding device 21*a* such as the ROM into the RAM. The communication device of the speech decoding device 21*a* receives the encoded multiplexed bit stream and outputs a decoded speech signal to outside the speech decoding device 21*a*. The speech decoding device 21*a*, as illustrated in FIG. 18, includes a low frequency linear prediction analysis unit 2*d*1, a signal change detecting unit 2*e*1, a high frequency linear prediction analysis unit 2*h*1, a linear prediction inverse filter unit 2*i*1, and a linear prediction filter unit 2*k*3 instead of the low frequency linear prediction analysis unit 2*d*, the signal change detecting unit 2*e*, the high frequency linear prediction analysis unit 2*h*, the linear prediction inverse filter unit 2*i*, and the linear prediction filter unit 2*k* of the speech decoding device 21, and further includes the time slot selecting unit 3*a*.

The time slot selecting unit 3*a* determines whether linear prediction synthesis filtering in the linear prediction filter unit 2*k* is to be performed on the signal $q_{exp}$ (k, r) in the QMF domain of the high frequency components of the time slot r generated by the high frequency generating unit 2*g*, and selects a time slot at which the linear prediction synthesis filtering is performed (process at Step Sh1). The time slot selecting unit 3*a* notifies, of the selection result of the time slot, the low frequency linear prediction analysis unit 2*d*1, the signal change detecting unit 2*e*1, the high frequency linear prediction analysis unit 2*h*1, the linear prediction inverse filter unit 2*i*1, and the linear prediction filter unit 2*k*3. The low frequency linear prediction analysis unit 2*d*1 performs linear prediction analysis on the QMF domain signal in the selected time slot r1, in the same manner as the low frequency linear prediction analysis unit 2*d*, based on the selection result transmitted from the time slot selecting unit 3*a*, to obtain low frequency linear prediction coefficients (process at Step Sh2). The signal change detecting unit 2*e*1 detects the temporal variation in the QMF domain signal in the selected time slot, as the signal change detecting unit 2*e*, based on the selection result transmitted from the time slot selecting unit 3*a*, and outputs a detection result T(r1).

The filter strength adjusting unit 2*f* performs filter strength adjustment on the low frequency linear prediction coefficients of the time slot selected by the time slot selecting unit 3*a* obtained by the low frequency linear prediction analysis unit 2*d*1, to obtain an adjusted linear prediction coefficients $a_{dec}$ (n, r1). The high frequency linear prediction analysis unit 2*h*1 performs linear prediction analysis in the frequency direction on the QMF domain signal of the high frequency components generated by the high frequency generating unit 2*g* for the selected time slot r1, based on the selection result transmitted from the time slot selecting unit 3*a*, as the high frequency linear prediction analysis unit 2*h*, to obtain a high frequency linear prediction coefficients $a_{exp}$ (n, r1) (process at Step Sh3). The linear prediction inverse filter unit 2*i*1 performs linear prediction inverse filtering, in which $a_{exp}$ (n, r1) are coefficients, in the frequency direction on the signal $q_{exp}$ (k, r) in the QMF domain of the high frequency components of the selected time slot r1, as the linear prediction inverse filter unit 2*i*, based on the selection result transmitted from the time slot selecting unit 3*a* (process at Step Sh4).

The linear prediction filter unit 2*k*3 performs linear prediction synthesis filtering in the frequency direction on a signal $q_{adj}$(k, r1) in the QMF domain of the high frequency components output from the high frequency adjusting unit 2*j* in the selected time slot r1 by using $a_{adj}$ (n, r1) obtained from the filter strength adjusting unit 2*f*, as the linear prediction filter unit 2*k*, based on the selection result transmitted from the time slot selecting unit 3*a* (process at Step Sh5). The changes made to the linear prediction filter unit 2*k* described in the modification 3 may also be made to the linear prediction filter unit 2*k*3. To select a time slot at which the linear prediction synthesis filtering is performed, for example, the time slot selecting unit 3*a* may select at least one time slot r in which the signal power of the QMF domain signal $q_{exp}$ (k, r) of the high frequency components is greater than a predetermined value $P_{exp,Th}$. It is preferable to calculate the signal power of $q_{exp}(k,r)$ according to the following expression.

$$P_{exp}(r) = \sum_{k=k_x}^{k_x+M-1} |q_{exp}(k, r)|^2 \tag{42}$$

where M is a value representing a frequency range higher than a lower limit frequency $k_x$ of the high frequency components generated by the high frequency generating unit 2g, and the frequency range of the high frequency components generated by the high frequency generating unit 2g may be represented as $k_x \le k < k_x + M$. The predetermined value $P_{exp,Th}$ may also be an average value of $P_{exp}(r)$ of a predetermined time width including the time slot r. The predetermined time width may also be the SBR envelope.

The selection may also be made so as to include a time slot at which the signal power of the QMF domain signal of the high frequency components reaches its peak. The peak signal power may be calculated, for example, by using a moving average value:

$$P_{exp,MA}(r) \tag{43}$$

of the signal power, and the peak signal power may be the signal power in the QMF domain of the high frequency components of the time slot r at which the result of:

$$P_{exp,MA}(r+1) - P_{exp,MA}(r) \tag{44}$$

changes from the positive value to the negative value. The moving average value of the signal power, $$P_{exp,MA}(r) \tag{45}$$

for example, may be calculated by the following expression.

$$P_{exp,MA}(r) = \frac{1}{c} \sum_{r'=r-\frac{c}{2}}^{r+\frac{c}{2}-1} P_{exp}(r') \tag{46}$$

where c is a predetermined value for defining a range for calculating the average value. The peak signal power may be calculated by the method described above, or may be calculated by a different method.

At least one time slot may be selected from time slots included in a time width t during which the QMF domain signal of the high frequency components transits from a steady state with a small variation of its signal power a transient state with a large variation of its signal power, and that is smaller than a predetermined value $t_{th}$. At least one time slot may also be selected from time slots included in a time width t during which the signal power of the QMF domain signal of the high frequency components is changed from a transient state with a large variation to a steady state with a small variation, and that are larger than the predetermined value $t_{th}$. The time slot r in which $|P_{exp}(r+1) - P_{exp}(r)|$ is smaller than a predetermined value (or equal to or smaller than a predetermined value) may be the steady state, and the time slot r in which $|P_{exp}(r+1) - P_{exp}(r)|$ is equal to or larger than a predetermined value (or larger than a predetermined value) may be the transient state. The time slot r in which $|P_{exp,MA}(r+1) - P_{exp,MA}(r)|$ is smaller than a predetermined value (or equal to or smaller than a predetermined value) may be the steady state, and the time slot r in which $|P_{exp,MA}(r+1) - P_{exp,MA}(r)|$ is equal to or larger than a predetermined value (or larger than a predetermined value) may be the transient state. The transient state and the steady state may be defined using the method described above, or may be defined using different methods. The time slot selecting method may be at least one of the methods described above, may include at least one method different from those described above, or may be the combination thereof.

Modification 5 of First Embodiment

Figure 45:
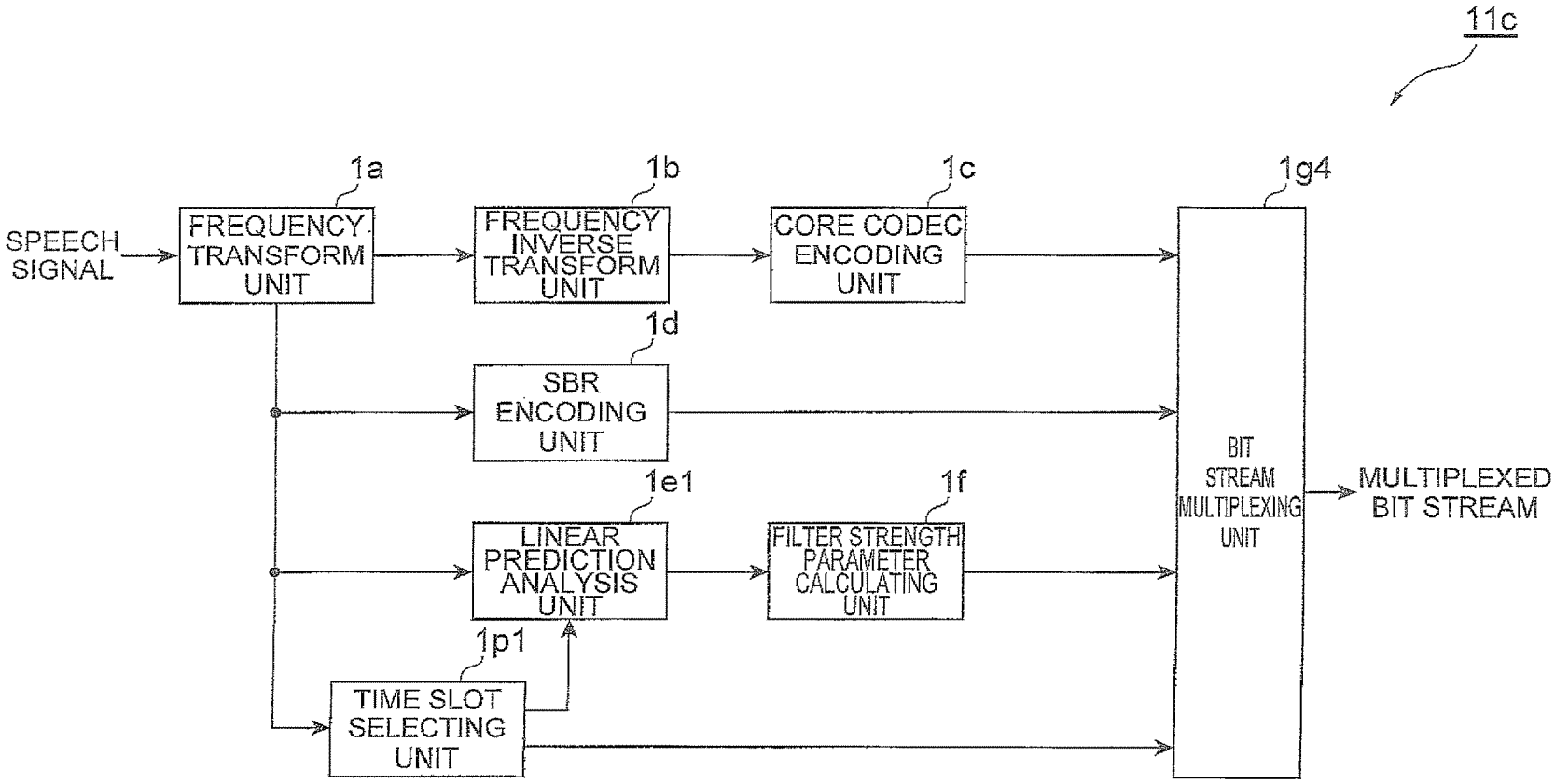
FIG. 45 is a diagram illustrating an example of a speech encoding device according to still another modification of the first embodiment.

A speech encoding device 11c (FIG. 45) of a modification 5 of the first embodiment physically includes a CPU, a ROM, a RAM, a communication device, and the like, which are not illustrated, and the CPU integrally controls the speech encoding device 11c by loading and executing a predetermined computer program stored in a built-in memory of the speech encoding device 11c such as the ROM into the RAM. The communication device of the speech encoding device 11c receives a speech signal to be encoded from outside the speech encoding device 11c, and outputs an encoded multiplexed bit stream to the outside. The speech encoding device 11c includes a time slot selecting unit 1p1 and a bit stream multiplexing unit 1g4, instead of the time slot selecting unit 1p and the bit stream multiplexing unit 1g of the speech encoding device 11b of the modification 4.

The time slot selecting unit 1p1 selects a time slot as the time slot selecting unit 1p described in the modification 4 of the first embodiment, and transmits time slot selection information to the bit stream multiplexing unit 1g4. The bit stream multiplexing unit 1g4 multiplexes the encoded bit stream calculated by the core codec encoding unit 1c, the SBR supplementary information calculated by the SBR encoding unit 1d, and the filter strength parameter calculated by the filter strength parameter calculating unit if as the bit stream multiplexing unit 1g, also multiplexes the time slot selection information received from the time slot selecting unit 1p1, and outputs the multiplexed bit stream through the communication device of the speech encoding device 11c. The time slot selection information is time slot selection information received by a time slot selecting unit 3a1 in a speech decoding device 21b, which will be describe later, and for example, an index r1 of a time slot to be selected may be included. The time slot selection information may also be a parameter used in the time slot selecting method of the time slot selecting unit 3a1. The speech decoding device 21b (see FIG. 20) of the modification 5 of the first embodiment physically includes a CPU, a ROM, a RAM, a communication device, and the like, which are not illustrated, and the CPU integrally controls the speech decoding device 21b by loading and executing a predetermined computer program (such as a computer program for performing processes illustrated in the example flowchart of FIG. 21) stored in a built-in memory of the speech decoding device 21b such as the ROM into the RAM. The communication device of the speech decoding device 21b receives the encoded multiplexed bit stream and outputs a decoded speech signal to outside the speech decoding device 21b.

Figure 20:
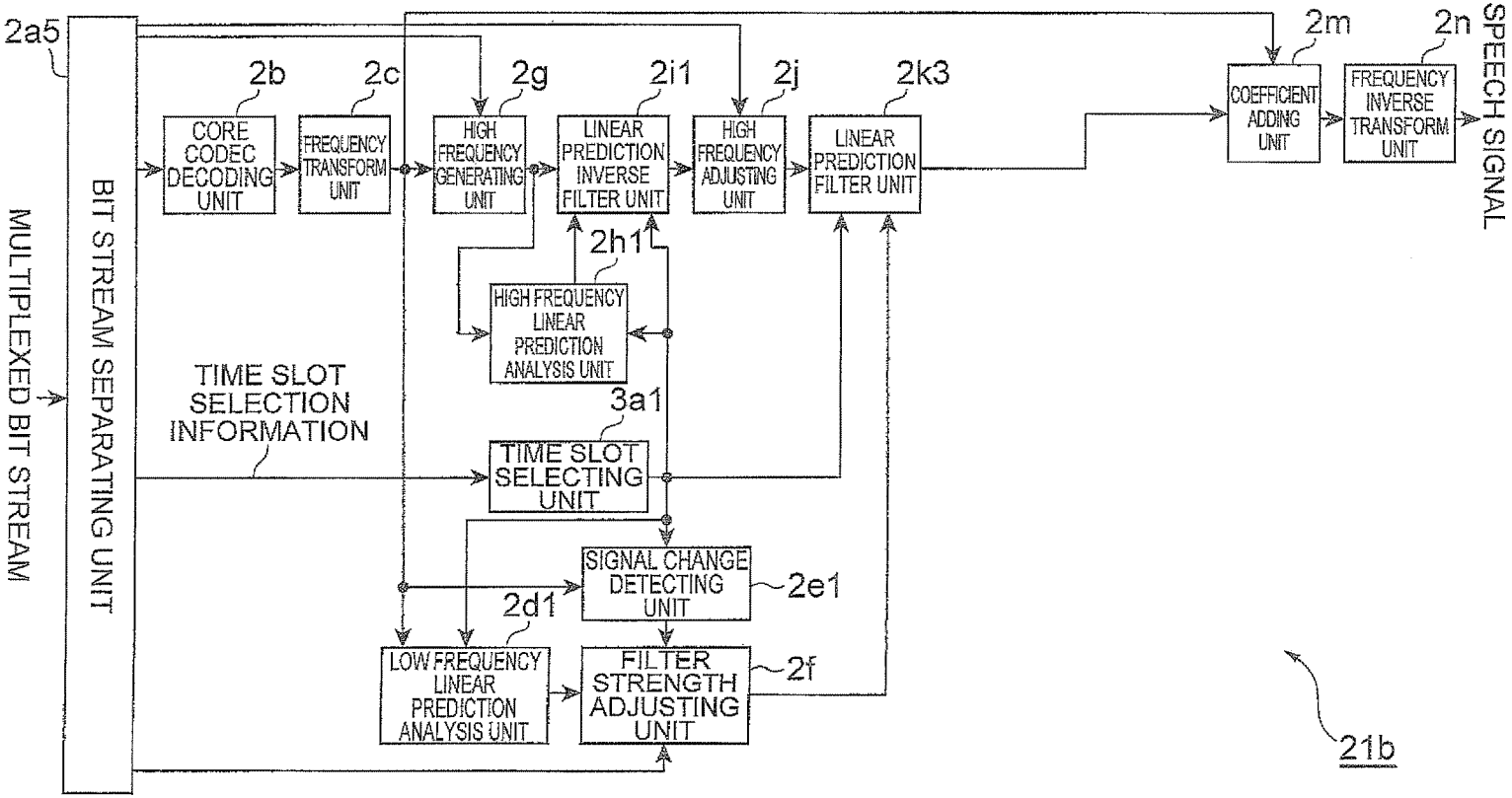
FIG. 20 is a diagram illustrating an example of a speech decoding device according to another modification of the first embodiment.
Figure 21:
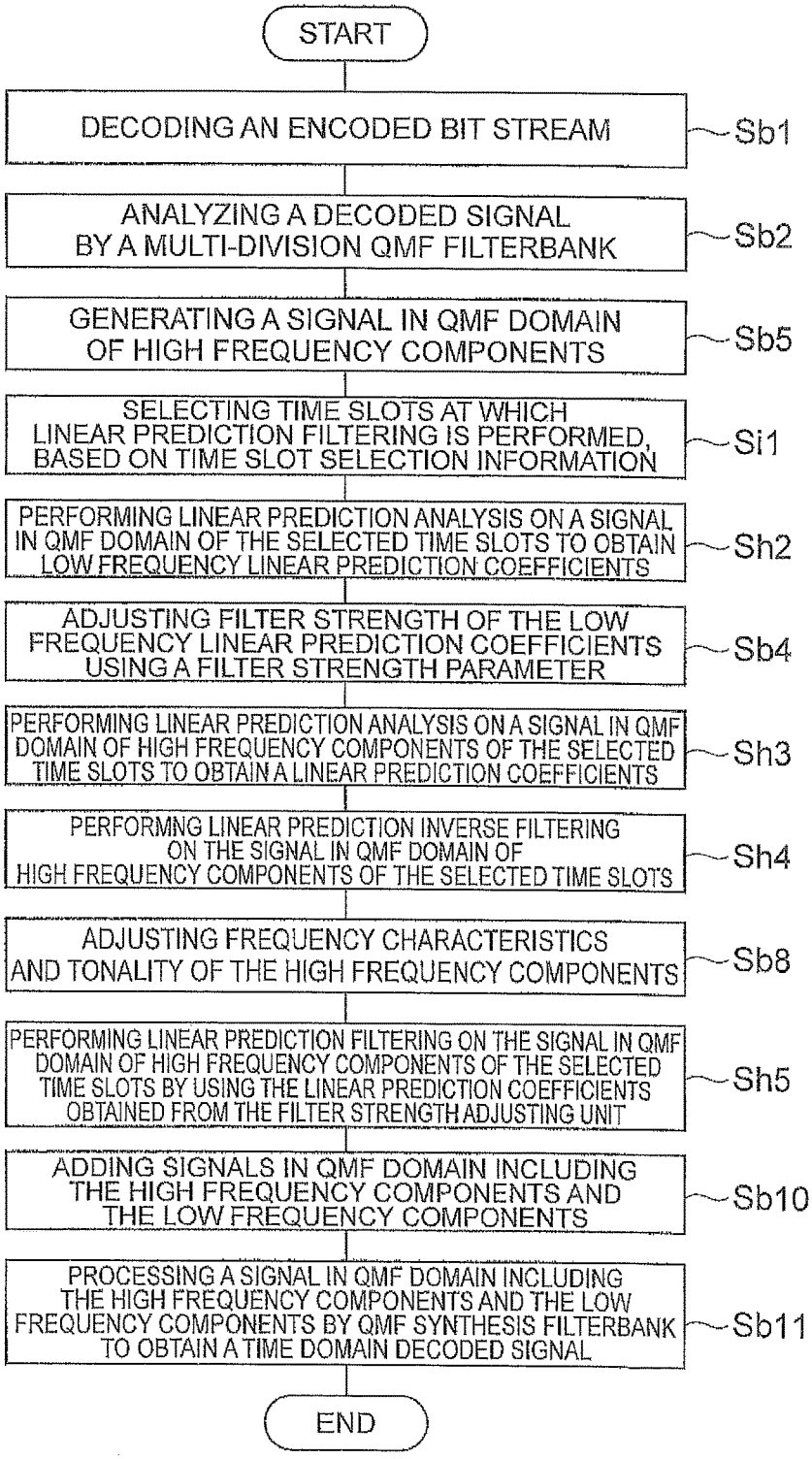
FIG. 21 is a flowchart to describe an example operation of the speech decoding device according to the modification of the first embodiment illustrated in FIG. 20.

The speech decoding device 21b, as illustrated in the example of FIG. 20, includes a bit stream separating unit 2a5 and the time slot selecting unit 3a1 instead of the bit stream separating unit 2a and the time slot selecting unit 3a of the speech decoding device 21a of the modification 4, and time slot selection information is supplied to the time slot selecting unit 3a1. The bit stream separating unit 2a5 separates the multiplexed bit stream into the filter strength parameter, the SBR supplementary information, and the encoded bit stream as the bit stream separating unit 2a, and further separates the time slot selection information. The time slot selecting unit 3*a*1 selects a time slot based on the time slot selection information transmitted from the bit stream separating unit 2*a*5 (process at Step Si1). The time slot selection information is information used for selecting a time slot, and for example, may include the index r1 of the time slot to be selected. The time slot selection information may also be a parameter, for example, used in the time slot selecting method described in the modification 4. In this case, although not illustrated, the QMF domain signal of the high frequency components generated by the high frequency generating unit 2*g* may be supplied to the time slot selecting unit 3*a*1, in addition to the time slot selection information. The parameter may also be a predetermined value (such as $P_{exp,Th}$ and $t_{Th}$) used for selecting the time slot.

Modification 6 of First Embodiment

A speech encoding device 11*d* (not illustrated) of a modification 6 of the first embodiment physically includes a CPU, a ROM, a RAM, a communication device, and the like, which are not illustrated, and the CPU integrally controls the speech encoding device 11*d* by loading and executing a predetermined computer program stored in a built-in memory of the speech encoding device 11*d* such as the ROM into the RAM. The communication device of the speech encoding device 11*d* receives a speech signal to be encoded from outside the speech encoding device 11*d*, and outputs an encoded multiplexed bit stream to the outside. The speech encoding device 11*d* includes a short-term power calculating unit 1*i*1, which is not illustrated, instead of the short-term power calculating unit 1*i* of the speech encoding device 11*a* of the modification 1, and further includes a time slot selecting unit 1*p*2.

The time slot selecting unit 1*p*2 receives a signal in the QMF domain from the frequency transform unit 1*a*, and selects a time slot corresponding to the time segment at which the short-term power calculation process is performed by the short-term power calculating unit 1*i*. The short-term power calculating unit 1*i*1 calculates the short-term power of a time segment corresponding to the selected time slot based on the selection result transmitted from the time slot selecting unit 1*p*2, as the short-term power calculating unit 1*i* of the speech encoding device 11*a* of the modification 1.

Modification 7 of First Embodiment

A speech encoding device 11*e* (not illustrated) of a modification 7 of the first embodiment physically includes a CPU, a ROM, a RAM, a communication device, and the like, which are not illustrated, and the CPU integrally controls the speech encoding device 11*e* by loading and executing a predetermined computer program stored in a built-in memory of the speech encoding device 11*e* such as the ROM into the RAM. The communication device of the speech encoding device 11*e* receives a speech signal to be encoded from outside the speech encoding device 11*e*, and outputs an encoded multiplexed bit stream to the outside. The speech encoding device 11*e* includes a time slot selecting unit 1*p*3, which is not illustrated, instead of the time slot selecting unit 1*p*2 of the speech encoding device 11*d* of the modification 6. The speech encoding device 11*e* also includes a bit stream multiplexing unit that further receives an output from the time slot selecting unit 1*p*3, instead of the bit stream multiplexing unit 1*g*1. The time slot selecting unit 1*p*3 selects a time slot as the time slot selecting unit 1*p*2 described in the modification 6 of the first embodiment, and transmits time slot selection information to the bit stream multiplexing unit.

Modification 8 of First Embodiment

A speech encoding device (not illustrated) of a modification 8 of the first embodiment physically includes a CPU, a ROM, a RAM, a communication device, and the like, which are not illustrated, and the CPU integrally controls the speech encoding device of the modification 8 by loading and executing a predetermined computer program stored in a built-in memory of the speech encoding device of the modification 8 such as the ROM into the RAM. The communication device of the speech encoding device of the modification 8 receives a speech signal to be encoded from outside the speech encoding device, and outputs an encoded multiplexed bit stream to the outside. The speech encoding device of the modification 8 further includes the time slot selecting unit 1*p* in addition to those of the speech encoding device described in the modification 2.

A speech decoding device (not illustrated) of the modification 8 of the first embodiment physically includes a CPU, a ROM, a RAM, a communication device, and the like, which are not illustrated, and the CPU integrally controls the speech decoding device of the modification 8 by loading and executing a predetermined computer program stored in a built-in memory of the speech decoding device of the modification 8 such as the ROM into the RAM. The communication device of the speech decoding device of the modification 8 receives the encoded multiplexed bit stream, and outputs a decoded speech signal to the outside the speech decoding device. The speech decoding device of the modification 8 further includes the low frequency linear prediction analysis unit 2*d*1, the signal change detecting unit 2*e*1, the high frequency linear prediction analysis unit 2*h*1, the linear prediction inverse filter unit 2*i*1, and the linear prediction filter unit 2*k*3, instead of the low frequency linear prediction analysis unit 2*d*, the signal change detecting unit 2*e*, the high frequency linear prediction analysis unit 2*h*, the linear prediction inverse filter unit 2*i*, and the linear prediction filter unit 2*k* of the speech decoding device described in the modification 2, and further includes the time slot selecting unit 3*a*.

Modification 9 of First Embodiment

A speech encoding device (not illustrated) of a modification 9 of the first embodiment physically includes a CPU, a ROM, a RAM, a communication device, and the like, which are not illustrated, and the CPU integrally controls the speech encoding device of the modification 9 by loading and executing a predetermined computer program stored in a built-in memory of the speech encoding device of the modification 9 such as the ROM into the RAM. The communication device of the speech encoding device of the modification 9 receives a speech signal to be encoded from outside the speech encoding device, and outputs an encoded multiplexed bit stream to the outside. The speech encoding device of the modification 9 includes the time slot selecting unit 1*p*1 instead of the time slot selecting unit 1*p* of the speech encoding device described in the modification 8. The speech encoding device of the modification 9 further includes a bit stream multiplexing unit that receives an output from the time slot selecting unit 1*p*1 in addition to the input supplied to the bit stream multiplexing unit described in the modification 8, instead of the bit stream multiplexing unit described in the modification 8.

A speech decoding device (not illustrated) of the modification 9 of the first embodiment physically includes a CPU, a ROM, a RAM, a communication device, and the like, which are not illustrated, and the CPU integrally controls the speech decoding device of the modification 9 by loading and executing a predetermined computer program stored in a built-in memory of the speech decoding device of the modification 9 such as the ROM into the RAM. The communication device of the speech decoding device of the modification 9 receives the encoded multiplexed bit stream, and outputs a decoded speech signal to the outside the speech decoding device. The speech decoding device of the modification 9 includes the time slot selecting unit 3*a*1 instead of the time slot selecting unit 3*a* of the speech decoding device described in the modification 8. The speech decoding device of the modification 9 further includes a bit stream separating unit that separates $a_D$ (n, r) described in the modification 2 instead of the filter strength parameter of the bit stream separating unit 2*a*5, instead of the bit stream separating unit 2*a*.

Modification 1 of Second Embodiment

Figure 46:
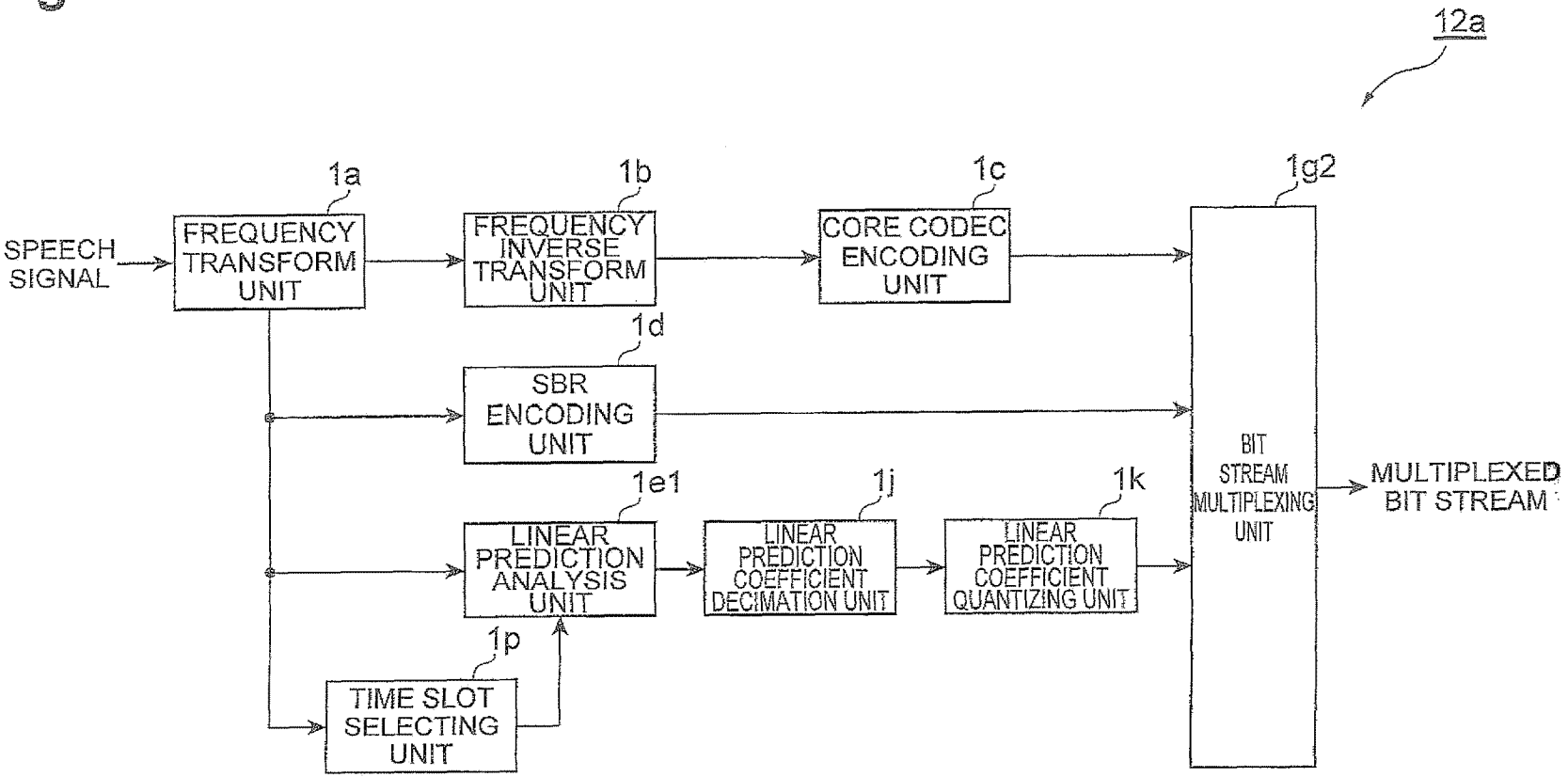
FIG. 46 is a diagram illustrating an example of a speech encoding device according to a modification of the second embodiment.

A speech encoding device 12*a* (FIG. 46) of a modification 1 of the second embodiment physically includes a CPU, a ROM, a RAM, a communication device, and the like, which are not illustrated, and the CPU integrally controls the speech encoding device 12*a* by loading and executing a predetermined computer program stored in a built-in memory of the speech encoding device 12*a* such as the ROM into the RAM. The communication device of the speech encoding device 12*a* receives a speech signal to be encoded from outside the speech encoding device, and outputs an encoded multiplexed bit stream to the outside. The speech encoding device 12*a* includes the linear prediction analysis unit 1*e*1 instead of the linear prediction analysis unit 1*e* of the speech encoding device 12, and further includes the time slot selecting unit 1*p*.

Figure 22:
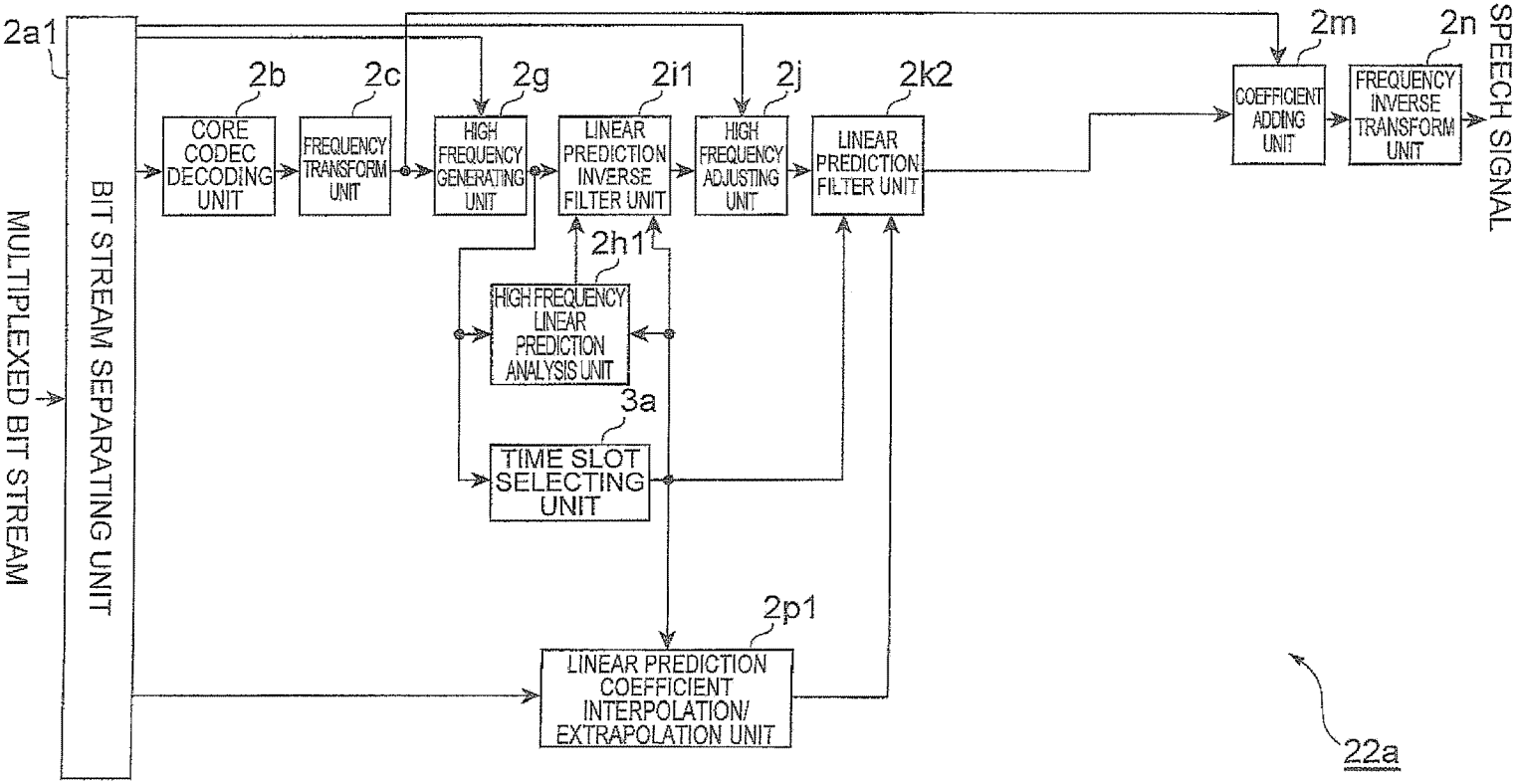
FIG. 22 is a diagram illustrating an example of a speech decoding device according to a modification of the second embodiment.
Figure 23:
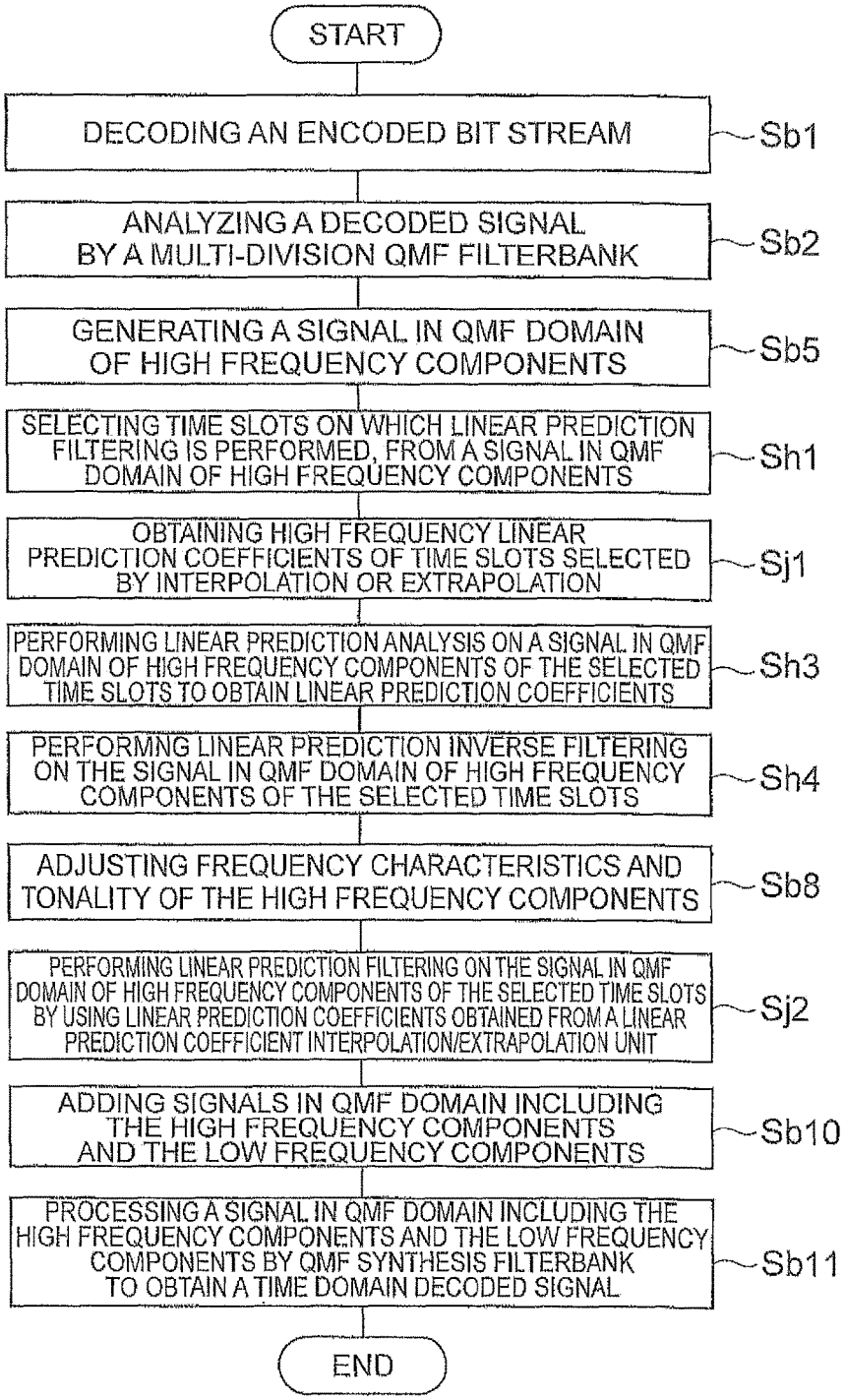
FIG. 23 is a flowchart to describe an operation of the speech decoding device according to the modification of the second embodiment illustrated in FIG. 22.

A speech decoding device 22*a* (see FIG. 22) of the modification 1 of the second embodiment physically includes a CPU, a ROM, a RAM, a communication device, and the like, which are not illustrated, and the CPU integrally controls the speech decoding device 22*a* by loading and executing a predetermined computer program (such as a computer program for performing processes illustrated in the flowchart of FIG. 23) stored in a built-in memory of the speech decoding device 22*a* such as the ROM into the RAM. The communication device of the speech decoding device 22*a* receives the encoded multiplexed bit stream, and outputs a decoded speech signal to the outside of the speech decoding device. The speech decoding device 22*a*, as illustrated in FIG. 22, includes the high frequency linear prediction analysis unit 2*h*1, the linear prediction inverse filter unit 2*i*1, a linear prediction filter unit 2*k*2, and a linear prediction interpolation/extrapolation unit 2*p*1, instead of the high frequency linear prediction analysis unit 2*h*, the linear prediction inverse filter unit 2*i*, the linear prediction filter unit 2*k*1, and the linear prediction interpolation/extrapolation unit 2*p* of the speech decoding device 22 of the second embodiment, and further includes the time slot selecting unit 3*a*.

The time slot selecting unit 3*a* notifies, of the selection result of the time slot, the high frequency linear prediction analysis unit 2*h*1, the linear prediction inverse filter unit 2*i*1, the linear prediction filter unit 2*k*2, and the linear prediction coefficient interpolation/extrapolation unit 2*p*1. The linear prediction coefficient interpolation/extrapolation unit 2*p*1 obtains $a_H$ (n, r) corresponding to the time slot r1 that is the selected time slot and of which linear prediction coefficients are not transmitted by interpolation or extrapolation, as the linear prediction coefficient interpolation/extrapolation unit 2*p*, based on the selection result transmitted from the time slot selecting unit 3*a* (process at Step Sj1). The linear prediction filter unit 2*k*2 performs linear prediction synthesis filtering in the frequency direction on $q_{adj}$ (n, r1) output from the high frequency adjusting unit 2*j* for the selected time slot r1 by using $a_H$ (n, r1) being interpolated or extrapolated and obtained from the linear prediction coefficient interpolation/extrapolation unit 2*p*1, as the linear prediction filter unit 2*k*1 (process at Step Sj2), based on the selection result transmitted from the time slot selecting unit 3*a*. The changes made to the linear prediction filter unit 2*k* described in the modification 3 of the first embodiment may also be made to the linear prediction filter unit 2*k*2.

Modification 2 of Second Embodiment

Figure 47:
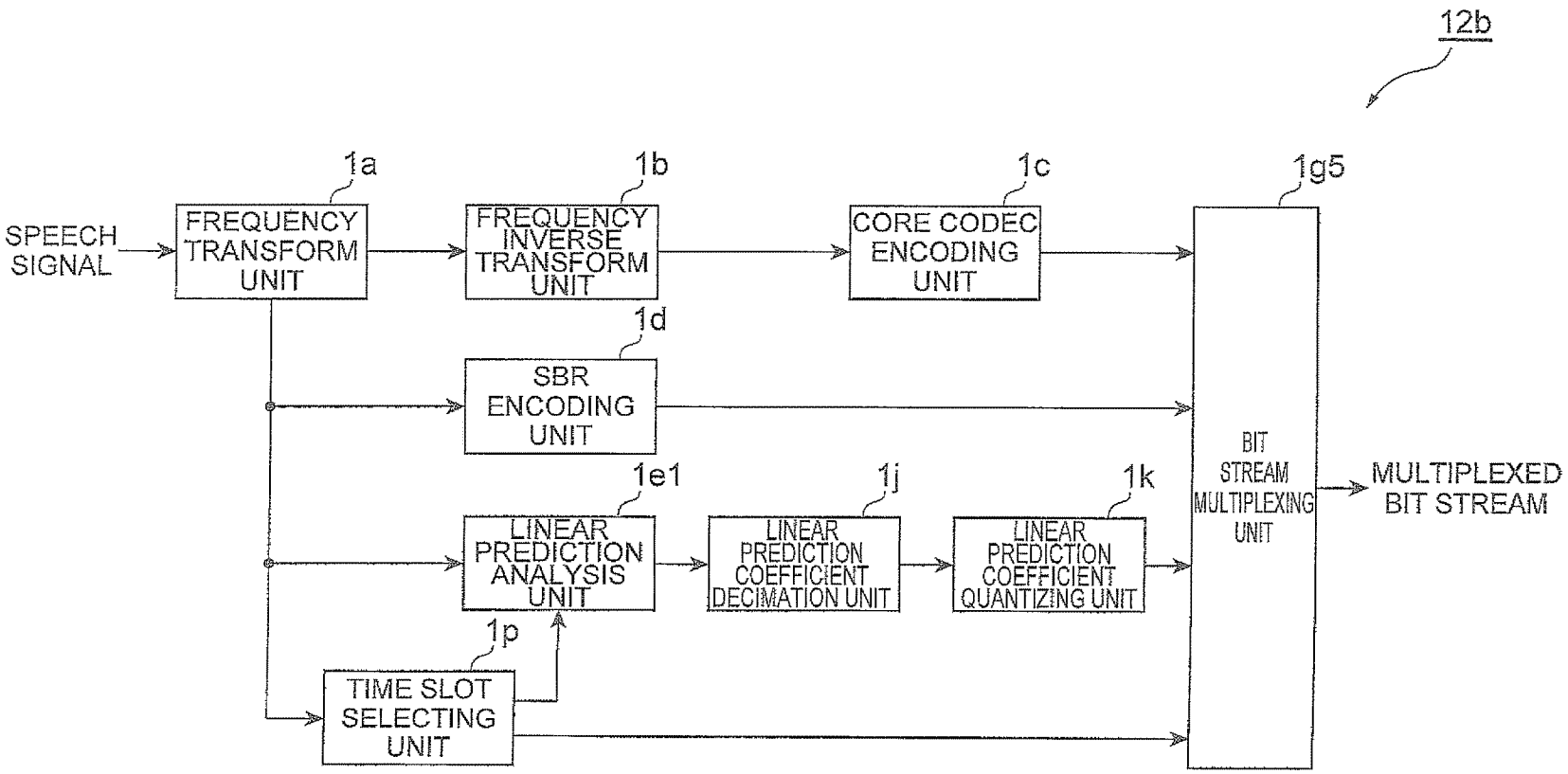
FIG. 47 is a diagram illustrating an example of a speech encoding device according to another modification of the second embodiment.

A speech encoding device 12*b* (FIG. 47) of a modification 2 of the second embodiment physically includes a CPU, a ROM, a RAM, a communication device, and the like, which are not illustrated, and the CPU integrally controls the speech encoding device 11*b* by loading and executing a predetermined computer program stored in a built-in memory of the speech encoding device 12*b* such as the ROM into the RAM. The communication device of the speech encoding device 12*b* receives a speech signal to be encoded from outside the speech encoding device 12*b*, and outputs an encoded multiplexed bit stream to the outside. The speech encoding device 12*b* includes the time slot selecting unit 1*p*1 and a bit stream multiplexing unit 1*g*5 instead of the time slot selecting unit 1*p* and the bit stream multiplexing unit 1*g*2 of the speech encoding device 12*a* of the modification 1. The bit stream multiplexing unit 1*g*5 multiplexes the encoded bit stream calculated by the core codec encoding unit 1*c*, the SBR supplementary information calculated by the SBR encoding unit 1*d*, and indices of the time slots corresponding to the quantized linear prediction coefficients received from the linear prediction coefficient quantizing unit 1*k* as the bit stream multiplexing unit 1*g*2, further multiplexes the time slot selection information received from the time slot selecting unit 1*p*1, and outputs the multiplexed bit stream through the communication device of the speech encoding device 12*b*.

Figure 24:
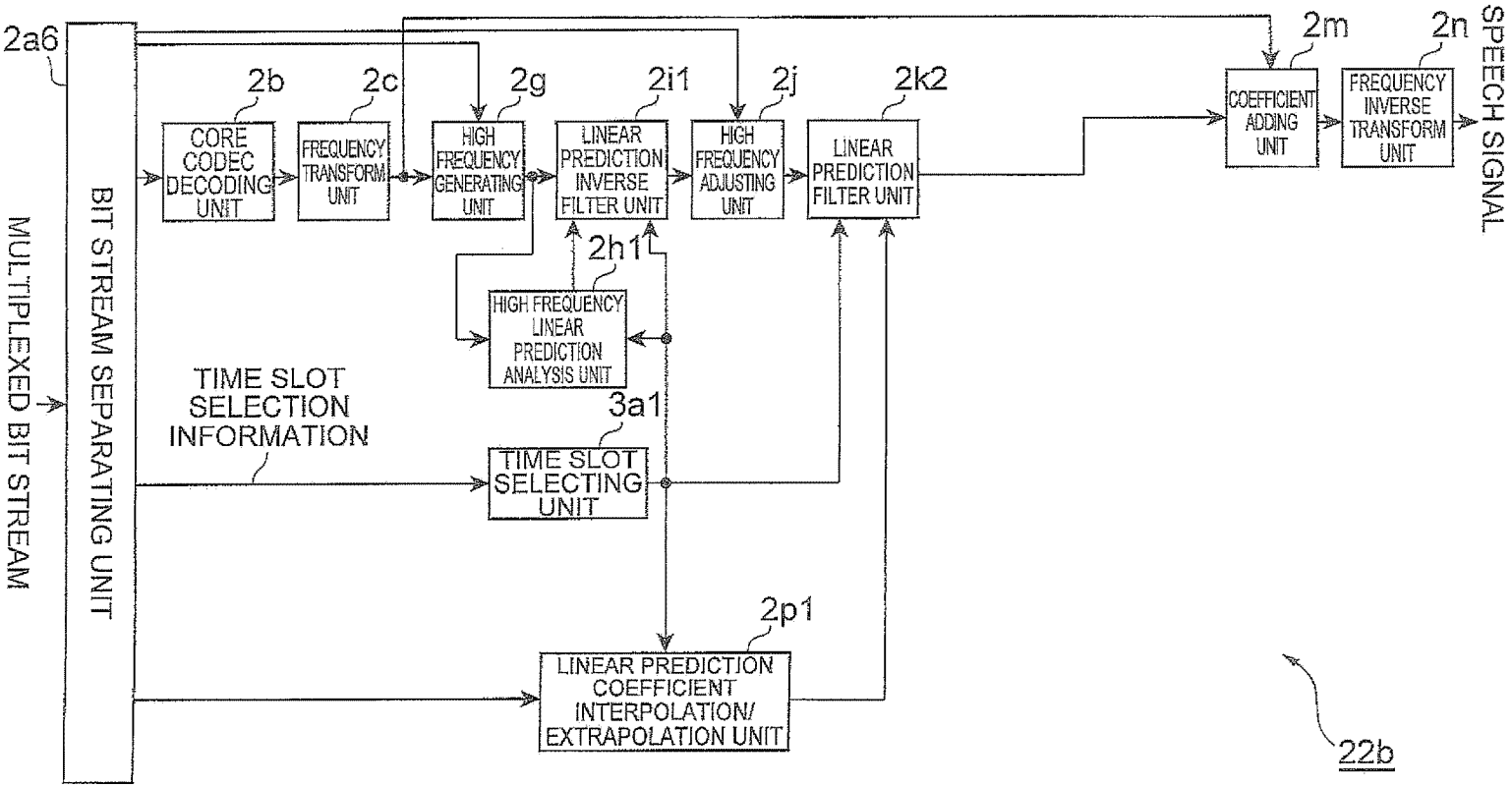
FIG. 24 is a diagram illustrating an example of a speech decoding device according to another modification of the second embodiment.
Figure 25:
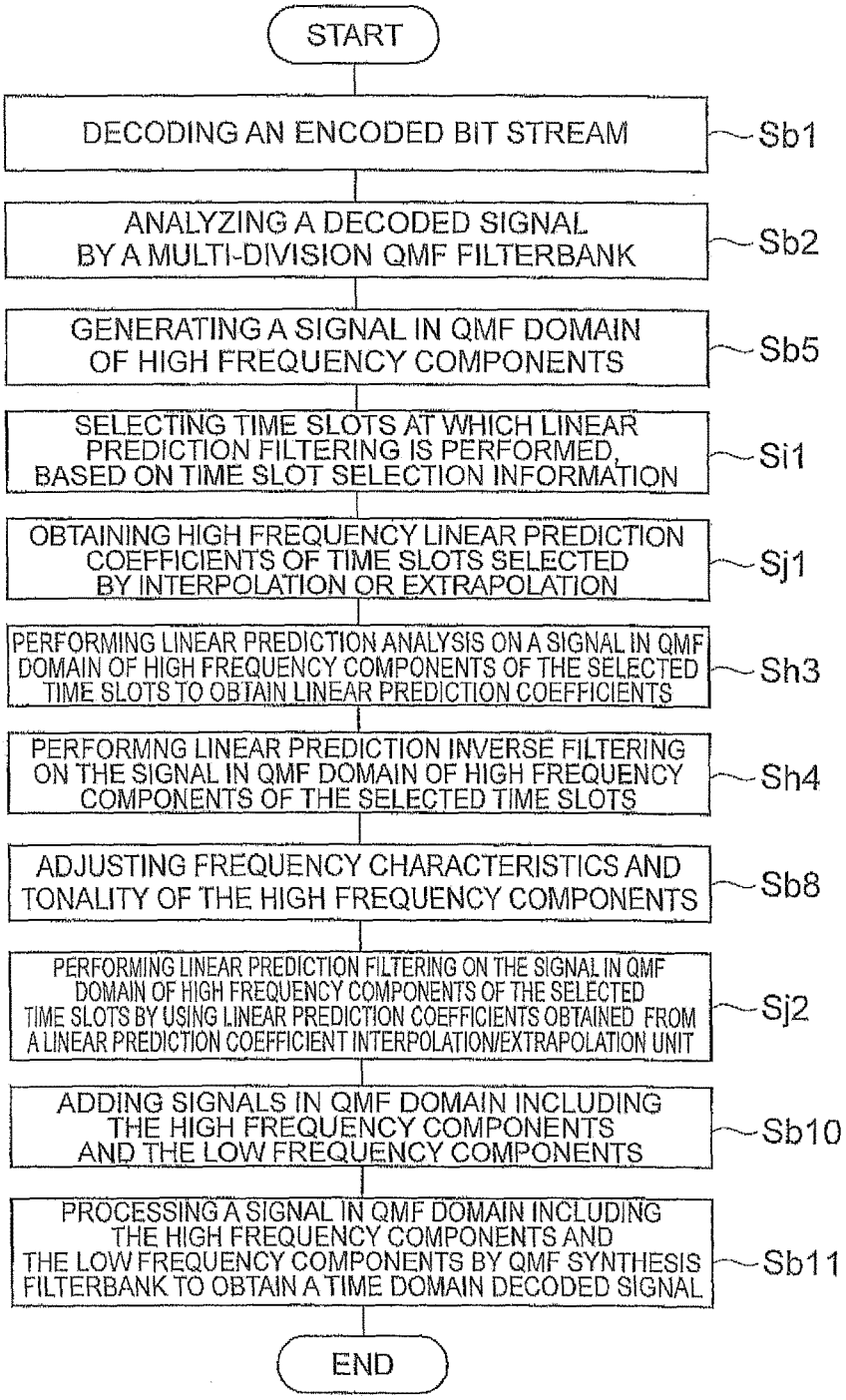
FIG. 25 is a flowchart to describe an example operation of the speech decoding device according to the modification of the second embodiment illustrated in FIG. 24.

A speech decoding device 22*b* (see FIG. 24) of the modification 2 of the second embodiment physically includes a CPU, a ROM, a RAM, a communication device, and the like, which are not illustrated, and the CPU integrally controls the speech decoding device 22*b* by loading and executing a predetermined computer program (such as a computer program for performing processes illustrated in the example flowchart of FIG. 25) stored in a built-in memory of the speech decoding device 22*b* such as the ROM into the RAM. The communication device of the speech decoding device 22*b* receives the encoded multiplexed bit stream, and outputs a decoded speech signal to the outside the speech decoding device 22*b*. The speech decoding device 22*b*, as illustrated in FIG. 24, includes a bit stream separating unit 2*a*6 and the time slot selecting unit 3*a*1 instead of the bit stream separating unit 2*a*1 and the time slot selecting unit 3*a* of the speech decoding device 22*a* described in the modification 1, and time slot selection information is supplied to the time slot selecting unit 3*a*1.

The bit stream separating unit 2a6 separates the multiplexed bit stream into $a_H$ (n, $r_i$) being quantized, the index $r_i$ of the corresponding time slot, the SBR supplementary information, and the encoded bit stream as the bit stream separating unit 2a1, and further separates the time slot selection information.

Modification 4 of Third Embodiment $$\overline{e(i)} \tag{47}$$

described in the modification 1 of the third embodiment may be an average value of e(r) in the SBR envelope, or may be a value defined in some other manner.

Modification 5 of Third Embodiment

As described in the modification 3 of the third embodiment, it is preferable that the envelope shape adjusting unit 2s control $e_{adj}(r)$ by using a predetermined value $e_{adj,Th}(r)$, considering that the adjusted temporal envelope $e_{adj}(r)$ is a gain coefficient multiplied by the QMF subband sample, for example, as the expression (28) and the expressions (37) and (38).

$$e_{adj}(r) \geq e_{adj,Th} \tag{48}$$

Fourth Embodiment

Figure 48:
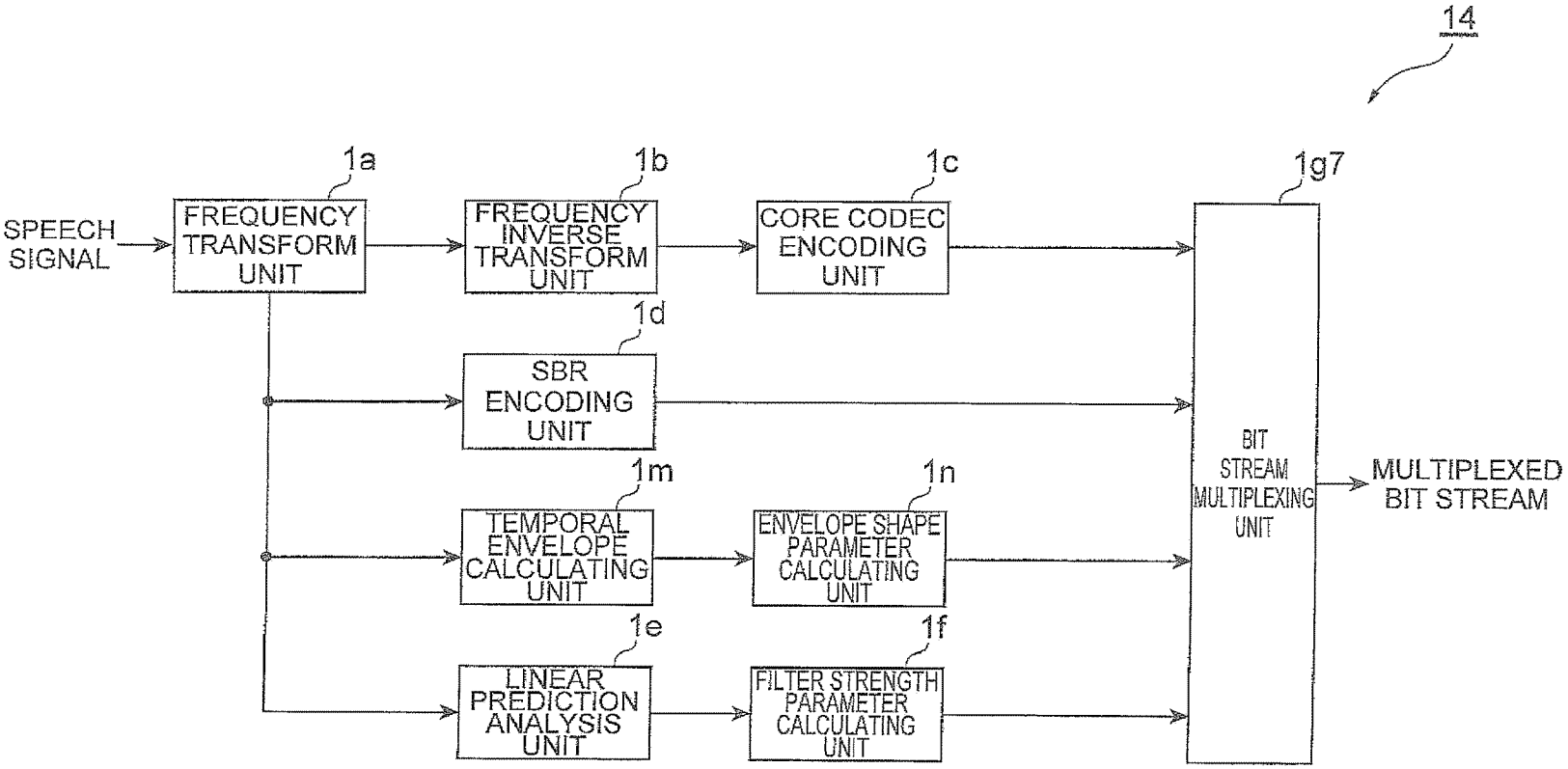
FIG. 48 is a diagram illustrating an example of a speech encoding device according to the fourth embodiment.

A speech encoding device 14 (FIG. 48) of the fourth embodiment physically includes a CPU, a ROM, a RAM, a communication device, and the like, which are not illustrated, and the CPU integrally controls the speech encoding device 14 by loading and executing a predetermined computer program stored in a built-in memory of the speech encoding device 14 such as the ROM into the RAM. The communication device of the speech encoding device 14 receives a speech signal to be encoded from outside the speech encoding device 14, and outputs an encoded multiplexed bit stream to the outside. The speech encoding device 14 includes a bit stream multiplexing unit 1g7 instead of the bit stream multiplexing unit 1g of the speech encoding device 11b of the modification 4 of the first embodiment, and further includes the temporal envelope calculating unit 1m and the envelope shape parameter calculating unit 1n of the speech encoding device 13.

The bit stream multiplexing unit 1g7 multiplexes the encoded bit stream calculated by the core codec encoding unit 1c and the SBR supplementary information calculated by the SBR encoding unit 1d as the bit stream multiplexing unit 1g, transforms the filter strength parameter calculated by the filter strength parameter calculating unit and the envelope shape parameter calculated by the envelope shape parameter calculating unit 1n into the temporal envelope supplementary information, multiplexes them, and outputs the multiplexed bit stream (encoded multiplexed bit stream) through the communication device of the speech encoding device 14.

Modification 4 of Fourth Embodiment

Figure 49:
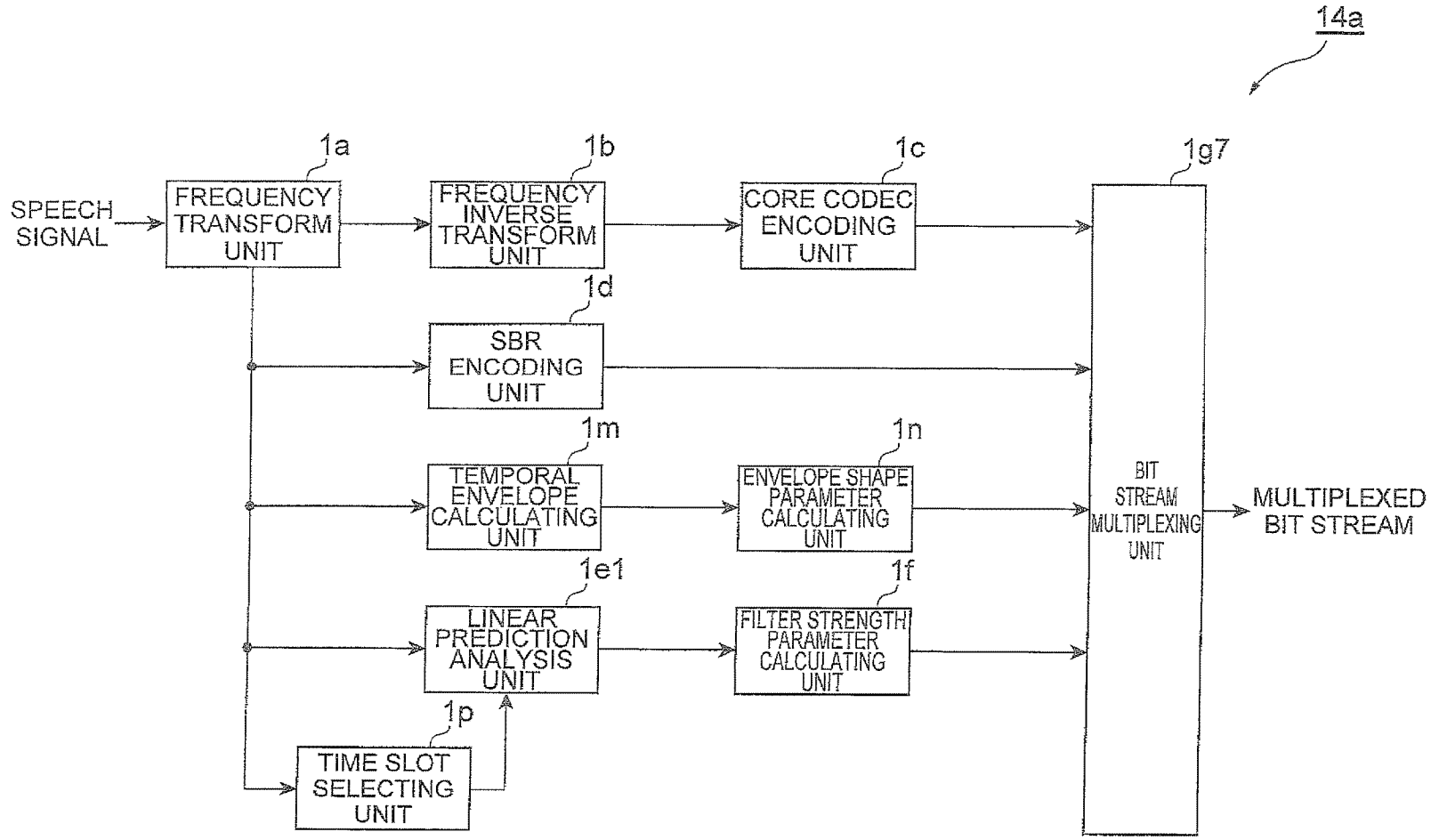
FIG. 49 is a diagram illustrating an example of a speech encoding device according to a modification of the fourth embodiment.

A speech encoding device 14a (FIG. 49) of a modification 4 of the fourth embodiment physically includes a CPU, a ROM, a RAM, a communication device, and the like, which are not illustrated, and the CPU integrally controls the speech encoding device 14a by loading and executing a predetermined computer program stored in a built-in memory of the speech encoding device 14a such as the ROM into the RAM. The communication device of the speech encoding device 14a receives a speech signal to be encoded from outside the speech encoding device 14a, and outputs an encoded multiplexed bit stream to the outside. The speech encoding device 14a includes the linear prediction analysis unit 1e1 instead of the linear prediction analysis unit 1e of the speech encoding device 14 of the fourth embodiment, and further includes the time slot selecting unit 1p.

Figure 26:
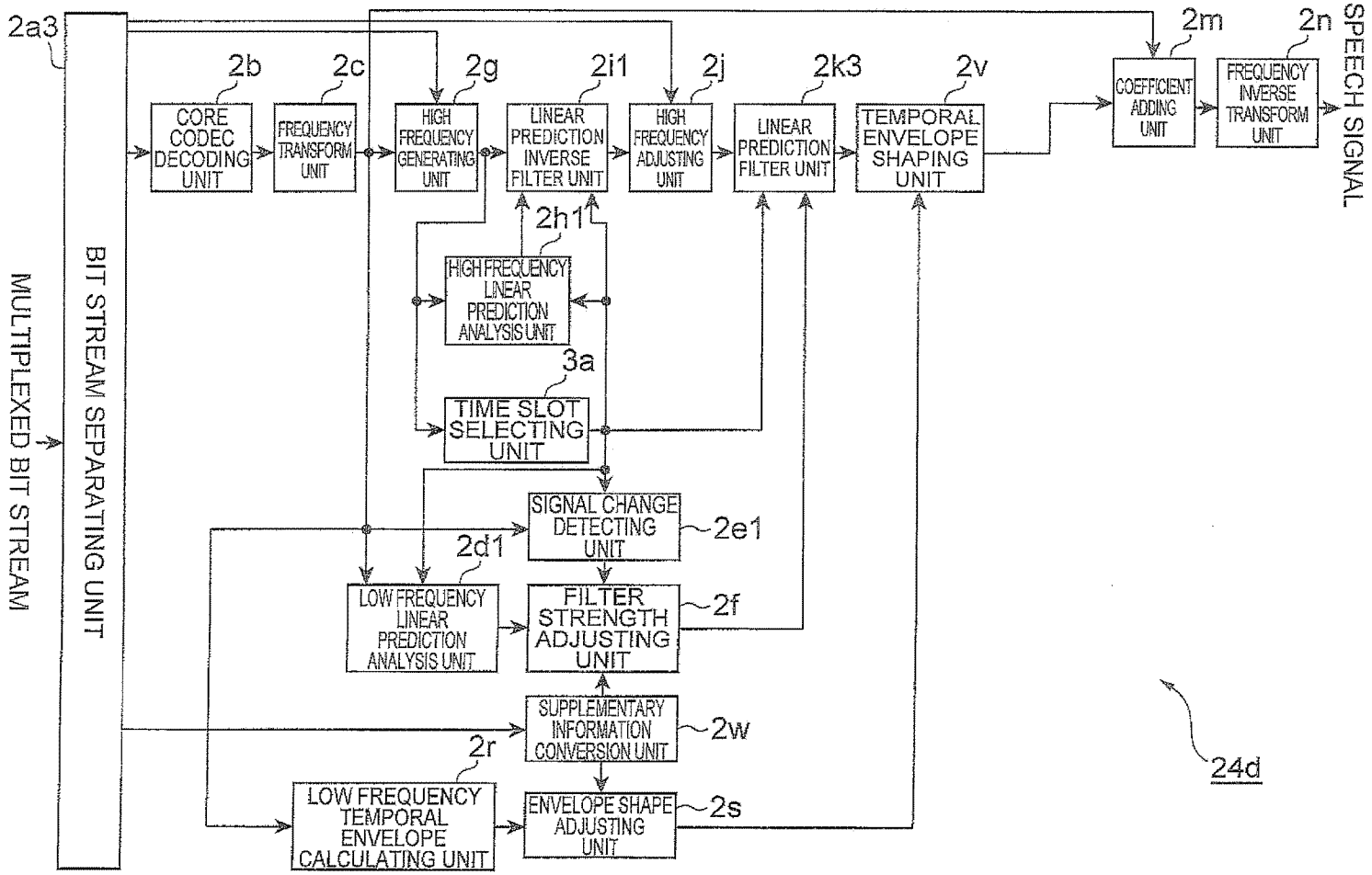
FIG. 26 is a diagram illustrating an example of a speech decoding device according to another modification of the fourth embodiment.
Figure 27:
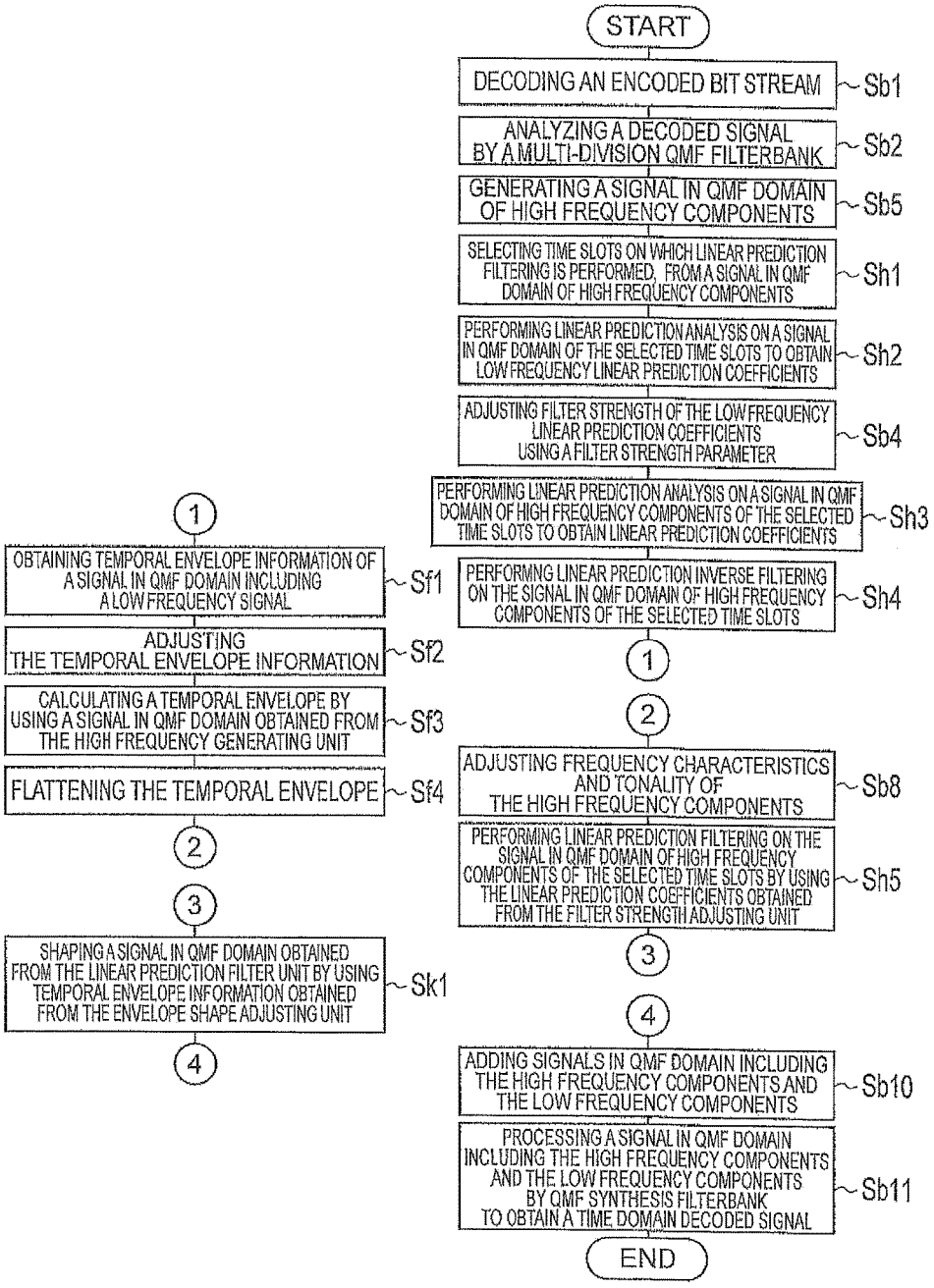
FIG. 27 is a flowchart to describe an example operation of the speech decoding device according to the modification of the fourth embodiment illustrated in FIG. 26.

A speech decoding device 24d (see FIG. 26) of the modification 4 of the fourth embodiment physically includes a CPU, a ROM, a RAM, a communication device, and the like, which are not illustrated, and the CPU integrally controls the speech decoding device 24d by loading and executing a predetermined computer program (such as a computer program for performing processes illustrated in the example flowchart of FIG. 27) stored in a built-in memory of the speech decoding device 24d such as the ROM into the RAM. The communication device of the speech decoding device 24d receives the encoded multiplexed bit stream, and outputs a decoded speech signal to the outside of the speech decoding device. The speech decoding device 24d, as illustrated in FIG. 26, includes the low frequency linear prediction analysis unit 2d1, the signal change detecting unit 2e1, the high frequency linear prediction analysis unit 2h1, the linear prediction inverse filter unit 2i1, and the linear prediction filter unit 2k3 instead of the low frequency linear prediction analysis unit 2d, the signal change detecting unit 2e, the high frequency linear prediction analysis unit 2h, the linear prediction inverse filter unit 2i, and the linear prediction filter unit 2k of the speech decoding device 24, and further includes the time slot selecting unit 3a. The temporal envelope shaping unit 2v transforms the signal in the QMF domain obtained from the linear prediction filter unit 2k3 by using the temporal envelope information obtained from the envelope shape adjusting unit 2s, as the temporal envelope shaping unit 2v of the third embodiment, the fourth embodiment, and the modifications thereof (process at Step Ski).

Modification 5 of Fourth Embodiment

Figure 28:
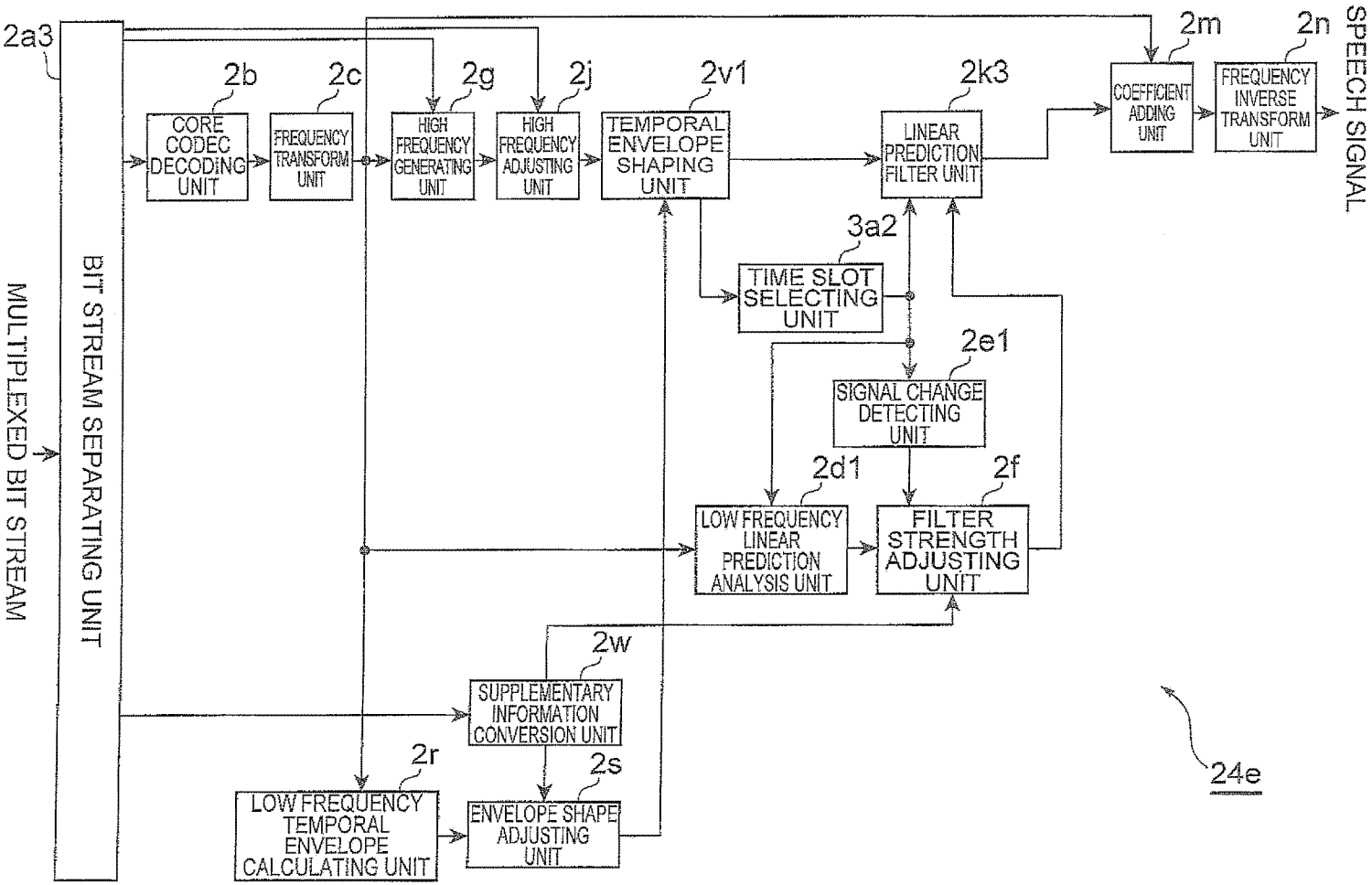
FIG. 28 is a diagram of an example of a speech decoding device according to another modification of the fourth embodiment.
Figure 29:
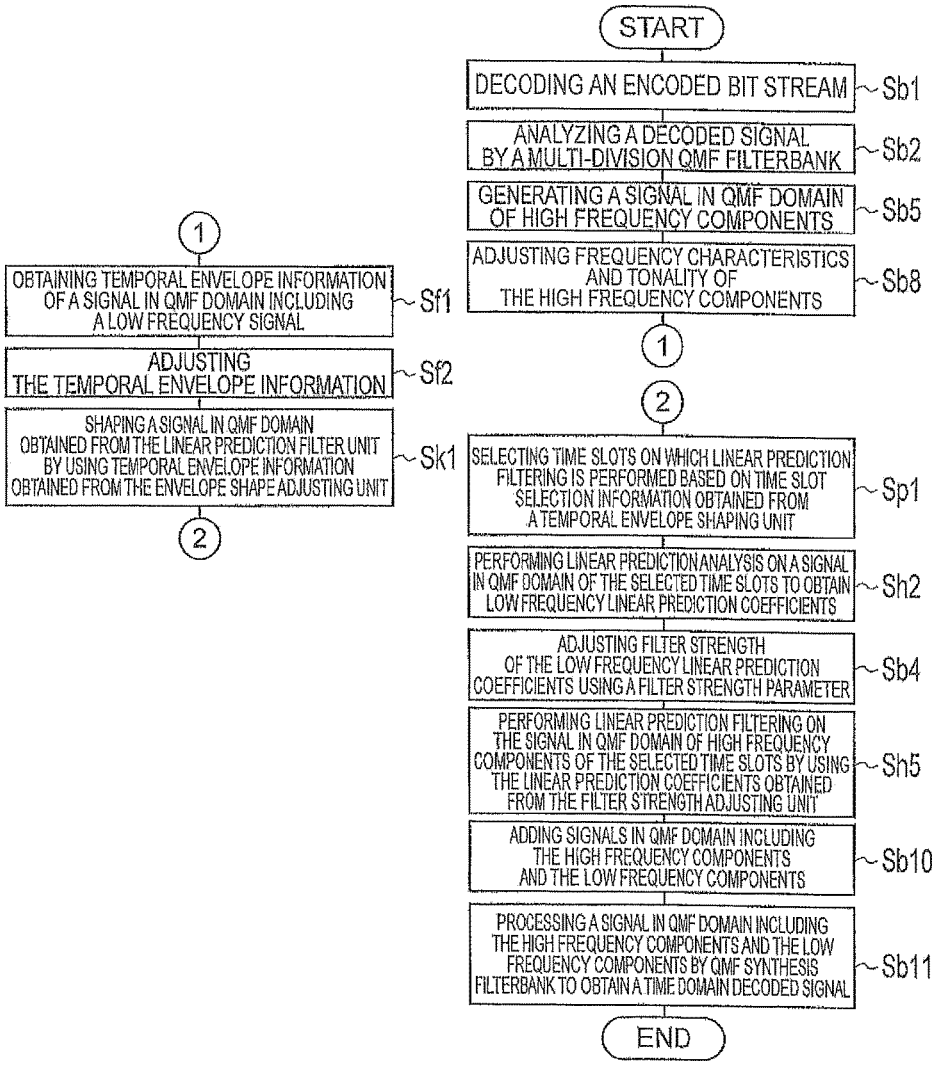
FIG. 29 is a flowchart to describe an example operation of the speech decoding device according to the modification of the fourth embodiment illustrated in FIG. 28.

A speech decoding device 24e (see FIG. 28) of a modification 5 of the fourth embodiment physically includes a CPU, a ROM, a RAM, a communication device, and the like, which are not illustrated, and the CPU integrally controls the speech decoding device 24e by loading and executing a predetermined computer program (such as a computer program for performing processes illustrated in the flowchart of FIG. 29) stored in a built-in memory of the speech decoding device 24e such as the ROM into the RAM. The communication device of the speech decoding device 24e receives the encoded multiplexed bit stream, and outputs a decoded speech signal to the outside of the speech decoding device. In the modification 5, as illustrated in the example embodiment of FIG. 28, the speech decoding device 24e omits the high frequency linear prediction analysis unit 2h1 and the linear prediction inverse filter unit 2i1 of the speech decoding device 24d described in the modification 4 that can be omitted throughout the fourth embodiment as the first embodiment, and includes a time slot selecting unit 3a2 and a temporal envelope shaping unit 2v1 instead of the time slot selecting unit 3a and the temporal envelope shaping unit 2v of the speech decoding device 24d. The speech decoding device 24e also changes the order of the linear prediction synthesis filtering performed by the linear prediction filter unit 2k3 and the temporal envelope shaping process performed by the temporal envelope shaping unit 2v1 whose processing order is interchangeable throughout the fourth embodiment.

The temporal envelope shaping unit 2v1 transforms $q_{adj}$ (k, r) obtained from the high frequency adjusting unit 2j by using $e_{adj}(r)$ obtained from the envelope shape adjusting unit 2s, as the temporal envelope shaping unit 2v, and obtains a signal $q_{envadj}$ (k, r) in the QMF domain in which the temporal envelope is shaped. The temporal envelope shaping unit 2v1 also notifies the time slot selecting unit 3a2 of a parameter obtained when the temporal envelope is being shaped, or a parameter calculated by at least using the parameter obtained when the temporal envelope is being transformed as time slot selection information. The time slot selection information may be e(r) of the expression (22) or the expression (40), or to which the square root operation is not applied during the calculation process. A $|e(r)|^2$ plurality of time slot sections (such as SBR envelopes)

$$b_i \le r < b_{i+1} \tag{49}$$

may also be used, and the expression (24) that is the average value thereof.

$$\overline{e(i)}, |\overline{e(i)}|^2 \tag{50}$$

may also be used as the time slot selection information. It is noted that:

$$|\overline{e(i)}|^2 = \frac{\sum_{r=b_i}^{b_{i+1}-1} |e(r)|^2}{b_{i+1} - b_i} \tag{51}$$

The time slot selection information may also be $e_{exp}(r)$ of the expression (26) and the expression (41), or $|e_{exp}(r)|^2$ to which the square root operation is not applied during the calculation process. A plurality of time slot segments (such as SBR envelopes)

$$b_i \le r < b_{i+1} \tag{52}$$

and the average value thereof.

$$\overline{e}_{exp}(i), |\overline{e}_{exp}(i)|^2 \tag{53}$$

may also be used as the time slot selection information. It is noted that:

$$\overline{e}_{exp}(i) = \frac{\sum_{r=b_i}^{b_{i+1}-1} e_{exp}(r)}{b_{i+1} - b_i} \tag{54}$$

$$|\overline{e}_{exp}(i)|^2 = \frac{\sum_{r=b_i}^{b_{i+1}-1} |e_{exp}(r)|^2}{b_{i+1} - b_i} \tag{55}$$

The time slot selection information may also be $e_{adj}(r)$ of the expression (23), the expression (35) or the expression (36), or may be $|e_{adj}(r)|^2$ to which the square root operation is not applied during the calculation process. A plurality of time slot segments (such as SBR envelopes)

$$b_i \le r < b_{i+1} \tag{56}$$

and the average thereof $$\overline{e}_{adj}(i), |\overline{e}_{adj}(i)|^2 \tag{57}$$

may also be used as the time slot selection information. It is noted that:

$$\overline{e}_{adj}(i) = \frac{\sum_{r=b_i}^{b_{i+1}-1} e_{adj}(r)}{b_{i+1} - b_i} \tag{58}$$

$$|\overline{e}_{adj}(i)|^2 = \frac{\sum_{r=b_i}^{b_{i+1}-1} |e_{adj}(r)|^2}{b_{i+1} - b_i} \tag{59}$$

The time slot selection information may also be $e_{adj,scaled}(r)$ of the expression (37), or may be $|e_{adj,scaled}(r)|^2$ to which the square root operation is not applied during the calculation process. In a plurality of time slot segments (such as SBR envelopes)

$$b_i \le r < b_{i+1} \tag{60}$$

and the average value thereof.

$$\overline{e}_{adj,scaled}(i), |\overline{e}_{adj,scaled}(i)|^2 \tag{61}$$

may also be used as the time slot selection information. It is noted that:

$$\overline{e}_{adj,scaled}(i) = \frac{\sum_{r=b_i}^{b_{i+1}-1} e_{adj,scaled}(r)}{b_{i+1} - b_i} \tag{62}$$

$$|\overline{e}_{adj,scaled}(i)|^2 = \frac{\sum_{r=b_i}^{b_{i+1}-1} |e_{adj,scaled}(r)|^2}{b_{i+1} - b_i} \tag{63}$$

The time slot selection information may also be a signal power $P_{envadj}(r)$ of the time slot r of the QMF domain signal corresponding to the high frequency components in which the temporal envelope is shaped or a signal amplitude value thereof to which the square root operation is applied $$\sqrt{P_{\text{envadj}}(r)} \tag{64}$$

In a plurality of time slot segments (such as SBR envelopes)

$$b_i \le r < b_{i+1} \tag{65}$$

and the average value thereof.

$$\overline{P}_{envadj}(i), \sqrt{\overline{P}_{\text{envadj}}(i)} \tag{66}$$

may also be used as the time slot selection information. It is noted that:

$$P_{envadj}(r) = \sum_{k=k_x}^{k_x+M-1} |q_{envadj}(k, r)|^2 \tag{67}$$

$$\overline{P}_{envadj}(i) = \frac{\sum_{r=b_i}^{b_{i+1}-1} P_{envadj}(r)}{b_{i+1} - b_i} \tag{68}$$

M is a value representing a frequency range higher than that of the lower limit frequency $k_x$ of the high frequency components generated by the high frequency generating unit 2g, and the frequency range of the high frequency components generated by the high frequency generating unit 2g may also be represented as $k_x \leq k < k_x + M$.

The time slot selecting unit 3a2 selects time slots at which the linear prediction synthesis filtering by the linear prediction filter unit 2k is performed, by determining whether linear prediction synthesis filtering is performed on the signal $q_{envadj}$ (k, r) in the QMF domain of the high frequency components of the time slot r in which the temporal envelope is shaped by the temporal envelope shaping unit 2v1, based on the time slot selection information transmitted from the temporal envelope shaping unit 2v1 (process at Step Sp1).

To select time slots at which the linear prediction synthesis filtering is performed by the time slot selecting unit 3a2 in the present modification, at least one time slot r in which a parameter u(r) included in the time slot selection information transmitted from the temporal envelope shaping unit 2v1 is larger than a predetermined value $u_{Th}$ may be selected, or at least one time slot r in which u(r) is equal to or larger than a predetermined value $u_{Th}$ may be selected. u(r) may include at least one of e(r), $|e(r)|^2$, $e_{exp}(r)$, $|e_{exp}(r)|^2$, $e_{adj}(r)$, $|e_{adj}(r)|^2$, $e_{adj,scaled}(r)$, $|e_{adj,scale}(r)|^2$, and $P_{envadj}(r)$, described above, and;

$$\sqrt{P_{\text{envadj}}(r)} \tag{69}$$

and $u_{Th}$ may include at least one of;

$$\overline{e(i)}, \overline{|e(i)|^2}, e_{exp}(i),$$

$$\overline{|e_{exp}(i)|^2}, \overline{e}_{adj}(i), \overline{|e_{adj}(i)|^2}$$

$$\overline{e}_{adj,scaled}(i), \overline{|e_{adj,scaled}(i)|^2},$$

$$\overline{P}_{envadj}(i), \sqrt{\overline{P}_{\text{envadj}}(i)}, \tag{70}$$

$u_{Th}$ may also be an average value of u(r) of a predetermined time width (such as SBR envelope) including the time slot r. The selection may also be made so that time slots at which u(r) reaches its peaks are included. The peaks of u(r) may be calculated as calculating the peaks of the signal power in the QMF domain signal of the high frequency components in the modification 4 of the first embodiment. The steady state and the transient state in the modification 4 of the first embodiment may be determined similar to those of the modification 4 of the first embodiment by using u(r), and time slots may be selected based on this. The time slot selecting method may be at least one of the methods described above, may include at least one method different from those described above, or may be the combination thereof.

Modification 6 of Fourth Embodiment

Figure 30:
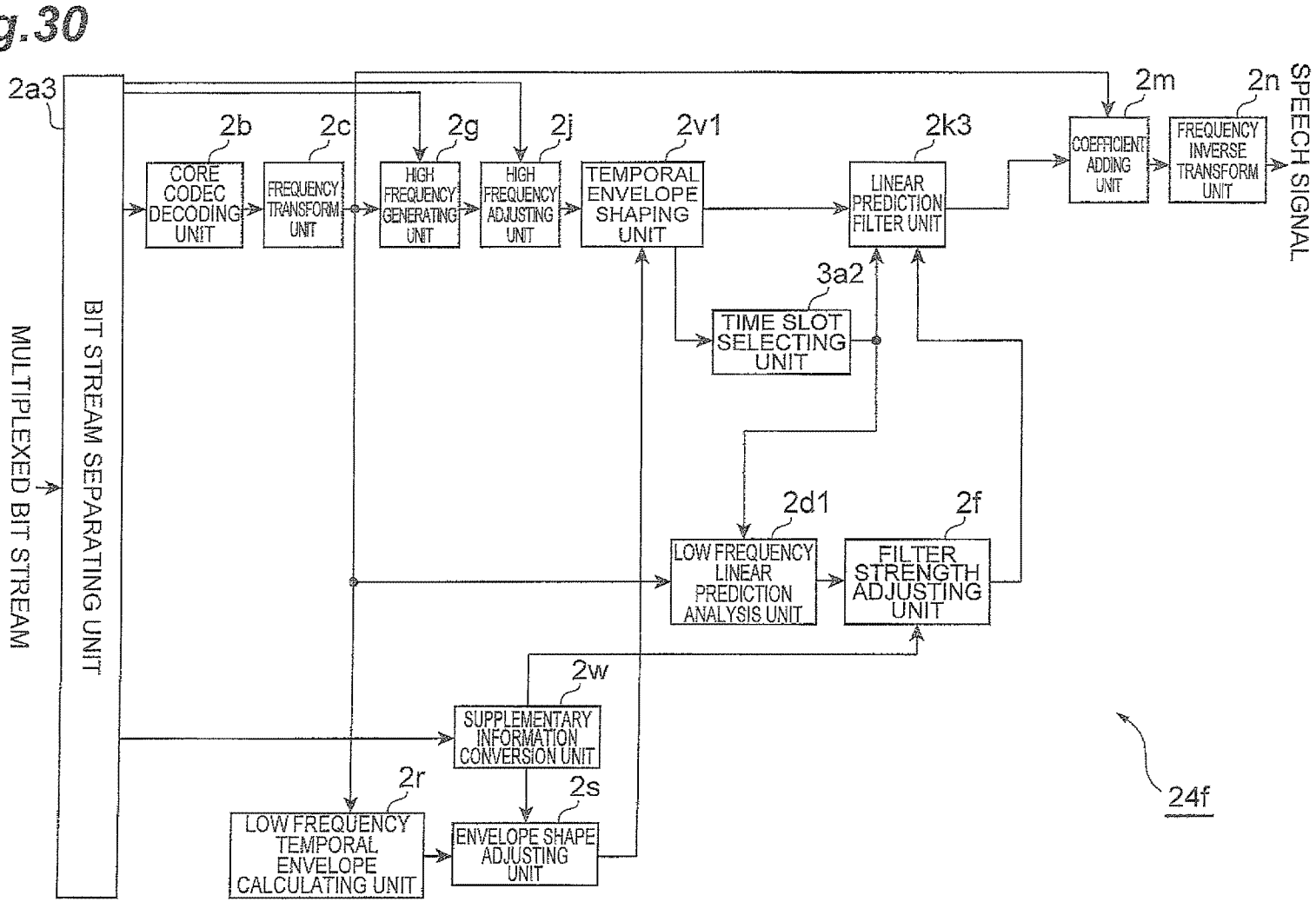
FIG. 30 is a diagram illustrating an example of a speech decoding device according to another modification of the fourth embodiment.

A speech decoding device 24f (see FIG. 30) of a modification 6 of the fourth embodiment physically includes a CPU, a memory, such as a ROM, a RAM, a communication device, and the like, which are not illustrated, and the CPU integrally controls the speech decoding device 24f by loading and executing a predetermined computer program (such as a computer program for performing processes illustrated in the example flowchart of FIG. 29) stored in a built-in memory of the speech decoding device 24f such as the ROM into the RAM. The communication device of the speech decoding device 24f receives the encoded multiplexed bit stream and outputs a decoded speech signal to outside the speech decoding device. In the modification 6, as illustrated in FIG. 30, the speech decoding device 24f omits the signal change detecting unit 2e1, the high frequency linear prediction analysis unit 2h1, and the linear prediction inverse filter unit 2i1 of the speech decoding device 24d described in the modification 4 that can be omitted throughout the fourth embodiment as the first embodiment, and includes the time slot selecting unit 3a2 and the temporal envelope shaping unit 2v1 instead of the time slot selecting unit 3a and the temporal envelope shaping unit 2v of the speech decoding device 24d. The speech decoding device 24f also changes the order of the linear prediction synthesis filtering performed by the linear prediction filter unit 2k3 and the temporal envelope shaping process performed by the temporal envelope shaping unit 2v1 whose processing order is interchangeable throughout the fourth embodiment.

The time slot selecting unit 3a2 determines whether linear prediction synthesis filtering is performed by the linear prediction filter unit 2k3, on the signal $q_{envadj}$ (k, r) in the QMF domain of the high frequency components of the time slots r in which the temporal envelope is shaped by the temporal envelope shaping unit 2v1, based on the time slot selection information transmitted from the temporal envelope shaping unit 2v1, selects time slots at which the linear prediction synthesis filtering is performed, and notifies, of the selected time slots, the low frequency linear prediction analysis unit 2d1 and the linear prediction filter unit 2k3.

Modification 7 of Fourth Embodiment

Figure 50:
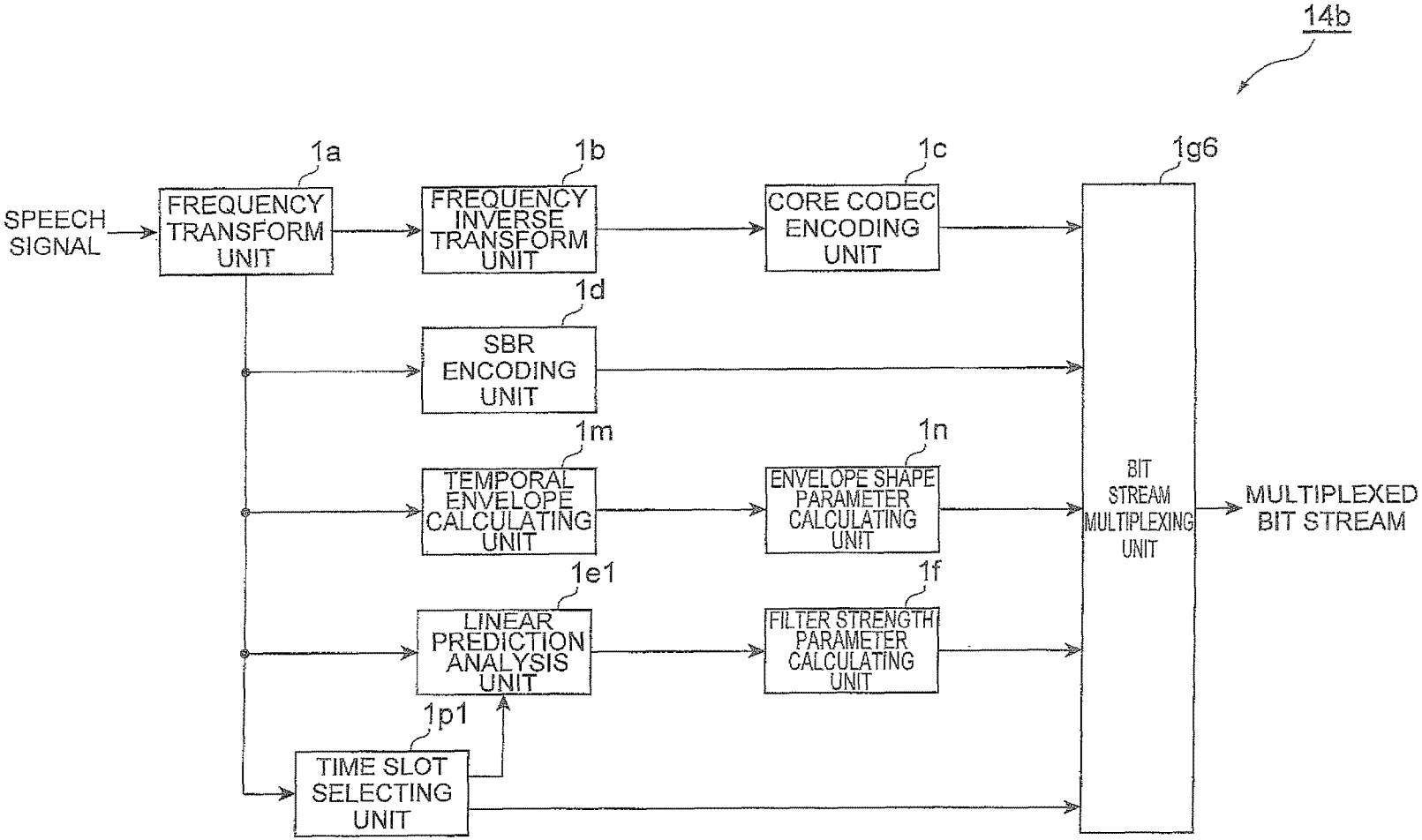
FIG. 50 is a diagram illustrating an example of a speech encoding device according to another modification of the fourth embodiment.

A speech encoding device 14b (FIG. 50) of a modification 7 of the fourth embodiment physically includes a CPU, a ROM, a RAM, a communication device, and the like, which are not illustrated, and the CPU integrally controls the speech encoding device 14b by loading and executing a predetermined computer program stored in a built-in memory of the speech encoding device 14b such as the ROM into the RAM. The communication device of the speech encoding device 14b receives a speech signal to be encoded from outside the speech encoding device 14b, and outputs an encoded multiplexed bit stream to the outside. The speech encoding device 14b includes a bit stream multiplexing unit 1g6 and the time slot selecting unit 1p1 instead of the bit stream multiplexing unit 1g7 and the time slot selecting unit 1p of the speech encoding device 14a of the modification 4.

The bit stream multiplexing unit 1g6 multiplexes the encoded bit stream calculated by the core codec encoding unit 1c, the SBR supplementary information calculated by the SBR encoding unit 1d, and the temporal envelope supplementary information in which the filter strength parameter calculated by the filter strength parameter calculating unit and the envelope shape parameter calculated by the envelope shape parameter calculating unit 1n are transformed, also multiplexes the time slot selection information received from the time slot selecting unit 1p1, and outputs the multiplexed bit stream (encoded multiplexed bit stream) through the communication device of the speech encoding device 14b.

Figure 31:
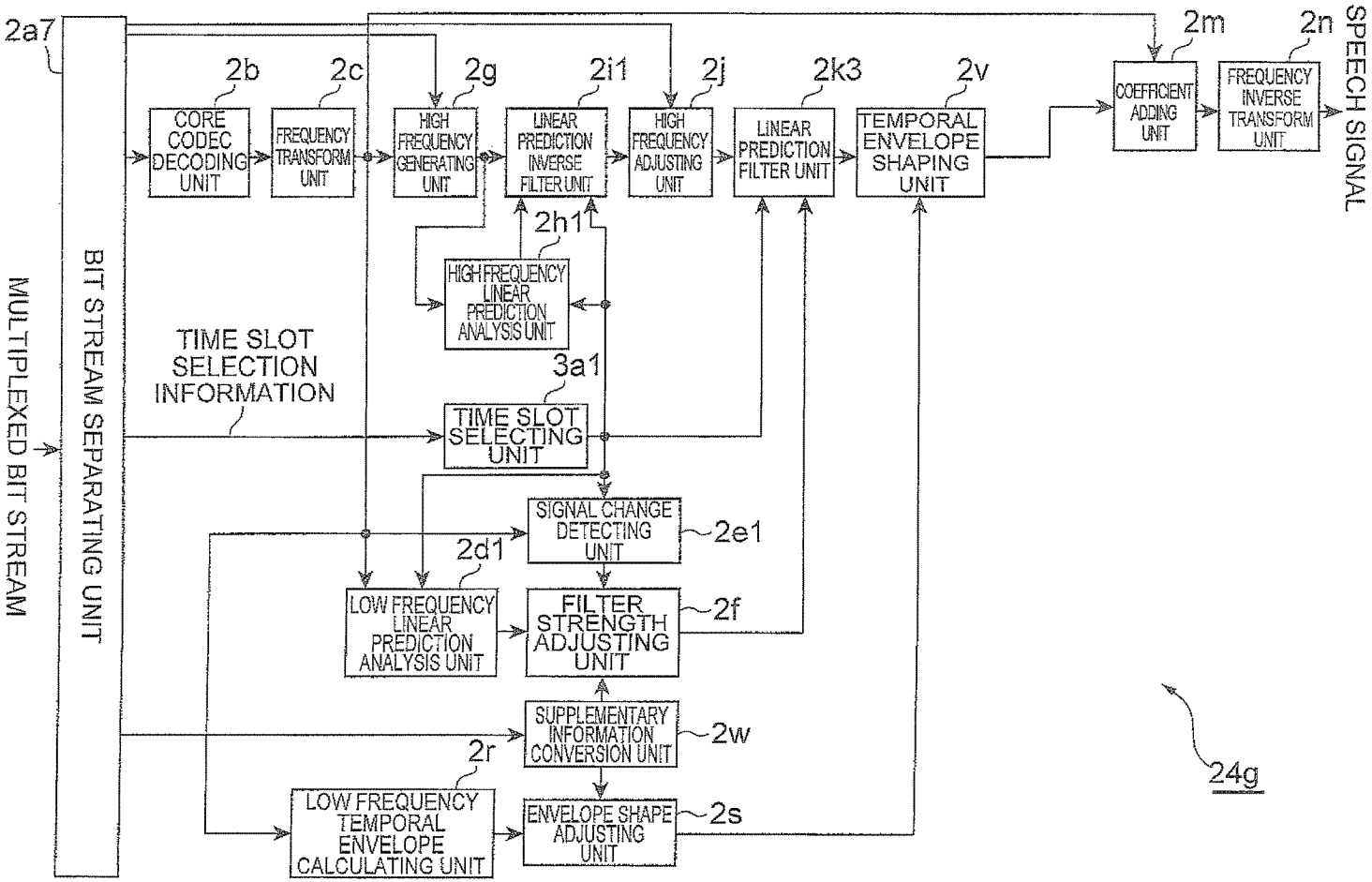
FIG. 31 is a diagram illustrating an example of a speech decoding device according to another modification of the fourth embodiment.
Figure 32:
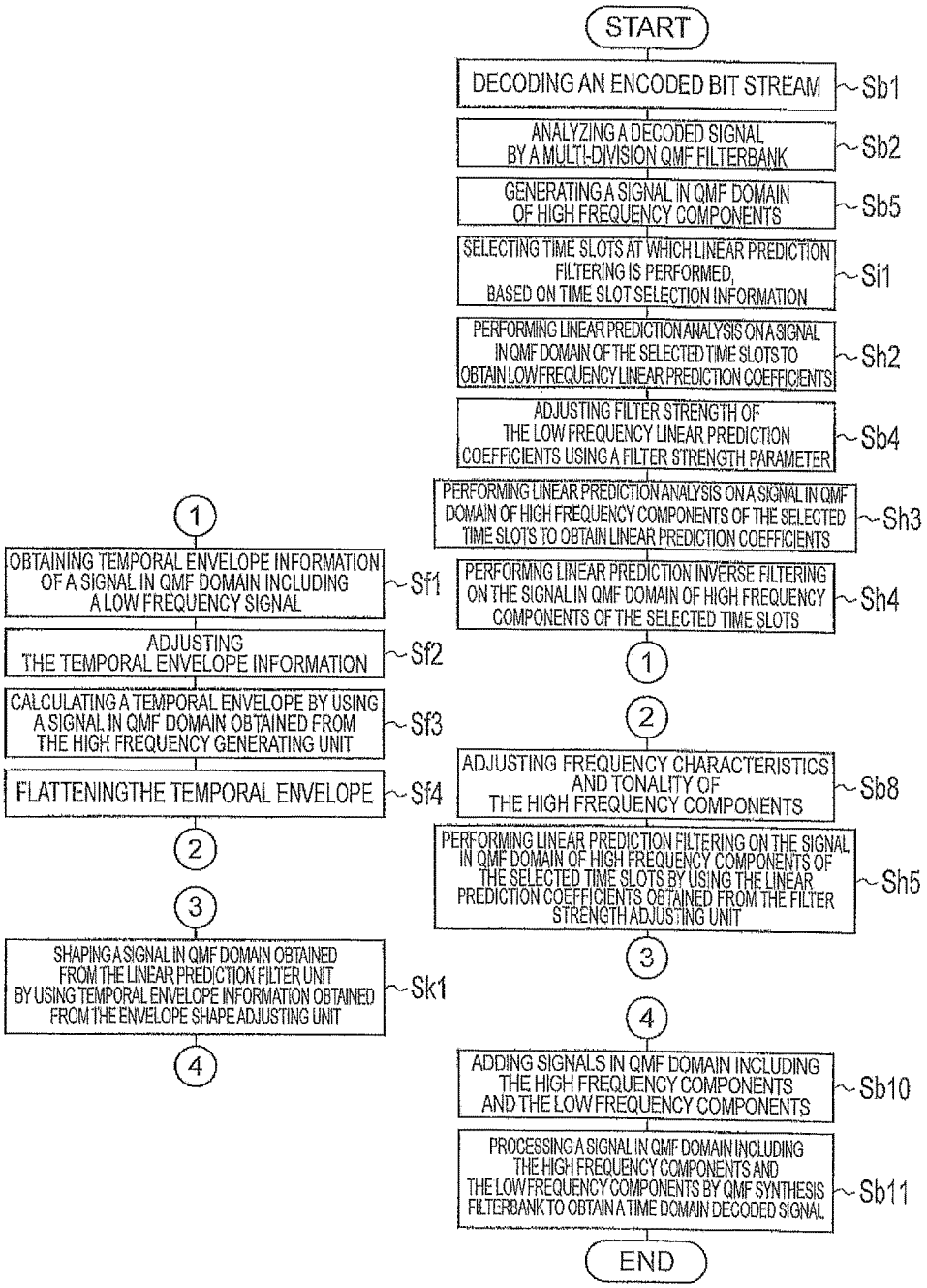
FIG. 32 is a flowchart to describe an example operation of the speech decoding device according to the modification of the fourth embodiment illustrated in FIG. 31.

A speech decoding device 24g (see FIG. 31) of the modification 7 of the fourth embodiment physically includes a CPU, a ROM, a RAM, a communication device, and the like, which are not illustrated, and the CPU integrally controls the speech decoding device 24g by loading and executing a predetermined computer program (such as a computer program for performing processes illustrated in the flowchart of FIG. 32) stored in a built-in memory of the speech decoding device 24g such as the ROM into the RAM. The communication device of the speech decoding device 24g receives the encoded multiplexed bit stream and outputs a decoded speech signal to outside the speech decoding device 24*g*. The speech decoding device 24*g* includes a bit stream separating unit 2*a*7 and the time slot selecting unit 3*a*1 instead of the bit stream separating unit 2*a*3 and the time slot selecting unit 3*a* of the speech decoding device 24*d* described in the modification 4.

The bit stream separating unit 2*a*7 separates the multiplexed bit stream supplied through the communication device of the speech decoding device 24*g* into the temporal envelope supplementary information, the SBR supplementary information, and the encoded bit stream, as the bit stream separating unit 2*a*3, and further separates the time slot selection information.

Modification 8 of Fourth Embodiment

Figure 33:
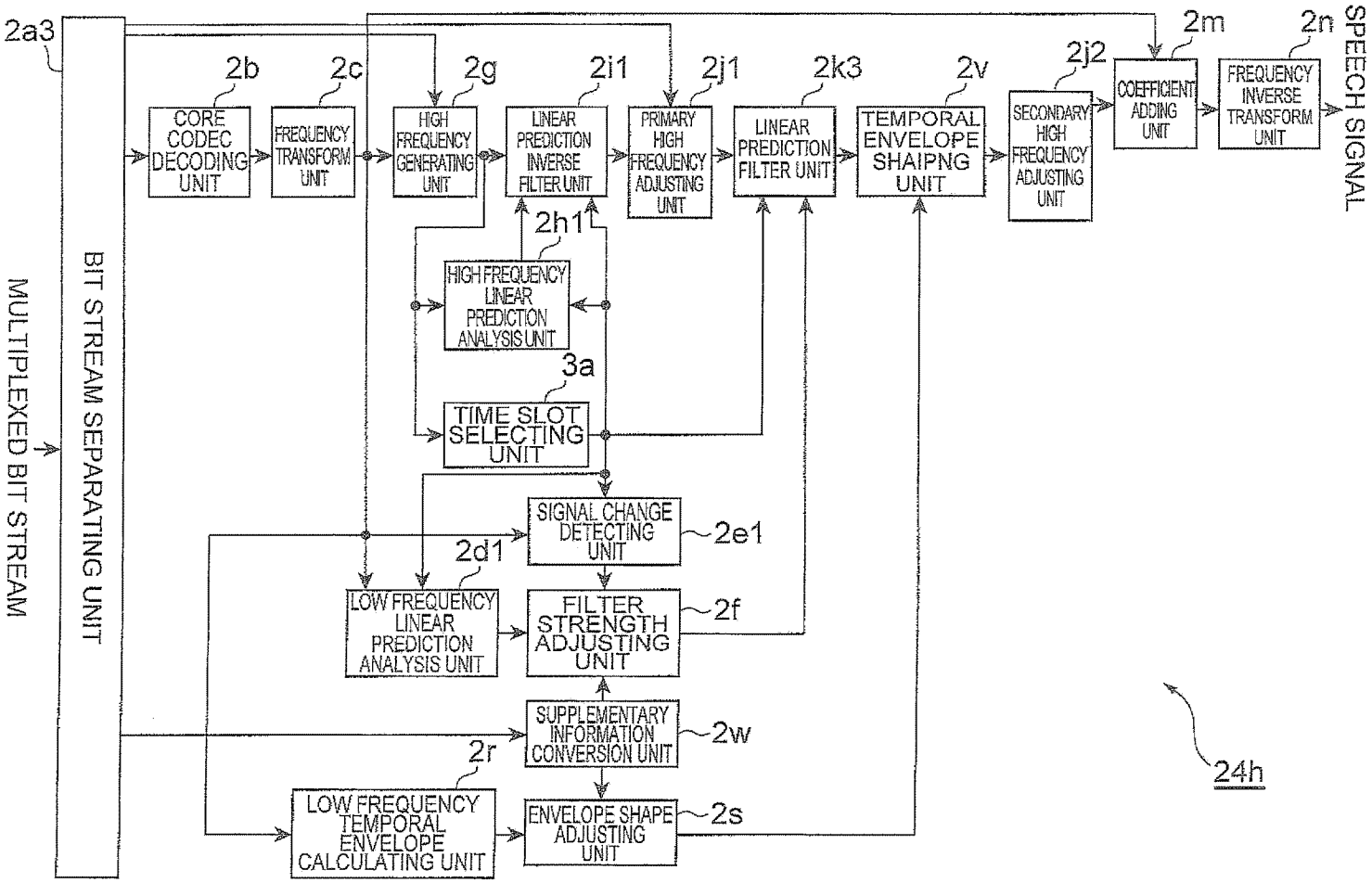
FIG. 33 is a diagram illustrating an example of a speech decoding device according to another modification of the fourth embodiment.
Figure 34:
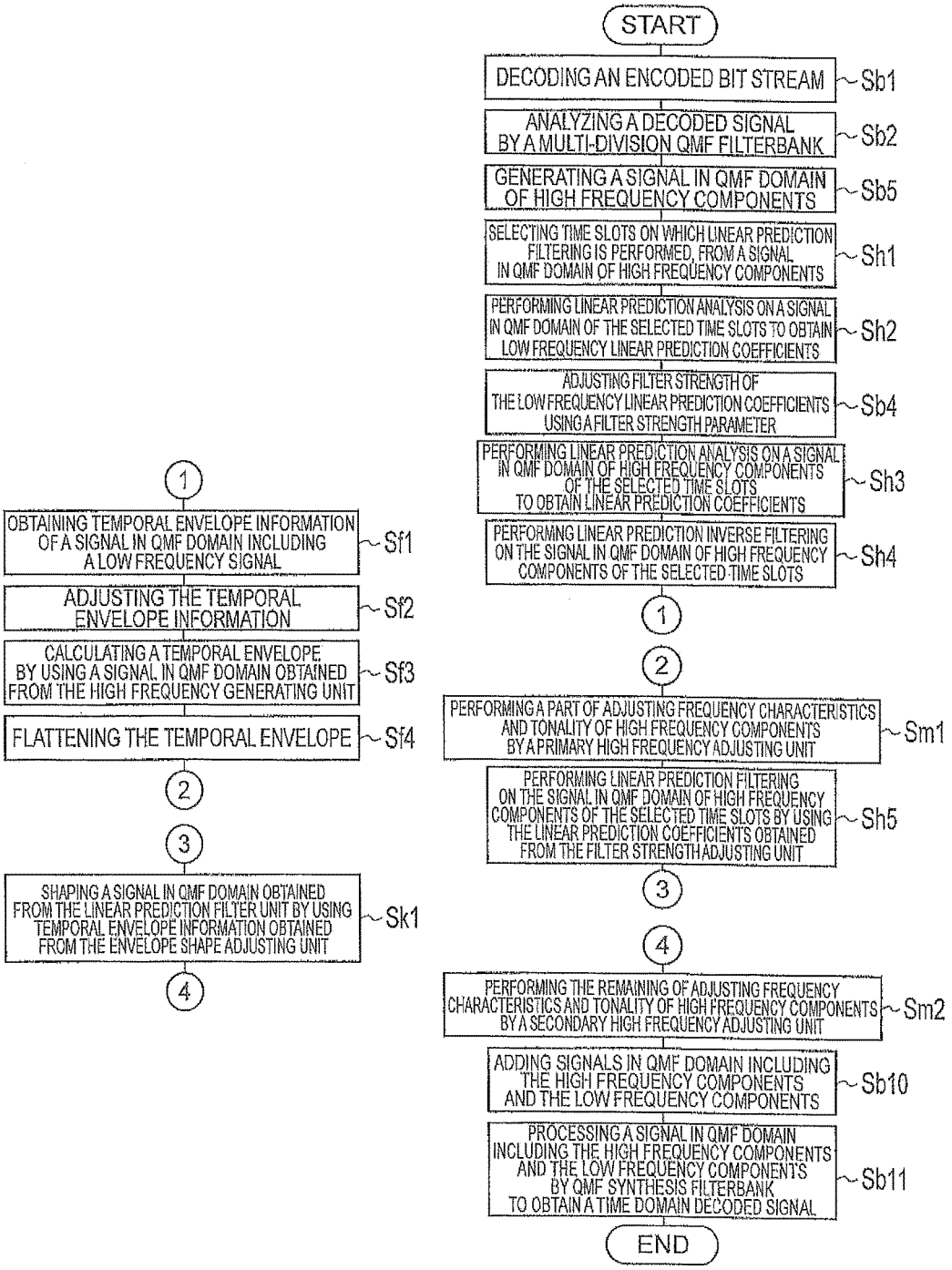
FIG. 34 is a flowchart to describe an example operation of the speech decoding device according to the modification of the fourth embodiment illustrated in FIG. 33.

A speech decoding device 24*h* (see FIG. 33) of a modification 8 of the fourth embodiment physically includes a CPU, a ROM, a RAM, a communication device, and the like, which are not illustrated, and the CPU integrally controls the speech decoding device 24*h* by loading and executing a predetermined computer program (such as a computer program for performing processes illustrated in the flowchart of FIG. 34) stored in a built-in memory of the speech decoding device 24*h* such as the ROM into the RAM. The communication device of the speech decoding device 24*h* receives the encoded multiplexed bit stream and outputs a decoded speech signal to outside the speech decoding device 24*h*. The speech decoding device 24*h*, as illustrated in FIG. 33, includes the low frequency linear prediction analysis unit 2*d*1, the signal change detecting unit 2*e*1, the high frequency linear prediction analysis unit 2*h*1, the linear prediction inverse filter unit 2*i*1, and the linear prediction filter unit 2*k*3 instead of the low frequency linear prediction analysis unit 2*d*, the signal change detecting unit 2*e*, the high frequency linear prediction analysis unit 2*h*, the linear prediction inverse filter unit 2*i*, and the linear prediction filter unit 2*k* of the speech decoding device 24*b* of the modification 2, and further includes the time slot selecting unit 3*a*. The primary high frequency adjusting unit 2*j*1 performs at least one of the processes in the "HF Adjustment" step in SBR in "MPEG-4 AAC", as the primary high frequency adjusting unit 2*j*1 of the modification 2 of the fourth embodiment (process at Step Sm1). The secondary high frequency adjusting unit 2*j*2 performs at least one of the processes in the "HF Adjustment" step in SBR in "MPEG-4 AAC", as the secondary high frequency adjusting unit 2*j*2 of the modification 2 of the fourth embodiment (process at Step Sm2). It is preferable that the process performed by the secondary high frequency adjusting unit 2*j*2 be a process not performed by the primary high frequency adjusting unit 2*j*1 among the processes in the "HF Adjustment" step in SBR in "MPEG-4 AAC".

Modification 9 of Fourth Embodiment

Figure 35:
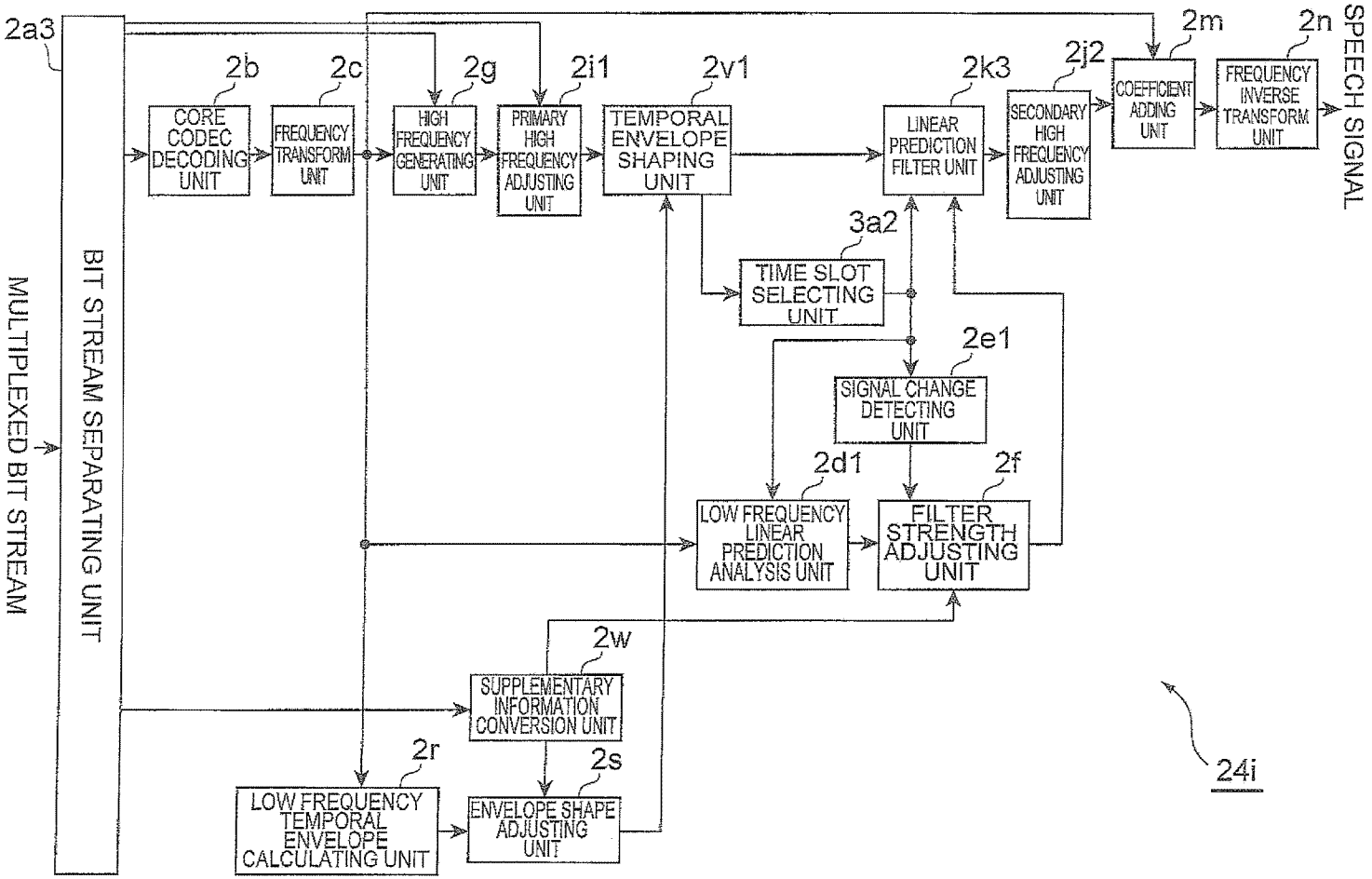
FIG. 35 is a diagram illustrating an example of a speech decoding device according to another modification of the fourth embodiment.
Figure 36:
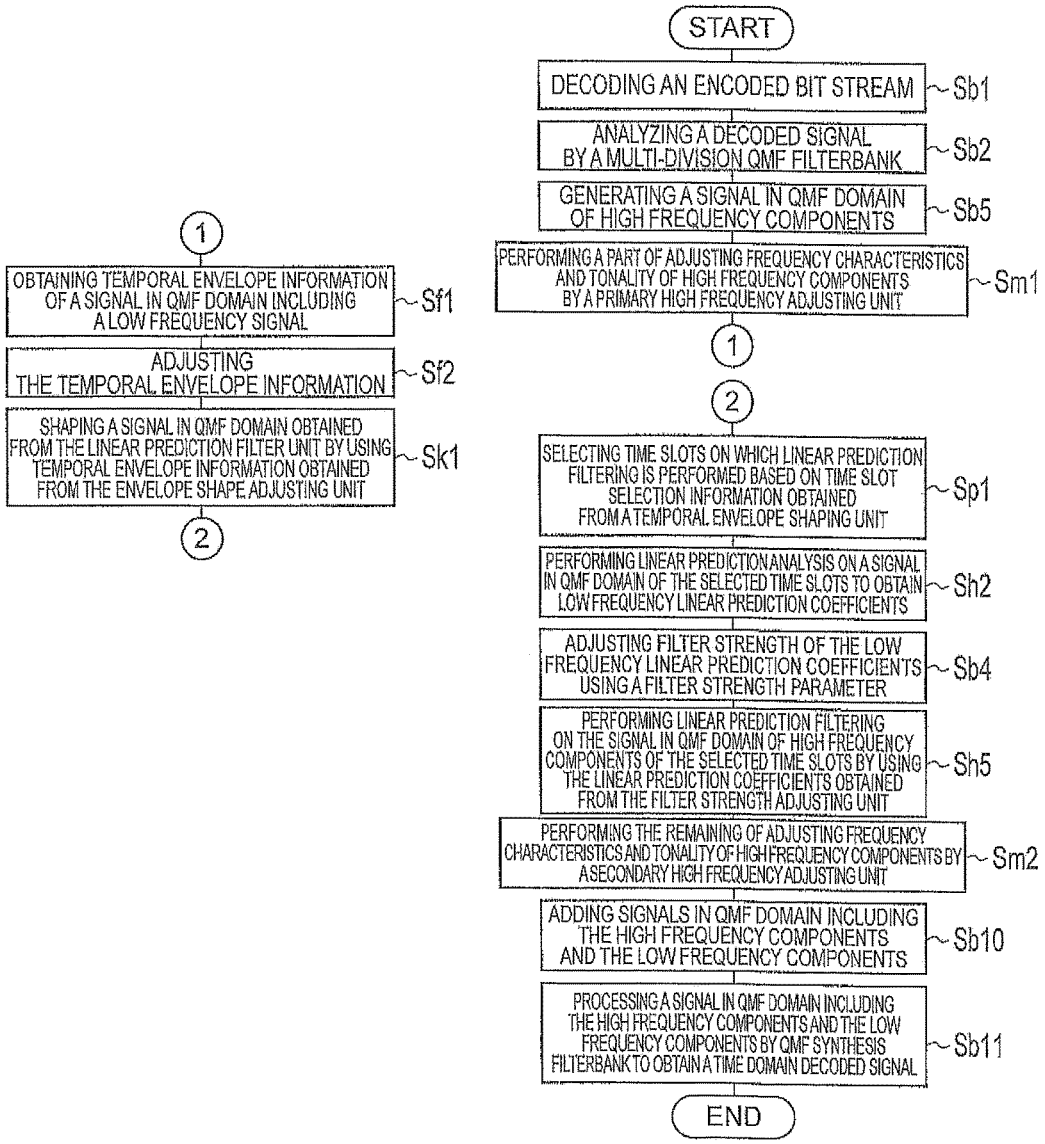
FIG. 36 is a flowchart to describe an example operation of the speech decoding device according to the modification of the fourth embodiment illustrated in FIG. 35.

A speech decoding device 24*i* (see FIG. 35) of the modification 9 of the fourth embodiment physically includes a CPU, a ROM, a RAM, a communication device, and the like, which are not illustrated, and the CPU integrally controls the speech decoding device 24*i* by loading and executing a predetermined computer program (such as a computer program for performing processes illustrated in the example flowchart of FIG. 36) stored in a built-in memory of the speech decoding device 24*i* such as the ROM into the RAM. The communication device of the speech decoding device 24*i* receives the encoded multiplexed bit stream and outputs a decoded speech signal to outside the speech decoding device 24*i*. The speech decoding device 24*i*, as illustrated in the example embodiment of FIG. 35, omits the high frequency linear prediction analysis unit 2*h*1 and the linear prediction inverse filter unit 2*i*1 of the speech decoding device 24*h* of the modification 8 that can be omitted throughout the fourth embodiment as the first embodiment, and includes the temporal envelope shaping unit 2*v*1 and the time slot selecting unit 3*a*2 instead of the temporal envelope shaping unit 2*v* and the time slot selecting unit 3*a* of the speech decoding device 24*h* of the modification 8. The speech decoding device 24*i* also changes the order of the linear prediction synthesis filtering performed by the linear prediction filter unit 2*k*3 and the temporal envelope shaping process performed by the temporal envelope shaping unit 2*v*1 whose processing order is interchangeable throughout the fourth embodiment.

Modification 10 of Fourth Embodiment

Figure 37:
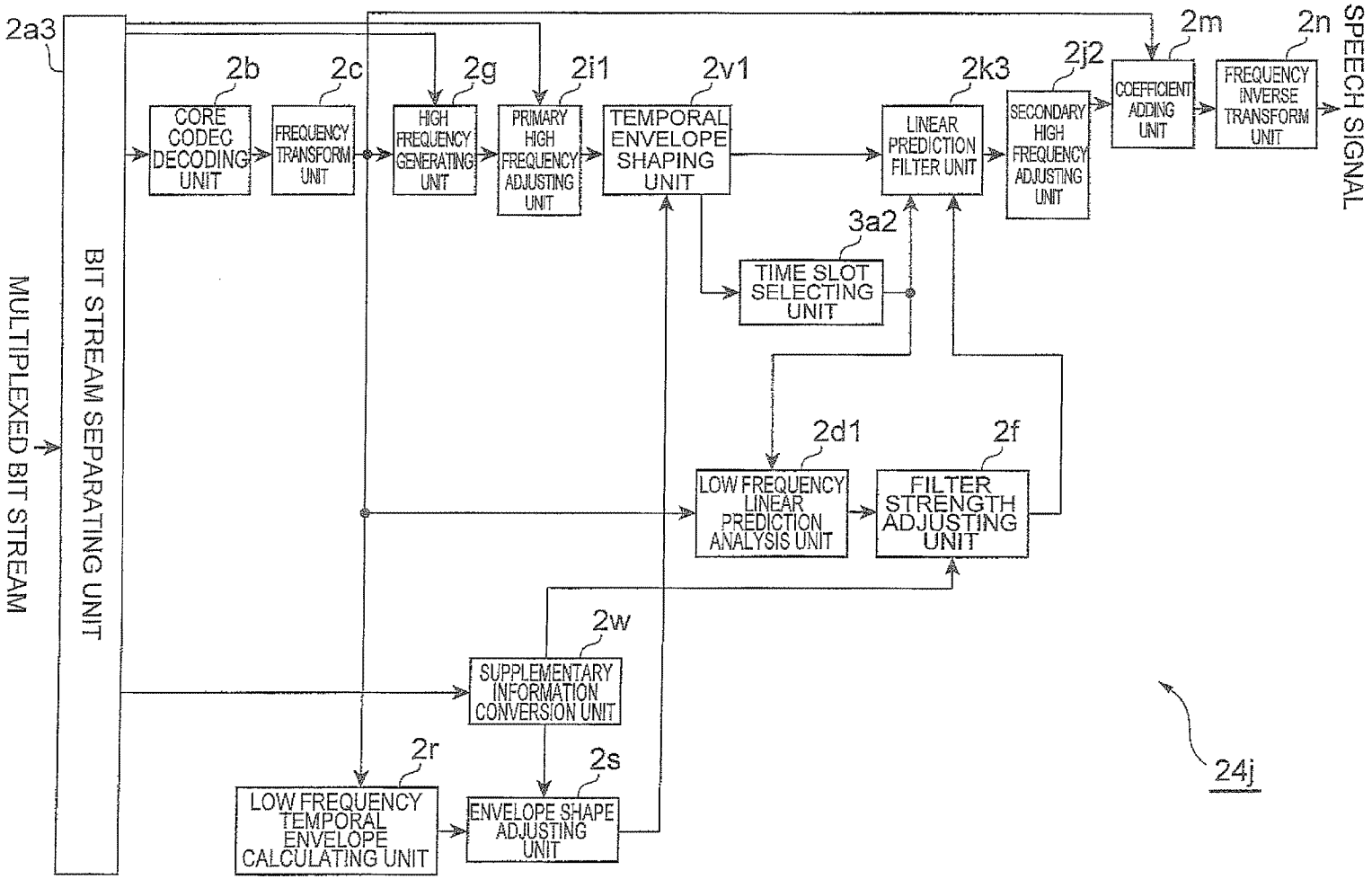
FIG. 37 is a diagram illustrating an example of a speech decoding device according to another modification of the fourth embodiment.

A speech decoding device 24*j* (see FIG. 37) of a modification 10 of the fourth embodiment physically includes a CPU, a ROM, a RAM, a communication device, and the like, which are not illustrated, and the CPU integrally controls the speech decoding device 24*j* by loading and executing a predetermined computer program (such as a computer program for performing processes illustrated in the example flowchart of FIG. 36) stored in a built-in memory of the speech decoding device 24*j* such as the ROM into the RAM. The communication device of the speech decoding device 24*j* receives the encoded multiplexed bit stream and outputs a decoded speech signal to outside the speech decoding device 24*j*. The speech decoding device 24*j*, as illustrated in example of FIG. 37, omits the signal change detecting unit 2*e*1, the high frequency linear prediction analysis unit 2*h*1, and the linear prediction inverse filter unit 2*i*1 of the speech decoding device 24*h* of the modification 8 that can be omitted throughout the fourth embodiment as the first embodiment, and includes the temporal envelope shaping unit 2*v*1 and the time slot selecting unit 3*a*2 instead of the temporal envelope shaping unit 2*v* and the time slot selecting unit 3*a* of the speech decoding device 24*h* of the modification 8. The order of the linear prediction synthesis filtering performed by the linear prediction filter unit 2*k*3 and the temporal envelope shaping process performed by the temporal envelope shaping unit 2*v*1 is changed, whose processing order is interchangeable throughout the fourth embodiment.

Modification 11 of Fourth Embodiment

Figure 38:
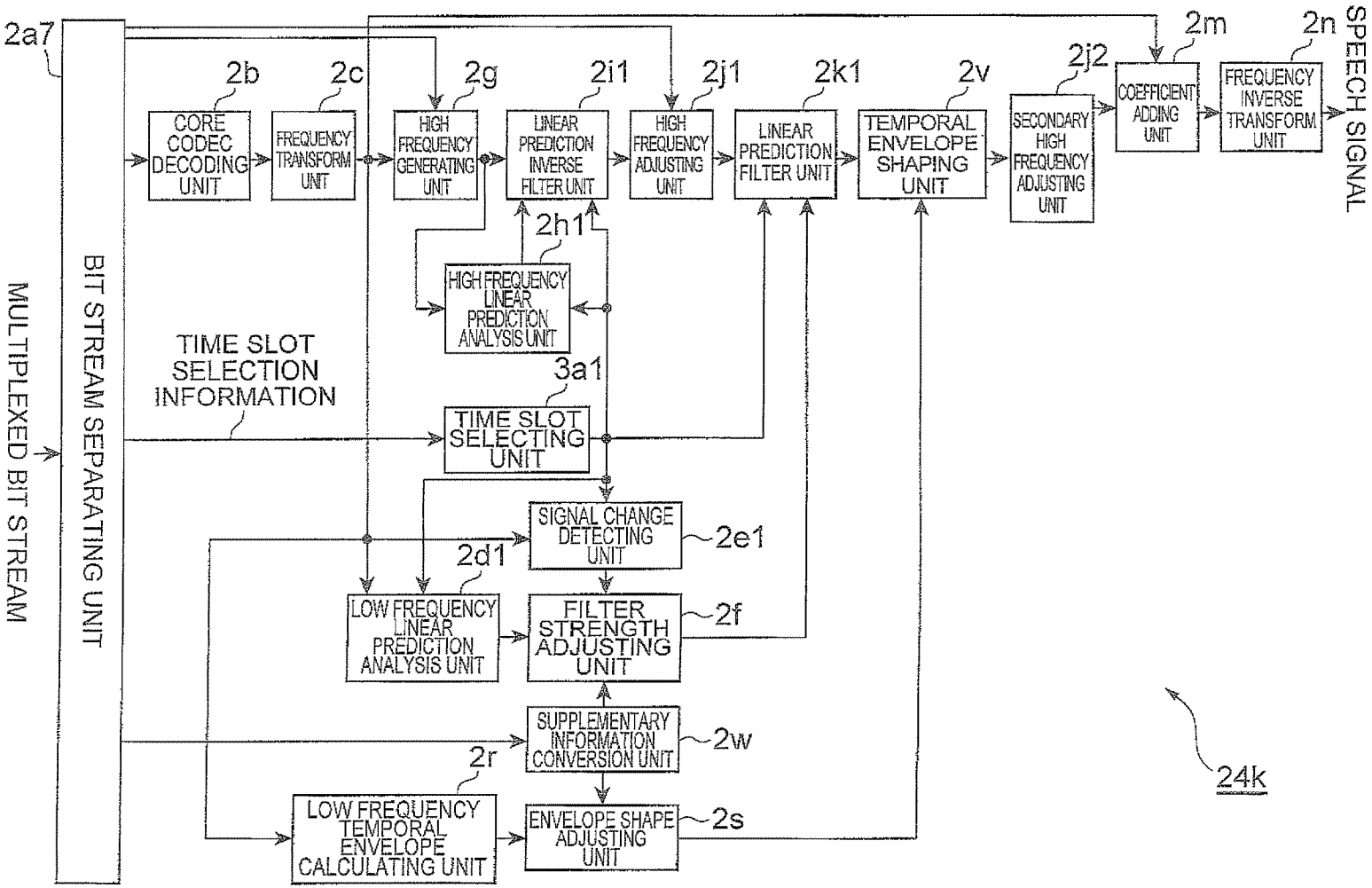
FIG. 38 is a diagram illustrating an example of a speech decoding device according to another modification of the fourth embodiment.
Figure 39:
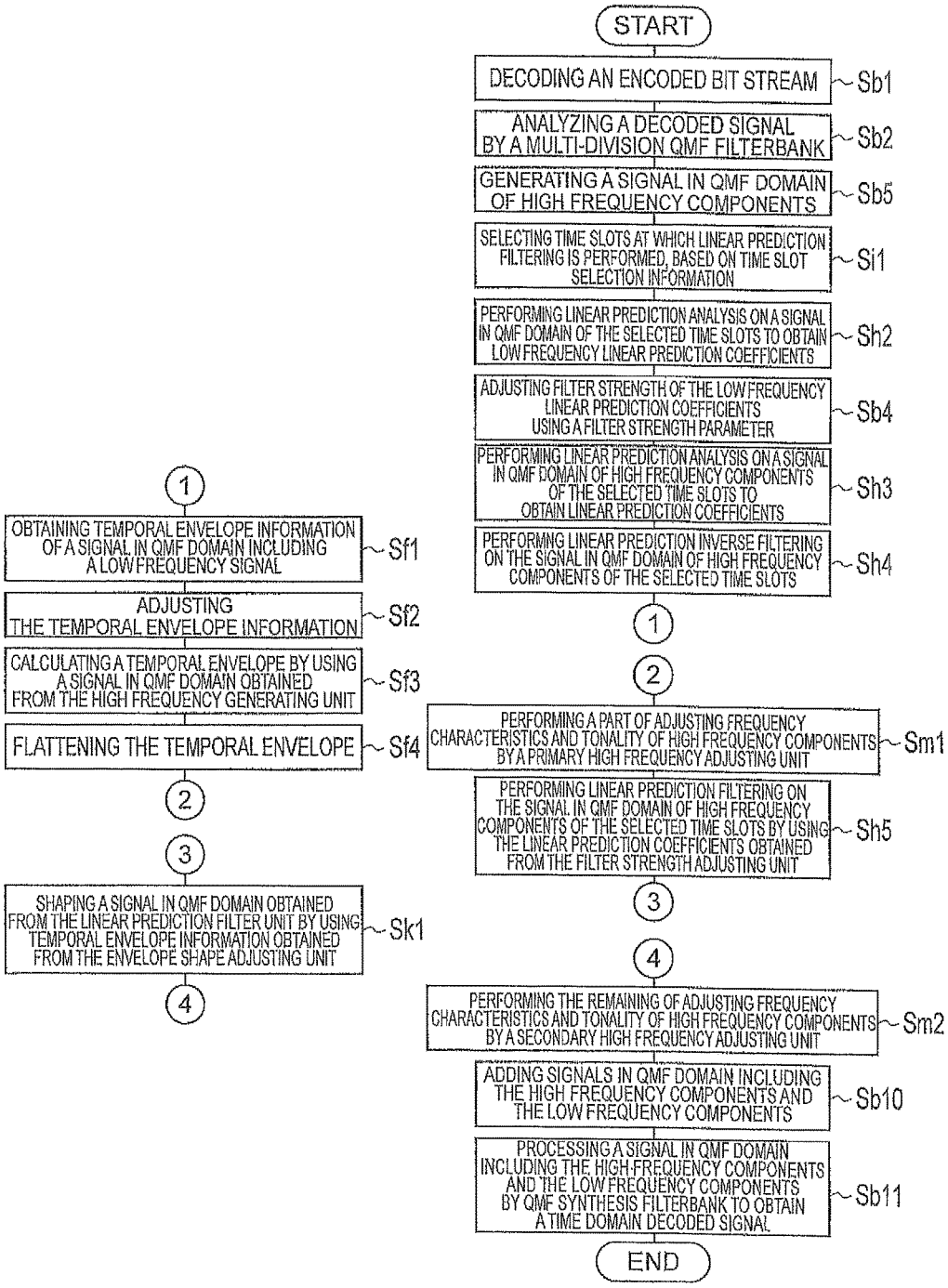
FIG. 39 is a flowchart to describe an example operation of the speech decoding device according to the modification of the fourth embodiment illustrated in FIG. 38.

A speech decoding device 24*k* (see FIG. 38) of a modification 11 of the fourth embodiment physically includes a CPU, a ROM, a RAM, a communication device, and the like, which are not illustrated, and the CPU integrally controls the speech decoding device 24*k* by loading and executing a predetermined computer program (such as a computer program for performing processes illustrated in the example flowchart of FIG. 39) stored in a built-in memory of the speech decoding device 24*k* such as the ROM into the RAM. The communication device of the speech decoding device 24*k* receives the encoded multiplexed bit stream and outputs a decoded speech signal to outside the speech decoding device 24*k*. The speech decoding device 24*k*, as illustrated in the example of FIG. 38, includes the bit stream separating unit 2*a*7 and the time slot selecting unit 3a1 instead of the bit stream separating unit 2a3 and the time slot selecting unit 3a of the speech decoding device 24h of the modification 8.

Modification 12 of Fourth Embodiment

Figure 40:
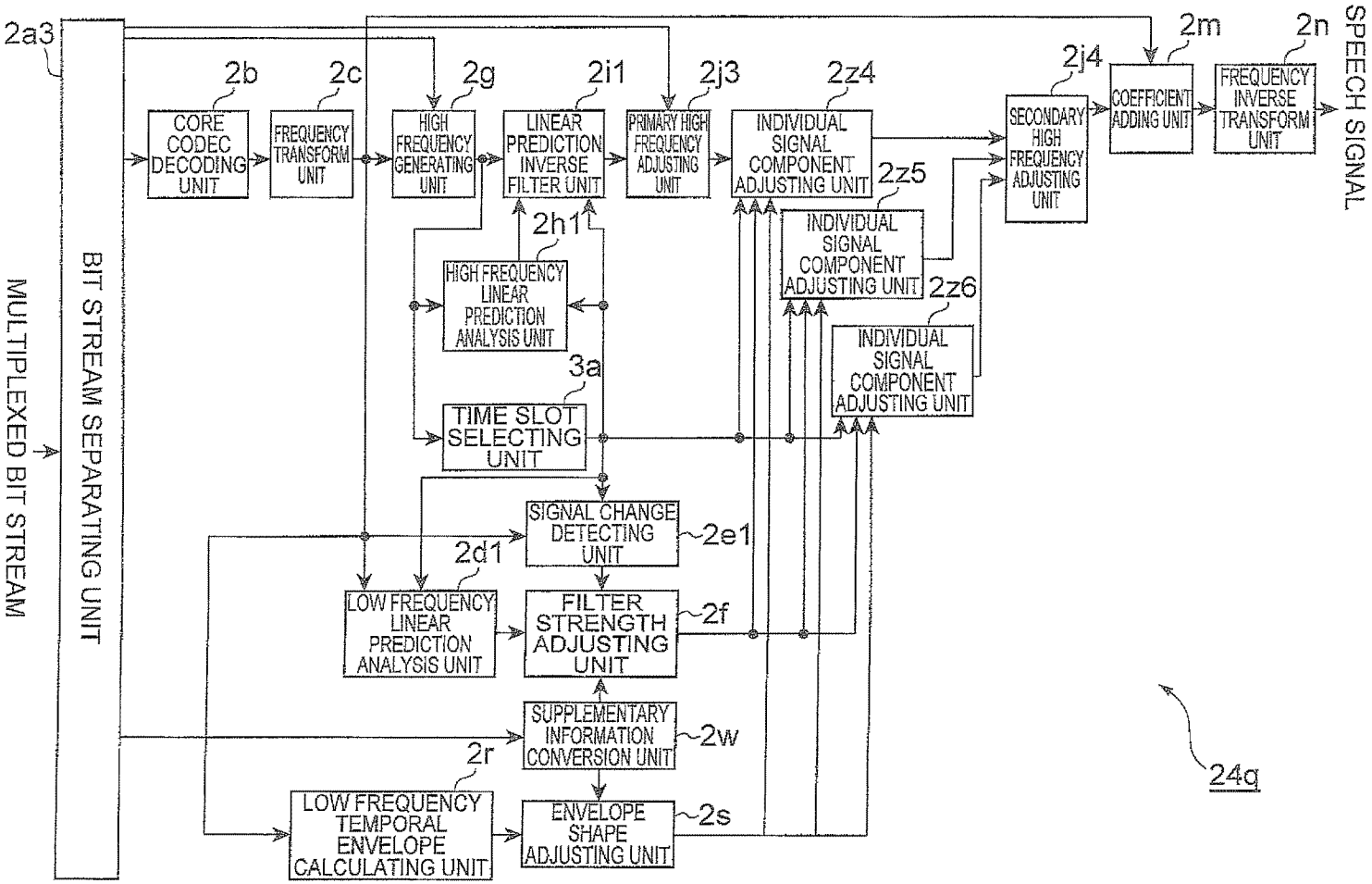
FIG. 40 is a diagram illustrating an example of a speech decoding device according to another modification of the fourth embodiment.
Figure 41:
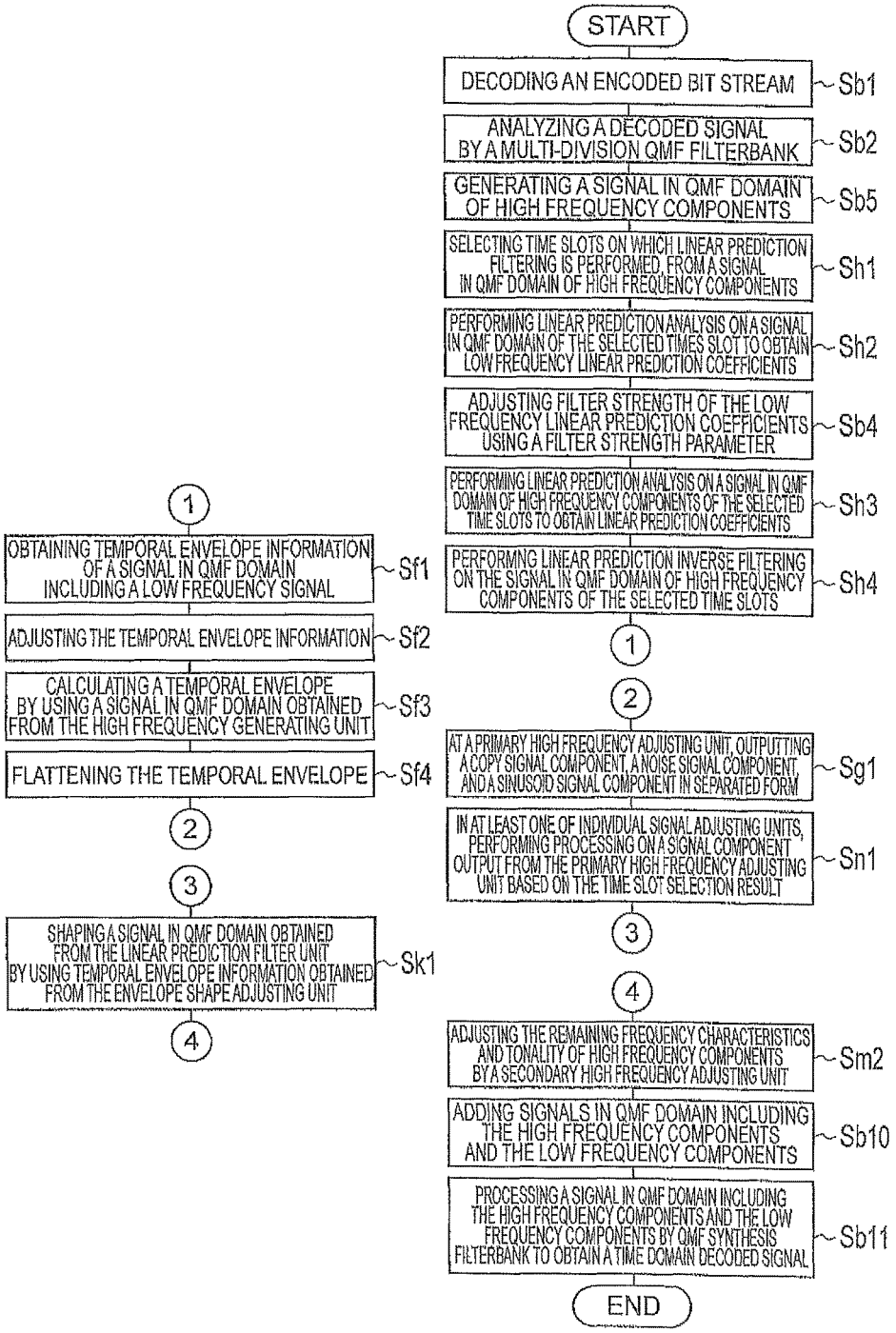
FIG. 41 is a flowchart to describe an example operation of the speech decoding device according to the modification of the fourth embodiment illustrated in FIG. 40.

A speech decoding device 24q (see FIG. 40) of a modification 12 of the fourth embodiment physically includes a CPU, a ROM, a RAM, a communication device, and the like, which are not illustrated, and the CPU integrally controls the speech decoding device 24q by loading and executing a predetermined computer program (such as a computer program for performing processes illustrated in the flowchart of FIG. 41) stored in a built-in memory of the speech decoding device 24q such as the ROM into the RAM. The communication device of the speech decoding device 24q receives the encoded multiplexed bit stream and outputs a decoded speech signal to outside the speech decoding device 24q. The speech decoding device 24q, as illustrated in the example of FIG. 40, includes the low frequency linear prediction analysis unit 2d1, the signal change detecting unit 2e1, the high frequency linear prediction analysis unit 2h1, the linear prediction inverse filter unit 2i1, and individual signal component adjusting units 2z4, 2z5, and 2z6 (individual signal component adjusting units correspond to the temporal envelope shaping unit) instead of the low frequency linear prediction analysis unit 2d, the signal change detecting unit 2e, the high frequency linear prediction analysis unit 2h, the linear prediction inverse filter unit 2i, and the individual signal component adjusting units 2z1, 2z2, and 2z3 of the speech decoding device 24c of the modification 3, and further includes the time slot selecting unit 3a.

At least one of the individual signal component adjusting units 2z4, 2z5, and 2z6 performs processing on the QMF domain signal of the selected time slot, for the signal component included in the output of the primary high frequency adjusting unit, as the individual signal component adjusting units 2z1, 2z2, and 2z3, based on the selection result transmitted from the time slot selecting unit 3a (process at Step Sn1). It is preferable that the process using the time slot selection information include at least one process including the linear prediction synthesis filtering in the frequency direction, among the processes of the individual signal component adjusting units 2z1, 2z2, and 2z3 described in the modification 3 of the fourth embodiment.

The processes performed by the individual signal component adjusting units 2z4, 2z5, and 2z6 may be the same as the processes performed by the individual signal component adjusting units 2z1, 2z2, and 2z3 described in the modification 3 of the fourth embodiment, but the individual signal component adjusting units 2z4, 2z5, and 2z6 may shape the temporal envelope of each of the plurality of signal components included in the output of the primary high frequency adjusting unit by different methods (if all the individual signal component adjusting units 2z4, 2z5, and 2z6 do not perform processing based on the selection result transmitted from the time slot selecting unit 3a, it is the same as the modification 3 of the fourth embodiment of the present invention).

All the selection results of the time slot transmitted to the individual signal component adjusting units 2z4, 2z5, and 2z6 from the time slot selecting unit 3a need not be the same, and all or a part thereof may be different.

In FIG. 40, the result of the time slot selection is transmitted to the individual signal component adjusting units 2z4, 2z5, and 2z6 from one time slot selecting unit 3a. However, it is possible to include a plurality of time slot selecting units for notifying, of the different results of the time slot selection, each or a part of the individual signal component adjusting units 2z4, 2z5, and 2z6. At this time, the time slot selecting unit relative to the individual signal component adjusting unit among the individual signal component adjusting units 2z4, 2z5, and 2z6 that performs the process 4 (the process of multiplying each QMF subband sample by the gain coefficient is performed on the input signal by using the temporal envelope obtained from the envelope shape adjusting unit 2s as the temporal envelope shaping unit 2v, and then the linear prediction synthesis filtering in the frequency direction is also performed on the output signal by using the linear prediction coefficients received from the filter strength adjusting unit 2f as the linear prediction filter unit 2k) described in the modification 3 of the fourth embodiment may select the time slot by using the time slot selection information supplied from the temporal envelope transformation unit.

Modification 13 of Fourth Embodiment

Figure 42:
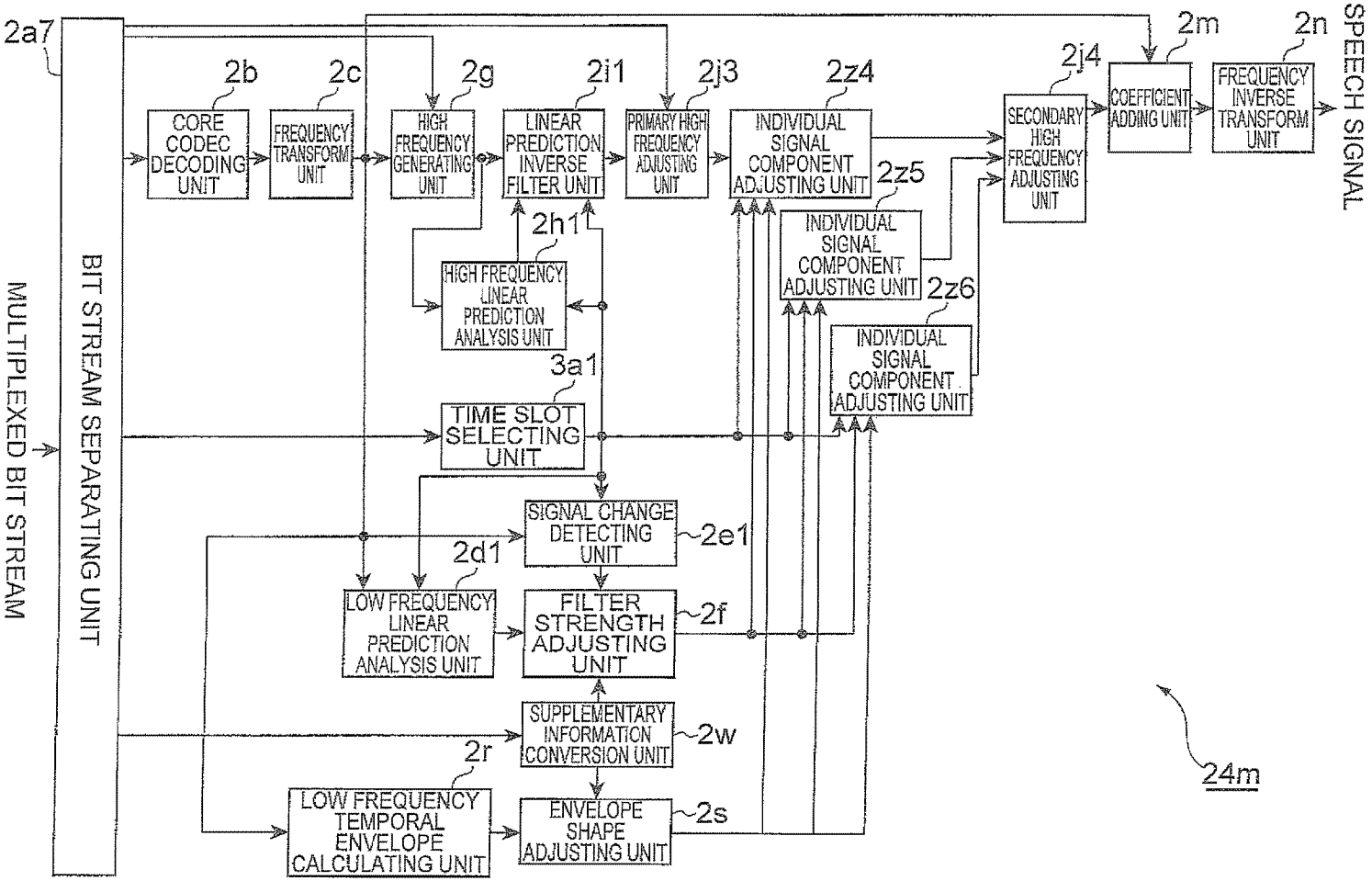
FIG. 42 is a diagram illustrating an example of a speech decoding device according to another modification of the fourth embodiment.
Figure 43:
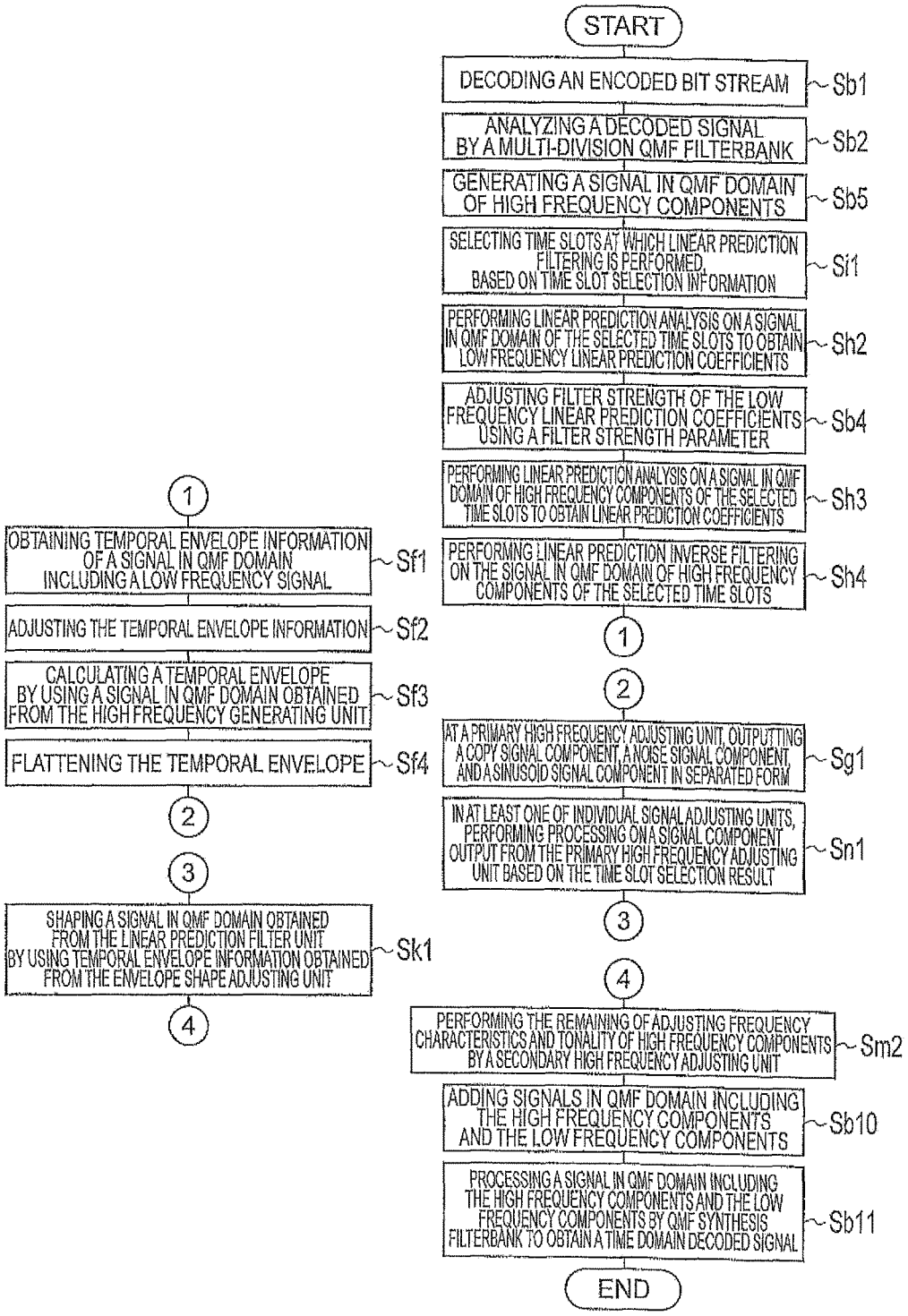
FIG. 43 is a flowchart to describe an example operation of the speech decoding device according to the modification of the fourth embodiment illustrated in FIG. 42.

A speech decoding device 24m (see FIG. 42) of a modification 13 of the fourth embodiment physically includes a CPU, a ROM, a RAM, a communication device, and the like, which are not illustrated, and the CPU integrally controls the speech decoding device 24m by loading and executing a predetermined computer program (such as a computer program for performing processes illustrated in the flowchart of FIG. 43) stored in a built-in memory of the speech decoding device 24m such as the ROM into the RAM. The communication device of the speech decoding device 24m receives the encoded multiplexed bit stream and outputs a decoded speech signal to outside the speech decoding device 24m. The speech decoding device 24m, as illustrated in FIG. 42, includes the bit stream separating unit 2a7 and the time slot selecting unit 3a1 instead of the bit stream separating unit 2a3 and the time slot selecting unit 3a of the speech decoding device 24q of the modification 12.

Modification 14 of Fourth Embodiment

A speech decoding device 24n (not illustrated) of a modification 14 of the fourth embodiment physically includes a CPU, a ROM, a RAM, a communication device, and the like, which are not illustrated, and the CPU integrally controls the speech decoding device 24n by loading and executing a predetermined computer program stored in a built-in memory of the speech decoding device 24n such as the ROM into the RAM. The communication device of the speech decoding device 24n receives the encoded multiplexed bit stream and outputs a decoded speech signal to outside the speech decoding device 24n. The speech decoding device 24n functionally includes the low frequency linear prediction analysis unit 2d1, the signal change detecting unit 2e1, the high frequency linear prediction analysis unit 2h1, the linear prediction inverse filter unit 2i1, and the linear prediction filter unit 2k3 instead of the low frequency linear prediction analysis unit 2d, the signal change detecting unit 2e, the high frequency linear prediction analysis unit 2h, the linear prediction inverse filter unit 2i, and the linear prediction filter unit 2k of the speech decoding device 24a of the modification 1, and further includes the time slot selecting unit 3a.

Modification 15 of Fourth Embodiment

A speech decoding device 24p (not illustrated) of a modification 15 of the fourth embodiment physically includes a CPU, a ROM, a RAM, a communication device, and the like, which are not illustrated, and the CPU integrally controls the speech decoding device 24*p* by loading and executing a predetermined computer program stored in a built-in memory of the speech decoding device 24*p* such as the ROM into the RAM. The communication device of the speech decoding device 24*p* receives the encoded multiplexed bit stream and outputs a decoded speech signal to outside the speech decoding device 24*p*. The speech decoding device 24*p* functionally includes the time slot selecting unit 3*a*1 instead of the time slot selecting unit 3*a* of the speech decoding device 24*n* of the modification 14. The speech decoding device 24*p* also includes a bit stream separating unit 2*a*8 (not illustrated) instead of the bit stream separating unit 2*a*4.

The bit stream separating unit 2*a*8 separates the multiplexed bit stream into the SBR supplementary information and the encoded bit stream as the bit stream separating unit 2*a*4, and further into the time slot selection information.

INDUSTRIAL APPLICABILITY

The present invention provides a technique applicable to the bandwidth extension technique in the frequency domain represented by SBR, and to reduce the occurrence of pre-echo and post-echo and improve the subjective quality of the decoded signal without significantly increasing the bit rate.

REFERENCE SIGNS LIST

11, 11*a*, 11*b*, 11*c*, 12, 12*a*, 12*b*, 13, 14, 14*a*, 14*b* speech encoding device
1*a* frequency transform unit
1*b* frequency inverse transform unit
1*c* core codec encoding unit
1*d* SBR encoding unit
1*e*, 1*e*1 linear prediction analysis unit
1*f* filter strength parameter calculating unit
1*f*1 filter strength parameter calculating unit
1*g*, 1*g*1, 1*g*2, 1*g*3, 1*g*4, 1*g*5, 1*g*6, 1*g*7 bit stream multiplexing unit
1*h* high frequency inverse transform unit
1*i* short-term power calculating unit
1*j* linear prediction coefficient decimation unit
1*k* linear prediction coefficient quantizing unit
1*m* temporal envelope calculating unit
1*n* envelope shape parameter calculating unit
1*p*, 1*p*1 time slot selecting unit
21, 22, 23, 24, 24*b*, 24*c* speech decoding device
2*a*, 2*a*1, 2*a*2, 2*a*3, 2*a*5, 2*a*6, 2*a*7 bit stream separating unit
2*b* core codec decoding unit
2*c* frequency transform unit
2*d*, 2*d*1 low frequency linear prediction analysis unit
2*e*, 2*e*1 signal change detecting unit
2*f* filter strength adjusting unit
2*g* high frequency generating unit
2*h*, 2*h*1 high frequency linear prediction analysis unit
2*i*, 2*i*1 linear prediction inverse filter unit
2*j*, 2*j*1, 2*j*2, 2*j*3, 2*j*4 high frequency adjusting unit
2*k*, 2*k*1, 2*k*2, 2*k*3 linear prediction filter unit
2*m* coefficient adding unit
2*n* frequency inverse transform unit
2*p*, 2*p*1 linear prediction coefficient interpolation/extrapolation unit
2*r* low frequency temporal envelope calculating unit
2*s* envelope shape adjusting unit
2*t* high frequency temporal envelope calculating unit
2*u* temporal envelope smoothing unit
2*v*, 2*v*1 temporal envelope shaping unit
2*w* supplementary information conversion unit
2*z*1, 2*z*2, 2*z*3, 2*z*4, 2*z*5, 2*z*6 individual signal component adjusting unit
3*a*, 3*a*1, 3*a*2 time slot selecting unit

We claim:

1. A speech decoding device for decoding an encoded speech signal, the speech decoding device comprising:
a processor configured to:
separate a bit stream that includes the encoded speech signal into an encoded bit stream and temporal envelope supplementary information, the bit stream received from outside the speech decoding device and the temporal envelope supplementary information comprising an indicator associated with a predetermined parameter;
decode the encoded bit stream to obtain a low frequency component;
transform the low frequency component into a spectral region;
generate a high frequency component by copying, from a low frequency band to a high frequency band, the low frequency component transformed into the spectral region;
adjust the high frequency component generated by the high frequency generating unit to generate an adjusted high frequency component;
analyze the low frequency component transformed into the spectral region to obtain temporal envelope information;
obtain the temporal envelope information by obtaining power of each quadrature mirror filter (QMF) subband sample of the low frequency component transformed into the spectral region;
convert the indicator included in the temporal envelope supplementary information into the predetermined parameter, wherein the predetermined parameter is for adjustment of the temporal envelope information;
adjust the temporal envelope information by adjusting the each QMF subband sample using the predetermined parameter to generate adjusted temporal envelope information; and
shape a temporal envelope of the adjusted high frequency component using the adjusted temporal envelope information.

2. The speech decoding device according to claim 1, wherein the processor is further configured to obtain the temporal envelope information by normalization of the power of the each QMF subband sample by use of average power in an spectral band replication (SBR) envelope time segment.

3. A speech decoding device for decoding an encoded speech signal, the speech decoding device comprising:
a processor configured to:
decode a bit stream that includes the encoded speech signal to obtain a low frequency component, the bit stream received from outside the speech decoding device;
transform the low frequency component into a spectral region;
generate a high frequency component by copying the low frequency component, transformed into the spectral region, from a low frequency band to a high frequency band;
adjust the high frequency component to generate an adjusted high frequency component;

analyze the low frequency component transformed into the spectral region to obtain temporal envelope information;

obtain the temporal envelope information by obtaining a power value of each quadrature mirror filter (QMF) subband sample of the low frequency component transformed into the spectral region;

analyze the bit stream and extract an indicator included in the bit stream, the indicator associated with a predetermined parameter, the predetermined parameter for adjustment of the temporal envelope information;

generate the predetermined parameter for adjustment of the temporal envelope information by conversion of the indicator extracted from the bit stream into the predetermined parameter;

adjust the temporal envelope information by adjusting the each QMF subband sample using the predetermined parameter to generate adjusted temporal envelope information;

and shape a temporal envelope of the adjusted high frequency component using the adjusted temporal envelope information.

4. The speech decoding device according to claim 3, wherein the processor is further configured to obtain the temporal envelope information by normalization of the power of the each QMF subband sample by use of average power in an spectral band replication (SBR) envelope time segment.

5. A speech decoding method using a speech decoding device for decoding an encoded speech signal, the speech decoding method comprising:

a bit stream separating step in which the speech decoding device separates a bit stream that includes the encoded speech signal into an encoded bit stream and temporal envelope supplementary information, the bit stream received from outside the speech decoding device and the temporal envelope supplementary information comprising an indicator associated with a predetermined parameter;

a core decoding step in which the speech decoding device obtains a low frequency component by decoding the encoded bit stream separated in the bit stream separating step;

a frequency transform step in which the speech decoding device transforms the low frequency component obtained in the core decoding step into a spectral region;

a high frequency generating step in which the speech decoding device generates a high frequency component by copying the low frequency component transformed into the spectral region in the frequency transform step from a low frequency band to a high frequency band;

a high frequency adjusting step in which the speech decoding device adjusts the high frequency component generated in the high frequency generating step to generate an adjusted high frequency component;

a low frequency temporal envelope analysis step in which the speech decoding device obtains temporal envelope information by analyzing the low frequency component transformed into the spectral region in the frequency transform step, wherein the temporal envelope information is obtained by obtaining a power of each quadrature mirror filter (QMF) subband sample of the low frequency component transformed into the spectral region in the frequency transform step;

a supplementary information converting step in which the speech decoding device converts the indicator included in the temporal envelope supplementary information into the predetermined parameter, the predetermined parameter for adjusting the temporal envelope information;

a temporal envelope adjusting step in which the speech decoding device adjusts the temporal envelope information obtained in the low frequency temporal envelope analysis step by adjusting the each QMF subband sample to generate adjusted temporal envelope information, wherein the predetermined parameter is utilized in said adjusting of the temporal envelope information; and a temporal envelope shaping step in which the speech decoding device shapes a temporal envelope of the adjusted high frequency component using the adjusted temporal envelope information.

6. A speech decoding method using a speech decoding device for decoding an encoded speech signal, the speech decoding method comprising:

a core decoding step in which the speech decoding device decodes a bit stream that includes the encoded speech signal to obtain a low frequency component, the bit stream received from outside the speech decoding device;

a frequency transform step in which the speech decoding device transforms the low frequency component obtained in the core decoding step into a spectral region;

a high frequency generating step in which the speech decoding device generates a high frequency component by copying the low frequency component transformed into the spectral region in the frequency transform step from a low frequency band to a high frequency band;

a high frequency adjusting step in which the speech decoding device adjusts the high frequency component generated in the high frequency generating step to generate an adjusted high frequency component;

a low frequency temporal envelope analysis step in which the speech decoding device obtains temporal envelope information by analyzing the low frequency component transformed into the spectral region in the frequency transform step, wherein the temporal envelope information is obtained by obtaining a power value of each quadrature mirror filter (QMF) subband sample of the low frequency component transformed into the spectral region in the frequency transform step;

a temporal envelope supplementary information generating step in which the speech decoding device analyzes the bit stream, extracts an indicator associated with a predetermined parameter, and converts the indicator into the predetermined parameter, wherein the predetermined parameter is for adjusting the temporal envelope information;

a temporal envelope adjusting step in which the speech decoding device adjusts the temporal envelope information obtained in the low frequency temporal envelope analysis step by adjusting the each QMF subband sample to generate adjusted temporal envelope information, wherein the predetermined parameter is utilized in said adjusting of the temporal envelope information; and a temporal envelope shaping step in which the speech decoding device shapes a temporal envelope of the adjusted high frequency component using the adjusted temporal envelope information.

7. A non-transitory storage medium that stores instructions executable by a processor to decode an encoded speech signal, the storage medium comprising:

instructions executable by the processor to separate a bit stream that includes the encoded speech signal into an encoded bit stream and temporal envelope supplementary information, the temporal envelope supplementary information comprising an indicator associated with a predetermined parameter for adjusting the temporal envelope information;

instructions executable by the processor to decode the encoded bit stream to obtain a low frequency component;

instructions executable by the processor to transform the low frequency component into a spectral region;

instructions executable by the processor to generate a high frequency component by copying the low frequency component transformed into the spectral region from a low frequency band to a high frequency band;

instructions executable by the processor to adjust the high frequency component to generate an adjusted high frequency component;

instructions executable by the processor to analyze the low frequency component transformed into the spectral region to obtain temporal envelope information by determination of a power of each quadrature mirror filter (QMF) subband sample of the low frequency component transformed into the spectral region by the frequency transform means;

instructions executable by the processor to convert the indicator included in the temporal envelope supplementary information into the predetermined parameter for adjusting the temporal envelope information;

instructions executable by the processor to adjust the temporal envelope information by adjusting the each QMF subband sample to generate adjusted temporal envelope information using the predetermined parameter; and instructions executable by the processor to shape a temporal envelope of the adjusted high frequency component using the adjusted temporal envelope information.

8. A non-transitory storage medium that stores instructions executable by a processor to decode an encoded speech signal, the storage medium comprising:

instructions executable by the processor to decode a bit stream that includes the encoded speech signal to obtain a low frequency component;

instructions executable by the processor to transform the low frequency component into a spectral region;

instructions executable by the processor to generate a high frequency component by copying the low frequency component transformed into the spectral region from a low frequency band to a high frequency band;

instructions executable by the processor to adjust the high frequency component to generate an adjusted high frequency component;

instructions executable by the processor to analyze the low frequency component transformed into the spectral region to obtain temporal envelope information by determination of a power value of each QMF subband sample of the low frequency component transformed into the spectral region;

instructions executable by the processor to analyze the bit stream, extract from the bit stream an indicator associated with a predetermined parameter, and convert the indicator to the predetermined parameter, the predetermined parameter for adjustment of the temporal envelope information;

instructions executable by the processor to adjust the temporal envelope information by adjusting the each QMF subband sample to generate adjusted temporal envelope information using the predetermined parameter; and instructions executable by the processor to shape a temporal envelope of the adjusted high frequency component using the adjusted temporal envelope information.

* * * * *